US006862417B2

(12) United States Patent
Tsunoda et al.

(10) Patent No.: US 6,862,417 B2
(45) Date of Patent: Mar. 1, 2005

(54) IMAGE FORMATION APPARATUS, SOUND QUALITY EVALUATION METHOD, METHOD OF MANUFACTURING IMAGE FORMATION APPARATUS, AND METHOD OF REMODELING IMAGE FORMATION APPARATUS

(75) Inventors: Koichi Tsunoda, Kanagawa (JP); Motohisa Hirono, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 1 day.

(21) Appl. No.: 10/628,245

(22) Filed: Jul. 29, 2003

(65) Prior Publication Data

US 2004/0062563 A1 Apr. 1, 2004

(30) Foreign Application Priority Data

| | | |
|---|---|---|
| Jul. 29, 2002 | (JP) | 2002-220404 |
| Aug. 23, 2002 | (JP) | 2002-244063 |
| Sep. 19, 2002 | (JP) | 2002-274110 |
| Nov. 18, 2002 | (JP) | 2002-334270 |
| Jul. 29, 2003 | (JP) | 2003-203359 |

(51) Int. Cl.[7] ..... G03G 21/20
(52) U.S. Cl. ..... 399/91; 381/94.1
(58) Field of Search ..... 399/1, 91, 411; 381/71.1, 71.2, 71.3, 71.14, 94.1

(56) References Cited

U.S. PATENT DOCUMENTS 4,954,849 A 9/1990 Koike et al.
4,975,749 A 12/1990 Tsunoda et al.

(List continued on next page.)

FOREIGN PATENT DOCUMENTS

| | | |
|---|---|---|
| JP | 9-193506 | 7/1997 |
| JP | 10-232163 | 9/1998 |
| JP | 10-253440 | 9/1998 |
| JP | 10-253442 | 9/1998 |
| JP | 10-267742 | 10/1998 |
| JP | 10-267743 | 10/1998 |

OTHER PUBLICATIONS

M. Ohashi, et al., Ono Sokki Co., Ltd, 4 pages, "Binaural Sound Measurement System for Psychoacoustic Parameters".

(List continued on next page.)

*Primary Examiner*—Robert Beatty
(74) *Attorney, Agent, or Firm*—Oblon, Spivak, McClelland, Maier & Neustadt, P.C.

(57) ABSTRACT

In an image formation apparatus, a discomfort probability P, calculated from an expression (a), fulfills a condition (b). Here, $$\hat{P}_{im}=1/\{1+\exp[-z]\} \quad \text{(a)}$$

$$\hat{P}_{im}\leqq 0.2725\cdot\ln(\text{ppm})-0.6331 \quad \text{(b)}$$

where z=A×sound pressure level i+B×loudness i+C×sharpness i+D×tonality i+E×impulsiveness i+F, i=1, 2, 3, . . . , n, A, B, C, D, and E are regression coefficients of parameters, and F is intercept, and A, B, C, D, E, and F satisfy the inequalities $0.142\leqq A\leqq 0.183$, $0.300\leqq B\leqq 0.389$, $1.097\leqq C\leqq 1.265$, $9.818\leqq D\leqq 11.516$, $2.588\leqq E\leqq 3.240$, $-18.844\leqq F\leqq 14.968$, ppm is a printing speed per minute for A4 horizontal size paper.

106 Claims, 19 Drawing Sheets

U.S. PATENT DOCUMENTS

| | | | | | |
|---|---|---|---|---|---|
| 4,979,727 | A | | 12/1990 | Koike et al. | |
| 5,014,091 | A | | 5/1991 | Koike et al. | |
| 5,245,385 | A | * | 9/1993 | Fukumizu et al. | 399/91 |
| 5,289,147 | A | * | 2/1994 | Koike et al. | 399/1 |
| 5,867,748 | A | * | 2/1999 | Takahashi et al. | 399/1 |
| 5,930,557 | A | * | 7/1999 | Sasahara et al. | 399/91 |
| 6,006,054 | A | * | 12/1999 | Wong et al. | 399/91 |
| 6,463,230 | B1 | * | 10/2002 | Wargo | 399/92 |
| 6,466,752 | B2 | | 10/2002 | Tsunoda | |
| 6,697,584 | B2 | * | 2/2004 | Tsunoda et al. | 399/91 |

OTHER PUBLICATIONS

U.S. Appl. No. 10/744,044, filed Dec. 24, 2003, Tsunoda et al.

U.S. Appl. No. 10/722,510, filed Nov. 28, 2003, Tsunoda et al.

U.S. Appl. No. 10/859,186, filed Jun. 3, 2004, Matsumoto et al.

* cited by examiner

IMAGE FORMATION APPARATUS, SOUND QUALITY EVALUATION METHOD, METHOD OF MANUFACTURING IMAGE FORMATION APPARATUS, AND METHOD OF REMODELING IMAGE FORMATION APPARATUS

BACKGROUND OF THE INVENTION

1) Field of the Invention

The present invention relates to a technology that can suppress noise produced by various motors or moving mechanical parts in an image formation apparatus.

2) Description of the Related Art

In recent years, there is a growing request for suppressing unpleasant noise produced by the office automation (OA) equipment in the offices. Noiseless office automation equipment have appeared in market. Such equipment improve the working environment in the offices as they do not produce noise.

A technique for suppressing noise is disclosed in, for example, Japanese Patent Application Laid-open Publication No.9-193506. This publication discloses a noise masking apparatus for the laser beam printers or the copying machines. This noise masking apparatus includes a sound generator that generates masking sound to mask noise produced by the motors or the moving mechanical parts. Moreover, a masking sound controller controls the sound generator to generate an appropriate masking sound. The masking sound is of a frequency that includes the frequency range of the main component of the noise. In this technique, however, as the masking noise is added to the noise, sometimes the noise level raises. Moreover, additional space is required to accommodate the sound generator and the masking sound controller.

It is common to use the acoustic power level (ISO7779) to evaluate noise in the office automation equipment. However, the acoustic power level is the value of the acoustic energy produced by the office automation equipment and has a little correlation with human subjective discomfort about noise. For example, even if two sounds have same acoustic power level, a listener may feel only one of them to be noisy. Moreover, some listener may feel that the sound is noisy even if the acoustic power level is low.

Therefore, the better approach will be to improve the sound quality in addition to lowering the acoustic power level of the office automation equipment. To improve the sound quality, it is necessary to quantitatively measure the sound quality before and after the improvement. However, as the sound quality is not physical parameter, it can not be measured quantitatively. In other words, evaluation of sound quality is different depending on persons. Only qualitative expression is possible such as "the sound quality is a little improved" or "the sound quality is substantially improved". When the sound quality cannot be quantitatively expressed as physical characteristics, the effect of a sound quality improvement measure taken cannot be subjectively evaluated. Therefore, it is necessary to carry out a subjective evaluation experiment and statistically quantify the sound quality based on a result of this experiment.

A psycho-acoustics parameter is available as a physical level to evaluate sound quality. The following representative parameters are available. Refer to "The seventh design optic system lecture" of the Japan Society of Mechanical Engineers, "Targeting at an innovative jump of design and system toward the twenty-first century!", Nov. 10, 1997, "Sound, oscillation, design, color, and design (1)", 089B. Units are expressed in brackets.

(1) Loudness (sone): loudness of sound
(2) Sharpness (acum): relative distribution of higher harmonic components
(3) Tonality (tu): tonality, ingredient of pure tone component
(4) Roughness (asper): roughness of sound
(5) Fluctuation strength (vacil): variable strength, beat tone
(6) Impulsiveness (iu): impulsiveness
(7) Relative approach: sensation of fluctuation An increase in each of the above psycho-acoustics parameters tends to increase discomfort. Only the loudness is standardized by the ISO532B. The rest of the psycho-acoustics parameters have the same idea in principle. However, as programs and calculation methods are different depending on individual researches carried out by each maker, measurement values are usually slightly different between makers. It is know that the sound quality can be improved if all these psycho-acoustics parameters are lowered.

Substantial work is necessary to take measures for all the psycho-acoustics parameters. Noise generated from office automation equipment such as a copying machine and a printer includes noise of various tones because of the complexity of the mechanism. For example, somber noise of low frequency shrill noise of high frequency, and impulsive noise are generated while changing from a plurality of noise sources such as a motor, a recording paper, a solenoid, etc.

A person judges these noises as a whole, and determines whether they are unpleasant. The person is considered to make a judgment by weighting a particularly unpleasant element. In other words, psycho-acoustics parameters highly related to discomfort and psycho-acoustics parameters not highly related to discomfort are present. These are different according to tones of machine. For example, when a printer rotates at a high speed and generates impulsive noise many times, impulsive noise is felt most unpleasant. A quiet desktop printer of a relatively low speed gives little impulsive noise. Therefore, charging noise generated when the printer is charged with alternating current (hereinafter, "AC") power is most unpleasant. Unpleasant noise tones are different depending on the output speed of the image formation apparatus. Consequently, tones that require improvement in sound quality are different between low-speed apparatuses and high-speed apparatuses. Therefore, when psycho-acoustics parameters having a large effect of improvement from discomfort are found and improved thereby to efficiently improve the sound quality, trials and errors for the improvement need not be repeated.

Therefore, psycho-acoustics parameters having a large effect of improvement from discomfort are combined together, and these psycho-acoustics parameters are weighted to calculate a sound quality evaluation expression. This sound quality evaluation expression is used to calculate a subjective evaluation value for discomfort. With this arrangement, subjective evaluation of sound quality becomes possible, which improves sound quality. Further, a discomfort subjective evaluation level at which sensation of discomfort is not present is decided. The sound quality is improved to a level not more than this value. When an image formation apparatus that achieves the above is provided, it is possible to solve the noise problems in the office.

The inventor(s) of the present invention obtained sound quality evaluation expressions. These expressions correspond to a copying apparatus of a low copying speed (i.e., printing speed) of 16 to 20 ppm, (where ppm represents a printing speed for A4 horizontal size paper) a copying apparatus of an intermediate copying speed of 27 ppm, and a copying apparatus of high copying speed of 45 to 70 ppm respectively. The inventor(s) have filed an application for patent for these sound quality evaluation expressions.

When the copying apparatus has the printing speed of 16 to 20 ppm, the discomfort is expressed using loudness (size of audible level) and tonality (relative distribution of pure tone component) according to subjective evaluation experiments and multiple regression analysis. Discomfort exponent S given by:

$$S = 0.3135 \times (\text{loudness}) + 3.4824 \times (\text{tonality}) - 3.146 \ (-1 \leq S \leq 1)$$

fulfills the inequality S<−0.6.

When the copying apparatus has the printing speed of 45 to 75 ppm, the discomfort exponent S is expressed using a squared loudness and sharpness (relative distribution of high-frequency component) according to subjective evaluation experiments and multiple regression analysis.

$$S = 0.01024269 \times (\text{loudness})^2 + 0.30996744 \times (\text{sharpness}) - 2.1386517.$$

When the copying apparatus has the printing speed of 27 ppm, the discomfort exponent S is expressed using a sound pressure level and sharpness (relative distribution of high-frequency component) according to subjective evaluation experiments and multiple regression analysis.

$$S = 0.0931 \times (\text{sound pressure}) + 0.5254 \times (\text{sharpness}) - 6.1935$$

However, as described above, there are the three kinds of sound quality evaluation expressions, as the portions that are felt unpleasant are different depending on the copying apparatus of the low copying speed (i.e., printing speed) of 16 to 20 ppm, the copying apparatus of the intermediate copying speed of 27 ppm, and the copying apparatus of the high copying speeds of 45 to 70 ppm respectively. Consequently, it is not possible to effectively evaluate the sound qualities of all of these apparatuses.

In other words, as the sound quality evaluation values calculated according to these sound quality evaluation expressions have no unit because of their predictive values for evaluating sound based on a subjective comparison of sound. The sound quality evaluation values work within a range of the subjective evaluation experiments. Therefore, as a matter of fact, discomfort levels are different even when the sound quality evaluation values are the same. For example, even when the value calculated according to the low-speed-layer sound quality evaluation expression and the values calculated according to the intermediate and high-speed-layer sound quality evaluation expressions are both "0", the discomfort levels are not the same.

Further, the inventor(s) of the present invention integrated the above three expressions corresponding to respective speeds into one sound quality evaluation expression in the early application. In other words, the inventor(s) obtained the following multiple regression equation having no constant term by using psycho-acoustics parameters as explanatory variable according to the Scheffe's method of a paired comparison method, in order to predict a difference (Ai−Aj) of an average discomfort effect of sample sounds Ai and Aj.

$$\begin{aligned} \alpha i - \alpha j = {} & 0.2307484\,(x \text{ loudness } i - x \text{ loudness } j) + \\ & 0.3720474\,(x \text{ sharpness } i - x \text{ sharpness } j) + \\ & 4.3095786\,(x \text{ tonality } i - x \text{ tonality } j) + \\ & 1.2007391\,(x \text{ impulsiveness } i - x \text{ impulsiveness } j) \end{aligned} \quad (1)$$

This multiple regression equation (1) is modified into an expression for obtaining a relative evaluation point of the sample sound Ai.

A person who is doing the evaluation (hereinafter, "evaluating person") gives −1 as an evaluation point when Ai is more unpleasant than Aj, and gives 1 as an evaluation point when Aj is more unpleasant than Ai. Therefore, only values from −1 to 1 can be taken as an average discomfort effect (i.e., measured value) according to the experiments. However, as the multiple regression equation (1) is a linear model, the prediction value of the discomfort effect by calculation is smaller than −1 or is larger than 1 depending on the input psycho-acoustics parameter value. Consequently, there remains irrationality that a range of actual measured values and a range of predicted values are different as indicated by ellipses in FIG. 5.

Further, the evaluation result according to the Scheffe's method of the paired comparison method is the obtaining of a subjective distance between discomforts of sample sound. The relative evaluation point expressed by the multiple regression equation (1) takes a range from −1 to 1. However, as the numerical values take no unit, an improvement of 0.2 from discomfort, for example, does not indicate a specific level of improvement.

SUMMARY OF THE INVENTION

It is an object of the present invention to solve at least the problems in the conventional technology.

An image formation apparatus according to one aspect of the present invention has an arrangement so that a discomfort probability P, calculated from an expression (a), fulfills a condition (b), wherein the discomfort probability P is calculated using a sound pressure level value, a loudness value of a psycho-acoustics parameter, a sharpness value, a tonality value, and an impulsiveness value obtained from operation noise at a position with a distance from an end surface of the image formation apparatus, $$\hat{P}_{im} = 1/\{1 + \exp[-z]\} \quad (a)$$

$$\hat{P}_{im} \leqq 0.2725 \cdot \ln(\text{ppm}) - 0.6331 \quad (b)$$

where $z = A \times \text{sound pressure level } i + B \times \text{loudness } i + C \times \text{sharpness } i + D \times \text{tonality } i + E \times \text{impulsiveness } i + F$ i=1, 2, 3, . . . , n A, B, C, D, and E are regression coefficients of parameters, and F is intercept, and A, B, C, D, E, and F satisfy the inequalities $0.142 \leqq A \leqq 0.183$ $0.300 \leqq B \leqq 0.389$ $1.097 \leqq C \leqq 1.265$ $9.818 \leqq D \leqq 11.516$ $2.588 \leqq E \leqq 3.240$ $-18.844 \leqq F \leqq -14.968$ ppm is a printing speed per minute for A4 horizontal size recording medium.

An image formation apparatus according to another aspect of the present invention has an arrangement so that a discomfort probability P, calculated from an expression (c), fulfills a condition (b), wherein the discomfort probability P is calculated using a sound pressure level value, a loudness value of a psycho-acoustics parameter, a sharpness value, a tonality value, and an impulsiveness value obtained from operation noise at a position with a distance from an end surface of the image formation apparatus, $$\hat{P}_{i\varpi} = 1 \Big/ \left\{ 1 + \exp\left[ \begin{array}{l} 16.90601 - 0.1625723\chi_{sound\ pressure\ level} - \\ 0.34475769\chi_{loudness\ i} - 1.18093783\chi_{sharpness\ i} - \\ 10.6669829\chi_{tonality\ i} - 2.91380546\varphi_{impulse\ i} \pm \\ 2\hat{\sigma} \end{array} \right] \right\} \quad \text{(c)}$$

$$\hat{P}_{im} \leqq 0.2725 \cdot \ln(\text{ppm}) - 0.6331 \quad \text{(b)}$$

where i=1, 2, 3, . . . , n

σ is standard error ppm is a printing speed per minute for A4 horizontal size recording medium.

An image formation apparatus according to still another aspect of the present invention has an arrangement so that a discomfort probability P, calculated from an expression (d), fulfills a condition (b), wherein the discomfort probability P is calculated using a sound pressure level value, a loudness value of a psycho-acoustics parameter, a sharpness value, a tonality value, and an impulsiveness value obtained from operation noise at a position with a predetermined distance from an end surface of the image formation apparatus, $$\hat{P}_{i\varpi} = 1 \Big/ \left\{ 1 + \exp\left[ \begin{array}{l} 16.90601 - 0.1625723\chi_{sound\ pressure\ level} - \\ 0.34475769\chi_{loudness\ i} - 1.18093783\chi_{sharpness\ i} - \\ 10.6669829\chi_{tonality\ i} - 2.91380546\chi_{impulse\ i} \end{array} \right] \right\} \quad \text{(d)}$$

$$\hat{P}_{im} \leqq 0.2725 \cdot \ln(\text{ppm}) - 0.6331 \quad \text{(b)}$$

where i=1, 2, 3, . . . , n ppm is a printing speed per minute for A4 horizontal size recording medium.

An image formation apparatus according to still another aspect of the present invention has an arrangement so that a discomfort probability P, calculated from an expression (e), fulfills a condition (f), wherein the discomfort probability P is calculated using a sound pressure level value (A) in decibels, a loudness value of a psycho-acoustics parameter, a sharpness value, a tonality value, an impulsiveness value, and a printing speed ppm, obtained from operation noise at a position with a distance from an end surface of the image formation apparatus, $$P = \frac{1}{1 + \exp(-z)} \quad \text{(e)}$$

$$P \leqq 0.1728e^{0.0065\ ppm} \quad \text{(f)}$$

where $z = A \times \text{sound pressure level } i + B \times \text{loudness } i + C \times \text{sharpness } i + D \times \text{tonality } i + E \times \text{impulsiveness } i + F \times \text{ppm } i + G$ i=1, 2, 3, . . . , n A, B, C, D, E, and F are regression coefficients of parameters, and G is intercept, and A, B, C, D, E, F, and G satisfy the inequalities $0.10547717 \leqq A \leqq 0.15069022$ $0.40687921 \leqq B \leqq 0.53399976$ $0.99138725 \leqq C \leqq 1.166331$ $8.38547981 \leqq D \leqq 10.1721249$ $2.57373312 \leqq E \leqq 3.21686388$ $-0.020344 \leqq F \leqq -0.0106576$ $-17.49359273 \leqq G \leqq -12.70308101$ ppm is a printing speed per minute for A4 horizontal size recording medium.

An image formation apparatus according to still another aspect of the present invention has an arrangement so that a discomfort probability P, calculated from an expression (g), fulfills a condition (f), wherein the discomfort probability P is calculated using a sound pressure level value (A) in decibels, a loudness value of a psycho-acoustics parameter, a sharpness value, a tonality value, an impulsiveness value, and a printing speed ppm, obtained from operation noise at a position with a predetermined distance from an end surface of the image formation apparatus, $$P = \frac{1}{1 + \exp(-z \pm 2\sigma)} \quad \text{(g)}$$

$$P \leqq 0.1728e^{0.0065\ ppm} \quad \text{(f)}$$

where $$z = 0.12808364 \times \text{sound pressure level } i + 0.47043907 \times \text{loudness } i + 1.07885872 \times \text{sharpness } i + 9.27879937 \times \text{tonality } i + 2.89529674 \times \text{impulsiveness } i - 0.0155008 \times ppm\ i - 15.09832827$$

i=1, 2, 3, . . . , n

σ is standard error=0.871894 ppm is a printing speed per minute for A4 horizontal size recording medium.

An image formation apparatus according to still another aspect of the present invention has an arrangement so that a discomfort probability P, calculated from an expression (h), fulfills a condition (f), wherein the discomfort probability P is calculated using a sound pressure level value (A) in decibels, a loudness value of a psycho-acoustics parameter, a sharpness value, a tonality value, an impulsiveness value, and a printing speed ppm, obtained from operation noise at a position with a predetermined distance from an end surface of the image formation apparatus, $$P = \frac{1}{1 + \exp(-z)} \quad \text{(h)}$$

$$P \leqq 0.1728e^{0.0065\ ppm} \quad \text{(f)}$$

where $$z = 0.12808364 \times \text{sound pressure level } i + 0.47043907 \times \text{loudness } i + 1.07885872 \times \text{sharpness } i + 9.27879937 \times \text{tonality } i + 2.89529674 \times \text{impulsiveness } i - 0.0155008 \times ppm\ i - 15.09832827$$

i=1, 2, 3, . . . , n ppm is a printing speed per minute for A4 horizontal size recording medium.

A method of evaluating a sound generated by an image formation apparatus when forming an image onto a recording medium according to still another aspect of the present invention includes recording an operation noise generated by each of a plurality of image formation apparatuses each having a different image formation speed; preparing a plurality of sample sounds from the operation noises; measuring a psycho-acoustics parameter for each of the sample sounds; evaluating the sample sounds using a paired comparison method; carrying out a logistic regression analysis by using a discomfort probability of two kinds of sound using the evaluation of the sample sounds as objective variables and a difference of psycho-acoustics parameters as explanatory variables; deriving a sound quality evaluation expression used to predict a probability of discomfort of sound based on a result of the logistic regression analysis; and evaluating sound quality by using the sound quality evaluation expression.

A method of manufacturing an image formation apparatus according to still another aspect of the present invention includes a design step of designing each section of the apparatus so that a discomfort probability (P) calculated according to the expression (k) fulfills the condition (l) by using a loudness value, a sharpness value, a tonality value, and an impulsiveness value of psycho-acoustics parameters obtained from sounds that the image formation apparatus emits at the time of forming an image onto a recording medium, the sounds being collected at a position with a distance from an end surface of the image formation apparatus, $$\hat{P}_{im} 1/\{1+\exp[-z]\} \quad (k)$$

$$\hat{P}_{im} \leqq 0.2725 \cdot \ln(\text{ppm}) - 0.6331 \quad (l)$$

where $$z = A \times \text{sound pressure level } i + B \times \text{loudness } i + C \times \text{sharpness } i + D \times \text{tonality } i + \text{impulsiveness } i + F$$

i=1, 2, 3, . . . , n

A, B, C, D, and E are regression coefficients of parameters, and F is intercept, and A, B, C, D, E, and F satisfy the inequalities $0.142 \leqq A \leqq 0.183$ $0.300 \leqq B \leqq 0.389$ $1.097 \leqq C \leqq 1.265$ $9.818 \leqq D \leqq 11.516$ $2.588 \leqq E \leqq 3.240$ $-18.844 \leqq F \leqq -14.968$; and a manufacturing step of manufacturing the image formation apparatus according to contents designed at the design step.

A method of manufacturing an image formation apparatus according to still another aspect of the present invention includes a design step of designing each section of the apparatus so that a discomfort probability (P) calculated according to the expression (m) fulfills the condition (l) by using a loudness value, a sharpness value, a tonality value, and an impulsiveness value of psycho-acoustics parameters obtained from sounds that the image formation apparatus emits at the time of forming an image onto a recording medium, the sounds being collected at apposition with a distance from an end surface of the image formation apparatus, $$\hat{P}_{i\varpi} = 1 \Big/ \left\{ 1 + \exp \begin{bmatrix} 16.90601 - 0.1625723\chi_{sound\ pressure\ level} - \\ 0.34475769\chi_{loudness\ i} - 1.18093783\chi_{sharpness\ i} - \\ 10.6669829\chi_{tonality\ i} - 2.91380546\chi_{impulse\ i} \pm \\ 2\hat{\sigma} \end{bmatrix} \right\} \quad (m)$$

$$\hat{P}_{im} < 0.2725 \cdot \ln(\text{ppm}) - 0.6331 \quad (l)$$

where i=1, 2, 3, . . . , n; and a manufacturing step of manufacturing the image formation apparatus according to contents designed at the design step.

A method of manufacturing an image formation apparatus according to still another aspect of the present invention includes a design step of designing each section of the apparatus so that a discomfort probability (P) calculated according to the expression (n) fulfills the condition (l) by using a loudness value, a sharpness value, a tonality value, and an impulsiveness value of psycho-acoustics parameters obtained from sounds that the image formation apparatus emits at the time of forming an image onto a recording medium, the sounds being collected at a position with a distance from an end surface of the image formation apparatus;

$$\hat{P}_{i\varpi} = 1 \Big/ \left\{ 1 + \exp \begin{bmatrix} 16.90601 - 0.1625723\chi_{sound\ pressure\ level} - \\ 0.34475769\chi_{loudness\ i} - 1.18093783\chi_{sharpness\ i} - \\ 10.6669829\chi_{tonality\ i} - 2.91380546\chi_{impulse\ i} \end{bmatrix} \right\} \quad (n)$$

$$\hat{P}_{im} \leqq 0.2725 \ln(\text{ppm}) - 0.6331 \quad (l)$$

where i=1, 2, 3, . . . , n; and a manufacturing step of manufacturing the image formation apparatus according to contents designed at the design step.

A method of manufacturing an image formation apparatus according to still another aspect of the present invention includes a design step of designing each section of the apparatus so that a discomfort probability (P) calculated according to the expression (o) fulfills the condition (p) by using a loudness value, a sharpness value, a tonality value, an impulsiveness value, and a printing speed ppm for A4 horizontal size medium per minute, of psycho-acoustics parameters obtained from sounds that the image formation apparatus emits at the time of forming an image onto a recording medium, the sounds being collected at a position with a distance from an end surface of the image formation apparatus, $$P = \frac{1}{1 + \exp(-z)} \quad (o)$$

$$P \leqq 0.1728e^{0.0065\,ppm} \quad (p)$$

where $z = A \times \text{sound pressure level } i + B \times \text{loudness } i + C \times \text{sharpness } i + D \times \text{tonality } i + E \times \text{impulsiveness } i + F \times \text{ppm } i + G$ i=1, 2, 3, . . . , n A, B, C, D, E, and F are regression coefficients of parameters, and G is intercept, and A, B, C, D, E, F, and G satisfy the inequalities $0.10547717 \leqq A \leqq 0.15069022$
$0.40687921 \leqq B \leqq 0.53399976$
$0.99138725 \leqq C \leqq 1.166331$
$8.38547981 \leqq D \leqq 10.1721249$
$2.57373312 \leqq E \leqq 3.21686388$
$-0.020344 \leqq F \leqq -0.0106576$
$-17.49359273 \leqq G \leqq -12.70308101$; and a manufacturing step of manufacturing the image formation apparatus according to contents designed at the design step.

A method of manufacturing an image formation apparatus according to still another aspect of the present invention includes a design step of designing each section of the apparatus so that a discomfort probability (P) calculated according to the expression (q) fulfills the condition (p) by using a loudness value, a sharpness value, a tonality value, an impulsiveness value, and a printing speed ppm for A4 horizontal size medium per minute, of psycho-acoustics parameters obtained from sounds that the image formation apparatus emits at the time of forming an image onto a recording medium, the sounds being collected at a position with a distance from an end surface of the image formation apparatus, $$P = \frac{1}{1 + \exp(-z \pm 2\sigma)} \quad (q)$$

$$P \leqq 0.1728e^{0.0065\,ppm} \quad (p)$$

where $z = 0.12808364 \times \text{sound pressure level } i + 0.47043907 \times \text{loudness } i + 1.07885782 \times \text{sharpness } i + 9.27879937 \times \text{tonality } i + 2.89529674 \times \text{impulsiveness } i - 0.01558008 \times ppm\ i - 15.09832827$ i=1, 2, 3, . . . , n σ is standard error=0.871894; and a manufacturing step of manufacturing the image formation apparatus according to contents designed at the design step.

A method of manufacturing an image formation apparatus according to still another aspect of the present invention includes a design step of designing each section of the apparatus so that a discomfort probability (P) calculated according to the expression (r) fulfills the condition (p) by using a loudness value, a sharpness value, a tonality value, an impulsiveness value, and a printing speed ppm for A4 horizontal size medium per minute, of psycho-acoustics parameters obtained from sounds that the image formation apparatus emits at the time of forming an image onto a recording medium, the sounds being collected at a position with a distance from an end surface of the image formation apparatus, $$P = \frac{1}{1 + \exp(-z)} \quad (r)$$

$$P \leqq 0.1728e^{0.0065\,ppm} \quad (p)$$

where $z = 0.12808364 \times \text{sound pressure level } i + 0.47043907 \times \text{loudness } i + 1.07885872 \times \text{sharpness } i + 9.27879937 \times \text{tonality } i + 2.89529674 \times \text{impulsiveness } i - 0.0155008 \times ppm\ i - 15.09832827$;

and a manufacturing step of manufacturing the image formation apparatus according to contents designed at the design step.

A method of remodeling an image formation apparatus according to still another aspect of the present invention includes a sound collecting step of collecting sounds that the image formation apparatus emits at the time of forming an image onto a recording medium, at a sound collection position with a distance from an end surface of the image formation apparatus to be remodeled; and a remodeling step of remodeling a configuration of the apparatus so that a probability (P) calculated according to the expression (s) fulfills the condition (t) by using a loudness value, a sharpness value, a tonality value, and an impulsiveness value of psycho-acoustics parameters obtained from a result of the sound collected at the sound collecting step, where $$\hat{P}_{im} = 1/\{1 + \exp[-z]\} \quad (s)$$

$$\hat{P}_{im} \leqq 0.2725 \ln(\text{ppm}) - 0.6331 \quad (t)$$

where $z = A \times \text{sound pressure level } i + B \times \text{loudness } i + C \text{ sharpness } i + D \times \text{tonality } i + E \times \text{impulsiveness } i + F$ i=1, 2, 3, . . . , n A, B, C, D, and E are regression coefficients of parameters, and F is intercept, and A, B, C, D, E, and F satisfy the inequalities $0.142 \leqq A \leqq 0.183$
$0.300 \leqq B \leqq 0.389$
$1.097 \leqq C \leqq 1.265$
$9.818 \leqq D \leqq 11.516$
$2.588 \leqq E \leqq 3.240$
$-18.844 \leqq F \leqq -14.968$.

A method of remodeling an image formation apparatus according to still another aspect of the present invention includes a sound collecting step of collecting sounds that the image formation apparatus emits at the time of forming an image onto a recording medium, at a sound collection position with a distance from an end surface of the image formation apparatus to be remodeled; and a remodeling step of remodeling a configuration of the apparatus so that a probability (P) calculated according to the expression (u) fulfills the condition (t) by using a loudness value, a sharpness value, a tonality value, and an impulsiveness value of psycho-acoustics parameters obtained from a result of the sound collected at the sound collecting step, where $$\hat{P}_{i\varpi} = 1 \Big/ \left\{ 1 + \exp\left[ \begin{array}{l} 16.90601 - 0.1625723\chi_{sound\ pressure\ level} - \\ 0.34475769\chi_{loudness\ i} - 1.18093783\chi_{sharpness\ i} - \\ 10.6669829\chi_{tonality\ i} - 2.91380546\chi_{impulse\ i} \pm \\ 2\hat{\sigma} \end{array} \right] \right\} \quad \text{(u)}$$

$$\hat{P}_{im} \leqq 0.2725 \ln(\text{ppm}) - 0.6331 \quad \text{(t)}$$

where i=1, 2, 3, . . . , n

σ is standard error.

A method of remodeling an image formation apparatus according to still another aspect of the present invention includes a sound collecting step of collecting sounds that the image formation apparatus emits at the time of forming an image onto a recording medium, at a sound collection position with a distance from an end surface of the image formation apparatus to be remodeled; and a remodeling step of remodeling a configuration of the apparatus so that a probability (P) calculated according to the expression (v) fulfills the condition (t) by using a loudness value, a sharpness value, a tonality value, and an impulsiveness value of psycho-acoustics parameters obtained from a result of the sound collected at the sound collecting step.

$$\hat{P}_{i\varpi} = 1 \Big/ \left\{ 1 + \exp\left[ \begin{array}{l} 16.90601 - 0.1625723\chi_{sound\ pressure\ level} - \\ 0.34475769\chi_{loudness\ i} - 1.18093783\chi_{sharpness\ i} - \\ 10.6669829\chi_{tonality\ i} - 2.91380546\chi_{impulse\ i} \end{array} \right] \right\} \quad \text{(v)}$$

$$\hat{P}_{im} \leqq 0.2725 \ln(\text{ppm}) - 0.6331 \quad \text{(t)}$$

where i=1, 2, 3, . . . , n.

A method of remodeling an image formation apparatus according to still another aspect of the present invention includes a sound collecting step of collecting sounds that the image formation apparatus emits at the time of forming an image onto a recording medium, at a sound collection position with a distance from an end surface of the image formation apparatus to be remodeled; and a remodeling step of remodeling a configuration of the apparatus so that a probability (P) calculated according to the expression (w) fulfills the condition (x) by using a loudness value, a sharpness value, a tonality value, an impulsiveness value, and a printing speed ppm for A4 horizontal size medium per minute, of psycho-acoustics parameters obtained from a result of the sound collected at the sound collecting step, $$P = \frac{1}{1 + \exp(-z)} \quad \text{(w)}$$

$$P \leqq 0.1728e^{0.0065\ ppm} \quad \text{(x)}$$

where $z = A \times \text{sound pressure level } i + B \times \text{loudness } i + C \text{ sharpness } i + D \times \text{tonality } i + E \times \text{impulsiveness } i + F \times \text{ppm } i + G$ i=1, 2, 3, . . . , n A, B, C, D, E, and F are regression coefficients of parameters, and G is intercept, and A, B, C, D, E, F, and G satisfy the inequalities $0.10547717 \leqq A \leqq 0.15069022$ $0.40687921 \leqq B \leqq 0.53399976$ $0.99138725 \leqq C \leqq 1.166331$ $8.38547981 \leqq D \leqq 10.1721249$ $2.57373312 \leqq E \leqq 3.21686388$ $-0.020344 \leqq F \leqq -0.0106576$ $-17.49359273 \leqq G \leqq -12.70308101$ ppm is a printing speed per minute for A4 horizontal size recording medium.

A method of remodeling an image formation apparatus according to still another aspect of the present invention includes a sound collecting step of collecting sounds that the image formation apparatus emits at the time of forming an image onto a recording medium, at a sound collection position with a distance from an end surface of the image formation apparatus to be remodeled; and a remodeling step of remodeling a configuration of the apparatus so that a probability (P) calculated according to the expression (y) fulfills the condition (x) by using a loudness value, a sharpness value, a tonality value, an impulsiveness value, and a printing speed ppm for A4 horizontal size medium per minute, of psycho-acoustics parameters obtained from a result of the sound collected at the sound collecting step, $$P = \frac{1}{1 + \exp(-z \pm 2\sigma)} \quad \text{(y)}$$

$$P \leqq 0.1728e^{0.0065\ ppm} \quad \text{(x)}$$

where $$z = 0.12808364 \times \text{sound pressure level } i + 0.47043907 \times \text{loudness } i + 1.07885872 \times \text{sharpness } i + 9.27879937 \times \text{tonality } i + 2.89529674 \times \text{impulsiveness } i - 0.0155008 \times ppm\ i - 15.09832827$$

i=1, 2, 3, . . . , n

σ is standard error=0.871894 ppm is a printing speed per minute for A4 horizontal size recording medium.

A method of remodeling an image formation apparatus according to still another aspect of the present invention includes a sound collecting step of collecting sounds that the image formation apparatus emits at the time of forming an image onto a recording medium, at a sound collection position with a distance from an end surface of the image formation apparatus to be remodeled; and a remodeling step of remodeling a configuration of the apparatus so that a probability (P) calculated according to the expression (z) fulfills the condition (x) by using a loudness value, a sharpness value, a tonality value, an impulsiveness value, and a printing speed ppm for A4 horizontal size medium per minute, of psycho-acoustics parameters obtained from a result of the sound collected at the sound collecting step, where $$P = \frac{1}{1 + \exp(-z)} \quad (Z)$$

$$P \leqq 0.1728e^{0.0065\ ppm} \quad (x)$$

where $$z = 0.12808364 \times \text{sound pressure level } i + 0.47043907 \times \text{loudness } i + 1.07885872 \times \text{sharpness } i + 9.27879937 \times \text{tonality } i + 2.89529674 \times \text{impulsiveness } i - 0.0155008 \times ppm\ i - 15.09832827$$

i=1, 2, 3, . . . , n.

The other objects, features and advantages of the present invention are specifically set forth in or will become apparent from the following detailed descriptions of the invention when read in conjunction with the accompanying drawings.

DETAILED DESCRIPTION

Exemplary embodiments according to the present invention will be explained below with reference to the accompanying drawings. It should be noted that the present invention is not limited to the image formation apparatus, the sound quality evaluation method, the method of manufacturing an image formation apparatus, and the method of remodeling an image formation apparatus explained below.

In the image formation apparatus, the sound quality evaluation method, the method of manufacturing an image formation apparatus, and the method of remodeling an image formation apparatus according to the first embodiment, "configuration of image formation apparatus", "derivation of expression for evaluating sound quality of image formation apparatus", and "measure for reducing unpleasant noise of image formation apparatus" will be explained in detail in this order.

Figure 1:
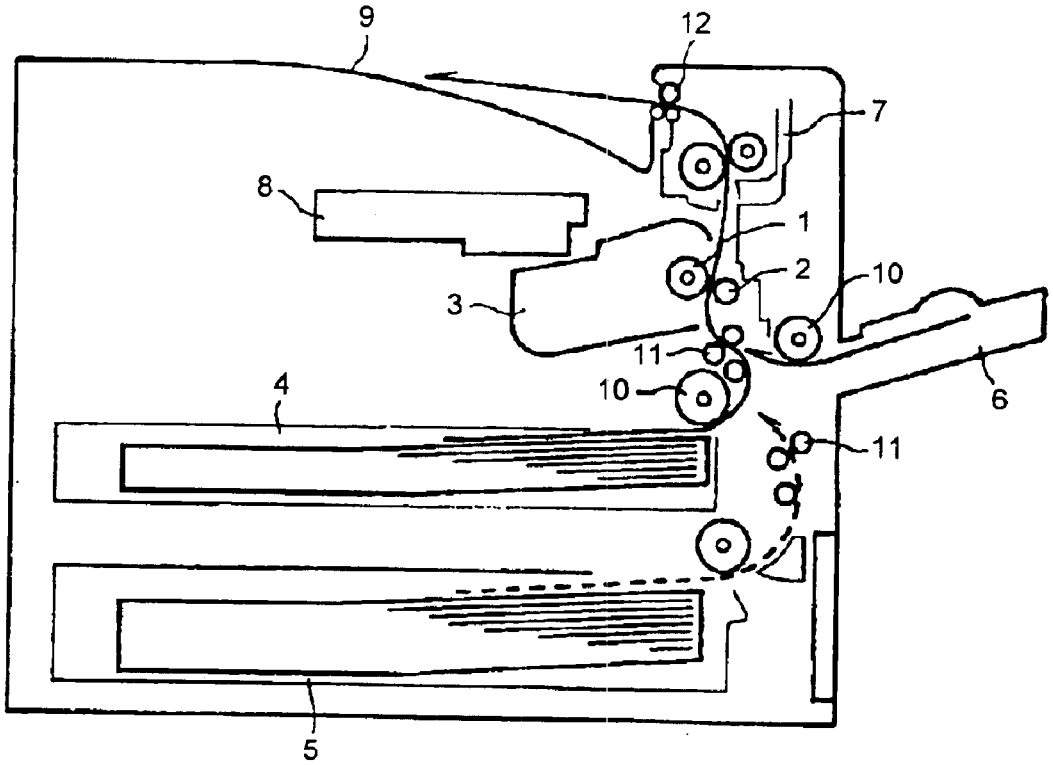
FIG. 1 illustrates an internal structure of a desktop-type image formation apparatus according to a first embodiment of the present invention.

FIG. 1 illustrates an internal structure of a desktop-type image formation apparatus according to a first embodiment of the present invention. In FIG. 1, a reference numeral 1 denotes a photosensitive drum as an image holder, and a reference numeral 2 denotes a transfer roller that transfers a toner image formed on the photosensitive drum 1 onto a sheet of recording paper. A reference numeral 3 denotes a process cartridge that forms a toner image on the photosensitive drum 1, a reference numeral 4 denotes a main body paper feed tray, a reference numeral 5 denotes a bank paper tray, and a reference numeral 6 denotes a manual feed tray. A reference numeral 7 denotes a fixing unit, a reference numeral 8 denotes a writing unit to write an image onto the photosensitive drum 1, and a reference numeral 9 denotes a paper discharging tray. A reference numeral 10 denotes a paper feed roller; a reference numeral 11 denotes a resist roller, and a reference numeral 12 denotes a paper discharging roller.

The image formation apparatus is provided with a paper conveying system including the main body paper feed tray 4, the bank paper tray 5, the manual feed tray 6, the paper feed roller 10, and the resist roller 11. The recording paper passes through an image formation side of the process cartridge 3 from the paper conveying system, and is transferred with an image. The recording paper passes through the fixing unit 7, and the paper discharging roller 12, and is then discharged onto the paper discharging tray 9.

The writing unit 8 consisting of an LD unit, a polygon mirror, and an fθ lens (not shown), is disposed at an upper portion of the process cartridge 3. Although not shown, a drive transmission system including a driving motor that rotates the photosensitive drum 1 and each roller, a solenoid, and clutches (a mechanical clutch, and an electromagnetic clutch) is also provided. When the image formation apparatus having the above configuration forms an image, the driving motor and the drive transmission system emit driving noise, the solenoid and the clutch emit operation noise, and the recording paper emits paper feeding noise and charging noise.

Figure 2:
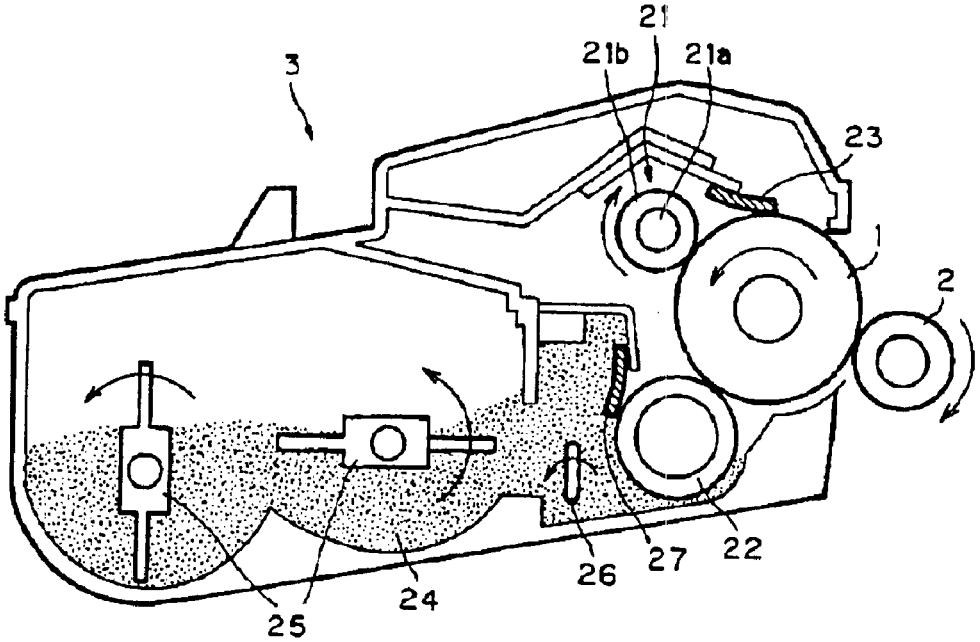
FIG. 2 illustrates a structure of a process cartridge.

FIG. 2 illustrates a structure of the process cartridge 3. The process cartridge 3 includes a charging roller 21 as a charging unit, a developing roller 22 as a developing unit, a cleaning blade 23 as a cleaning unit, an agitator 25 that agitates a toner 24 and supplies the agitated toner to the developing roller 22, a stirring shaft 26, and a developing blade 27. The charging roller 21 includes a core metal 21*a*, and a charger 21*b*.

The charging roller 21, the developing roller 22, and the cleaning blade 23 are disposed in a predetermined condition, around the photosensitive drum 1 as the image holder. The agitator 25 and the stirring shaft 26 agitate the toner 24 within the process cartridge 3, and convey the agitated toner 24 to the developing roller 22. The toner 24 adheres to the roller surface due to the magnetic force within the developing roller 22. When this toner 24 passes through the developing blade 27, the toner 24 is charged in minus due to frictional charging. The toner charged in minus moves to the photosensitive drum 1 due to a bias voltage, and adheres to an electrostatic latent image.

When the recording paper fed from the resist roller 11 passes through between the photosensitive drum 1, and the transfer roller 2, the toner is transferred from the photosensitive drum 1 onto the recording paper due to plus charge from the transfer roller 2. The cleaning blade 23 scratches the toner that remains on the photosensitive drum 1, and recovers the scratched toner as waste toner into a tank above the cleaning blade 23. The portions other than the transfer roller 2 are integrated as the process cartridge 3, which a user can replace.

Figure 3:
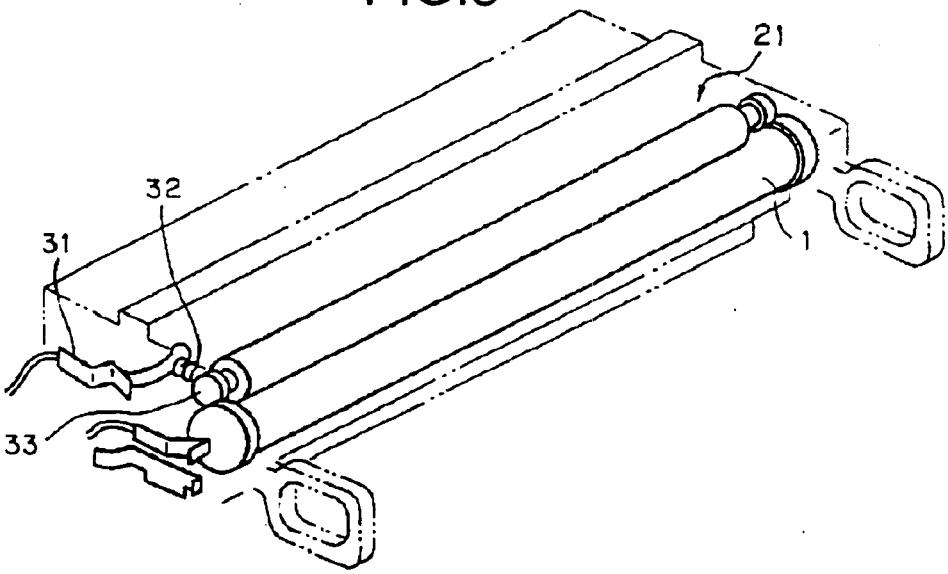
FIG. 3 illustrates a structure of a charging roller.

FIG. 3 illustrates a structure of the charging roller 21. The charging roller 21 uniformly charges (primary charging) the surface of the photosensitive drum 1 by being driven with frictional force while always in contact with the photosensitive drum 1. As shown in FIG. 2, the charging roller 21 rotates around the core metal 21*a* as the rotation shaft. The charger 21*b* is concentrically formed around the core metal 21*a*.

When charging the charging roller 21, the core metal 21*a* is applied with a bias voltage having an AC voltage superimposed on a direct current (hereinafter, "DC") voltage. Precisely, a voltage generated by a high-voltage power source is passed to the core metal 21*a* via an electrode terminal 31, a charging roller pressing spring 32, and a conductive bearing 33. The charging roller 21 uniformly charges the photosensitive drum 1 with the same voltage as the bias voltage of the DC component. The AC component of the bias voltage on the charging roller 21 functions to uniformly charge the photosensitive drum 1.

An explanation about what is the optimum value of the frequency of the AC component will now be given. In general, when the printing speed (ppm) is high, the frequency of the AC component needs to be increased. Specifically, when the printing speed is equal to or higher that 16 ppm, the proper value of the frequency of the AC component is preferably 1000 hertz or above. However, when the printer prints less than 16 ppm, the frequency need not be set to such a high level.

When the charging roller 21 charges the photosensitive drum 1 in contact, the attracting force and the repulsive force alternately work between the surface of the charging roller 21 and the surface of the photosensitive drum 1 due to the AC component of the bias voltage. This may cause the charging roller 21 to generate oscillation. The oscillation of the charging roller 21 causes the charging roller 21 itself to generate abrasive oscillation noise (i.e., charging noise) of high frequency. This oscillation noise is transmitted to the photosensitive drum 1, which makes the photosensitive drum 1 oscillate and generate noise.

In general, charging noise includes a frequency of the AC component and a higher harmonic of an integer times this frequency. When the basic frequency of the AC component is 1000 hertz, charging noise of a secondary higher harmonic 2000 hertz, charging noise of a tertiary higher harmonic 3000 hertz, and so on are generated in many cases. When the order becomes higher, the sound pressure level is lowered in many cases. When the image formation apparatus generates oscillation, frequencies not higher than 200 hertz appear as banding in the image, and frequencies of 200 hertz or above appear as audible sound. Acoustically, sound of a frequency lower than 200 hertz is not audible, which causes little problem. In other words, this sound has small loudness. Therefore, charging noise of the AC component of 200 hertz or above needs to be considered.

Figure 4:
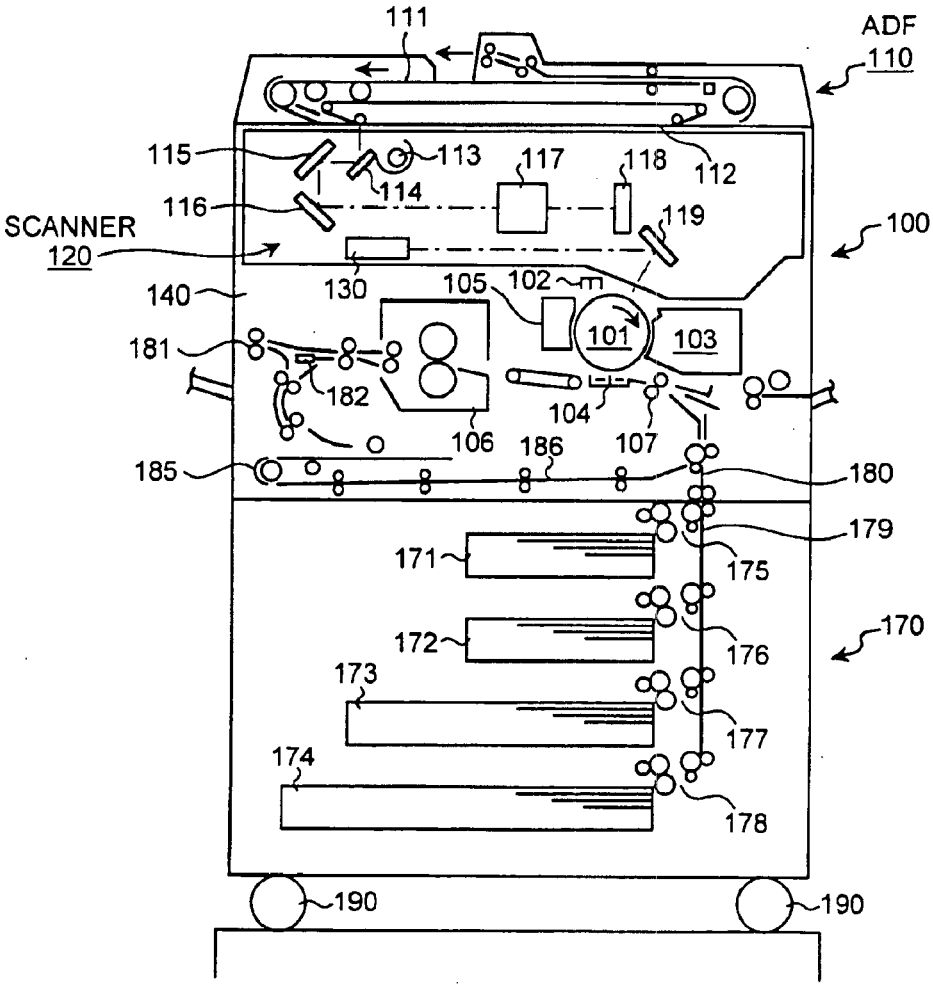
FIG. 4 illustrates a structure of a console-type image formation apparatus according to the first embodiment of the present invention.

FIG. 4 illustrates a structure of a console-type image formation apparatus according to the first embodiment of the present invention. This image formation apparatus is, for example, a digital copying machine, and has a considerable height so that it can be appropriately operated when it is placed on the floor. This machine has an upper part 100 and a lower part. The upper part 100 includes an automatic document feeder 110, a scanner 120, a writing unit 130, and an image formation engine 140. The lower part includes a bank paper feed unit 170. This type of copying machine is in general a high-speed machine. The process from the image writing to the image formation is basically the same as that of the desktop machine shown in FIG. 1.

The upper portion 100 has an optical unit that accommodates optical elements of the scanner 120 and the writing unit 130 within a casing, an image formation engine 140 positioned below the optical unit, and the automatic document feeder 110 disposed on top of the casing.

A reference numeral 101 denotes a photosensitive drum as an image holder onto which an electrostatic latent image is formed, a reference numeral 102 denotes a charger, and a reference numeral 103 denotes a developing unit. A reference numeral 104 denotes a transfer and separation charger, a reference numeral 105 denotes a cleaning unit, and a reference numeral 106 denotes a fixing unit. A reference numeral 107 denotes a resist roller, a reference numeral 111 denotes a document table, a reference numeral 112 denotes a contact glass, and a reference numeral 113 denotes an exposure lamp. A reference numeral 114 denotes a first mirror, a reference numeral 115 denotes a second mirror, and a reference numeral 116 denotes a third mirror. A reference numeral 117 denotes an image focusing lens, a reference numeral 118 denotes a charge-coupled device (hereinafter, "CCD"), a reference numeral 119 denotes a mirror, and a reference numeral 190 denotes a lock-functional caster.

In other words, the scanner 120 includes the contact glass 112 on which the document is mounted, and a scanning optical system. The scanning optical system includes a first carriage mounted with the exposure lamp 113 and the first mirror 114, a second carriage that holds the second mirror 115 and the third mirror 116, the image focusing lens 117, and the CCD 118. During a document reading period, a stepping motor drives the first carriage to move at a constant speed, and drives the second carriage to move at a half speed of that of the first carriage.

The first carriage and the second carriage optically scan the document not shown on the contact glass 112. A beam reflected from the document reaches the CCD 119 via the exposure lamp 113, the first mirror 114, the second mirror 115, the third mirror 116, and the image focusing lens 117 respectively. The CCD 119 forms an image a photoelectrically converts the image.

The wiring unit 130 has a laser output unit, an fθ lens, and a mirror not shown. A laser diode as a laser beam source and a polygon mirror are provided inside the laser output unit.

The writing unit 130 converts an image signal output from the image processing section into a laser beam having intensity corresponding to the image signal. A collimator lens, an aperture, and a cylinder lens shape the laser beam into an optical flux of a certain shape, irradiate the beam to a polygon mirror, which outputs the laser beam. The laser beam that is output from the writing unit 130 is irradiated onto the photosensitive drum 101 via the mirror 119. The laser beam that passes through the fθ lens is irradiated onto a beam sensor not shown that generates a main scanning synchronization detection signal disposed at the outside of the image region.

The automatic document feeder 110 conveys each sheet of the document set on the document table 111 onto the contact glass 112, reads each sheet, and discharges the sheet. In other words, the document is set on the document table 111, and has its width direction aligned by a side guide. The paper feed roller feeds each sheet of paper from the bottom of the document that is positioned on the document table 111. A conveyer belt 153 conveys the document onto the contact glass 101. After the document on the contact glass is read, the conveyer belt and the paper discharging roller discharge the document into the paper discharging tray.

A first paper feeder 175, a second paper feeder 176, a third paper feeder 177, and a fourth paper feeder 178 feed recording sheets onto a first tray 171, a second tray 172, a third tray 173, and a fourth tray 174 of the bank paper feed unit 170 respectively. A bank longitudinal conveyer unit 179 and a main body longitudinal conveying unit 180 convey the recording paper respectively. When a resist sensor not shown detects a front end of the recording paper, the recording paper temporarily stops at a nip portion of the resist roller 107 after the paper is conveyed during a constant period of time.

The waiting recording paper is sent out to the photosensitive drum 101 to match a front end of an image effective signal. The transfer and separation charger 104 transfers the image onto the recording paper, and separates the recording paper from the photosensitive drum 101. The conveyer unit conveys the recording paper formed with the toner image. The fixing unit 106 consisting of a fixing roller and a pressing roller fixes the image, and a paper discharging roller 181 discharges the paper.

A laser beam is irradiated onto the charge applied on the photosensitive drum 101 by the charger 102, thereby to form an electrostatic latent image. The developing unit 103 forms the image on the photosensitive drum 101.

In order to print onto both sides of the paper with a two-sided unit 185, a switching claw 128 guides the recording paper after the fixing onto a convey route 186 for two-sided printing. These sheets of paper are accumulated onto a tray for two-sided printing through a feeding roller 132 and a separation roller 133. The recording paper accumulated on the tray is brought into contact with the feeding roller when the tray is lifted up. The feeding roller rotates to feed the paper to the main body longitudinal conveying unit 180. After the paper is fed to the resist roller 107 again, the paper is reversed, and the reverse side of the paper is printed.

To reverse the paper, a switching claw 167 guides the recording paper to a reversing tray 164 direction. When the tail end of the recording paper passes through a reversal detection sensor 168, the rotation of a conveyer roller 169 is reversed to guide the paper to a paper discharging tray direction, and discharges the paper into a tray set in advance.

The inventor of the present inventors obtains by calculation, discomfort probabilities that are expressed by combining psycho-acoustics parameters having a large improvement effect against unpleasant noise emitted from the three types of image formation apparatuses of low speed, intermediate speed, and high speed. The inventor is successful is deriving sound quality evaluation expressions for estimating a subjective evaluation value of sound quality, that is, objective sound quality evaluation expressions. The inventor of the present invention also proposes approximation expressions for obtaining a relationship between a speed of the image formation apparatus and a permissible value of discomfort. Further, the inventor is also successful in proposing conditions for not sensing discomfort in the derived sound quality evaluation expression. The derivation of the sound quality evaluation expressions for calculating discomfort probabilities of noise emitted from the low-speed to high-speed image formation apparatuses, and conditions for not sensing discomfort will be explained in detail below.

Figure 5:
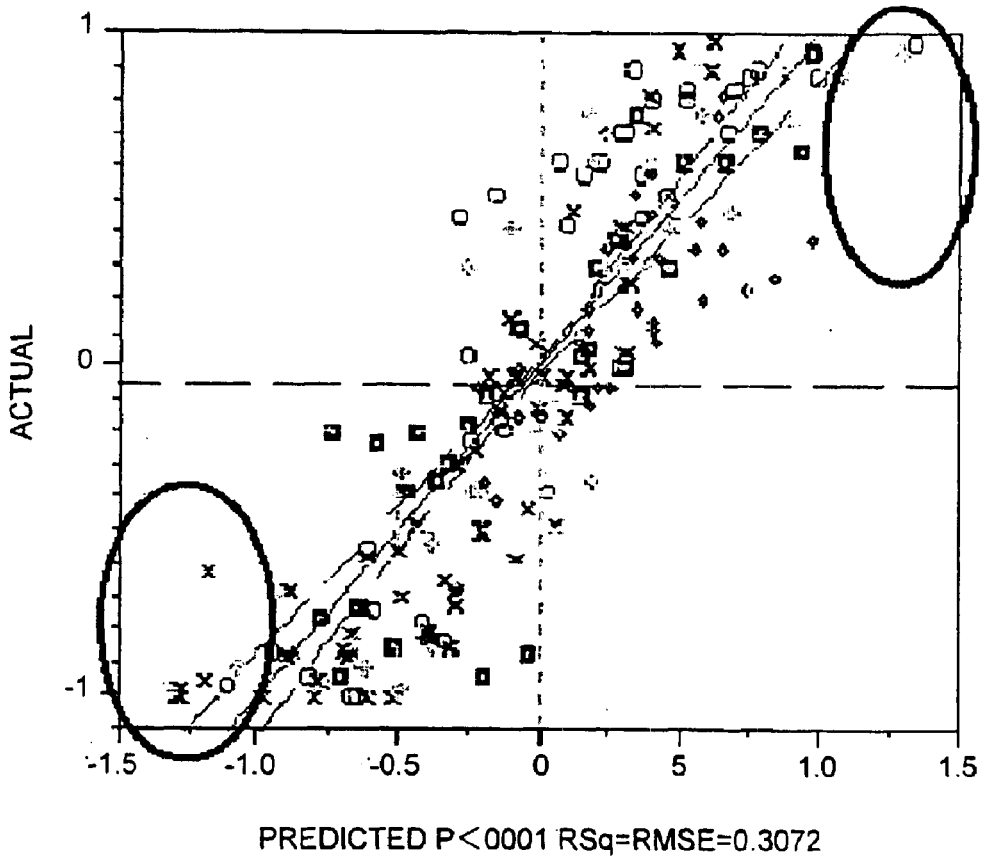
FIG. 5 is a scatter diagram of actual against predicted values of evaluation points in a model according to the first embodiment.

As the Scheffe's method is a model that establishes addition in an evaluation point, a method of deriving sound quality evaluation expressions so far filed for application are employed. However, the predicted values, as indicated by ellipses in FIG. 5, are out of the range of 1 and −1. In other words, these expressions yield wrong values and make the result irrational.

To overcome this problem, in the present invention, a multiple logistic regression model as illustrated by following expression (2) is applied to the sound quality prediction model:

$$\hat{P}_{ij} = 1 \Big/ \left\{1 + \exp\left[-\left(\sum_{l=1}^{L} b_l(x_{li} - x_{lj})\right)\right]\right\} \quad (2)$$

The multiple logistic regression model based on the expression (2) is an improvement of the explained multiple regressive equation (1). While the expression (1) gives an average difference of comparative dominance between the sample sounds Aj and Ai, the expression (2) gives predicted probabilities of the dominance between Aj and Ai as given by the following expression:

$$\hat{P}_{ij} = \frac{\pi_i}{\pi_i + \pi_j},\ 1 - P_{ij} = \frac{\pi_i}{\pi_i + \pi_j}.$$

In the expression (2), the difference of the effect as a result of the paired comparison is set as a variable. Therefore, an incomplete paired comparison may be experimented, that is, an experiment of a part of combination not the whole combinations, instead of a comparative experiment of the whole combinations used to derive the expressions. As the incomplete paired comparison is carried out, a number of persons who compare the sounds may be different depending on the combination of sounds. In the logit regression analysis and the logit transformation to be described later, the effect of the paired comparison, that is, dominance probabilities of the discomfort as a result of comparison between two sounds, can be estimated using a difference between the psycho-acoustics parameters. This will be explained in detail later. When psycho-acoustics parameters of sound to be evaluated are input instead of comparison between two sounds, by transforming the expression (2), it is possible to derive an expression for obtaining discomfort probabilities of a single sound as compared with an average sound from a population.

Pij represents a probability that Ai is sensed as unpleasant in comparison with a sample pair (Ai, Aj). On the other hand, (1−Pij) represents a probability that Aj is sensed as unpleasant. These probabilities can be easily calculated when $\pi i$ represents a frequency that the sample Ai is sensed as unpleasant, and $\pi j$ represents a frequency that the sample Aj is sensed as unpleasant. Therefore, there is a merit that the data used to derive the expression (1) can be used as they are. A statistic relationship that the probability Pij follows a binomial distribution is known. When an assumption that the expected value affects a psycho-acoustics parameter is fulfilled, the use of the multiple model according to the expression (2) becomes rational.

As the multiple logistic regression model predicts the probability Pij, the predicted discomfort probability (expressed in the following expression 7) takes a value between 0 and 1. Therefore, a rational exponent can be obtained.

The logit transformation and the logistic regression analysis will be briefly explained below.

In general, when an occurrence probability Pr (E) of an event E changes based on p explanation variable vectors x ($x_1$, $x_2$, . . . , and $x_p$), a ratio between the probability Pr (E) and a probability 1−Pr (E) that E does not occur is called odds or a perspective, which is defined by the following expression.

$$\text{odds}=Pr(E)/[1-Pr(E)]$$

When a conditional probability of the event E when an n-th dimensional observation value vector x is observed is expressed as Pr (E|x), the odds is expressed as follows.

$$\text{odds}=Pr(E|x)/[1-Pr(E|x)]$$

A logarithm of the odds is called log odds. As the probability Pr (E|x) takes a value between 0 and 1, the above expression takes a positive value. When a logarithm is taken, all values can be real values. Therefore, this facilitates modeling. Assume that the log adds is expressed by the following linear expression of x.

$$1n\{Pr(E|x)/[1-Pr(E|x)]\}=\beta_1x_1+\beta_2x_2+\ldots\beta_px_p$$

A model according to this expression is called the multiple logistic model, which is used to analyze a level of contribution of various factors to a specific event. $\beta_1$, $\beta_2$, . . . $\beta_p$ are coefficients of the model.

The above expression of log odds can be expressed as follows.

$$1n\{Pr(E|x)/[1-Pr(E|x)]\}=x'\beta$$

where $x=(x_1, x_2, \ldots, x_n)'$, and $\beta=(\beta_1, \beta_2, \ldots \beta_p)'$.

In this expression, when values of other variables are constant, and when the coefficient $\beta_1$ of the explanation variable Xi is positive, an increase in an explanation variable Xi contributes to an increase in the occurrence probability of the event E. When the coefficient $\beta_1$ is negative, an increase in an explanation variable Xj contributes to a decrease in the occurrence probability of the event E. When the expression of log odds is solved for Pr(E|x), the multiple logistic function given in the following expression is derived.

$$Pr(E|x)=1/\{1+\exp(-x'\beta)=\exp(x'\beta)/(1+\exp(x'\beta).$$

The application of the multiple logistic function to the evaluation of sound quality of the image formation apparatus according to the present embodiment of the present invention will be considered. Loudness is one of factors of unpleasant noise generated from the image formation apparatus.

Assume "n" (number of) persons compare two sample sounds (A1 and A2) to find which one of the sounds is unpleasant. When there is no difference in loudness, a probability that A1 is unpleasant and a probability that A2 is unpleasant are both expected to be the same 50 percent. Assume that when the loudness of A2 is smaller than that of A1 by 1, a probability that A2 is unpleasant is 25 percent. However, when the loudness of A2 is further compared to become smaller than that of A1 by 2, it is unlikely that a probability that A2 is unpleasant is further lowered by 25 percent to become 0 percent. When the loudness difference is 1, it is more natural to consider that the probability is lowered to a half than to consider that the probability of discomfort is lowered by 25 percent. It is natural to consider that the probability becomes 25×(½)=12.5 percent by making similar effort. As explained above, in the sound quality improvement effect, addition does not work but multiplication works. To challenge a limit to 100 percent like yield, −1n(1−p) may be taken. The following expression (3) that combines these two is called the logit transformation. Here, p is the probability of occurance.

$$z = \ln(p) - \ln(1-p) = \ln\left(\frac{p}{1-p}\right) \quad (3)$$

$$p = \frac{\exp(z)}{1+\exp(z)} = \frac{1}{1+\exp(-z)} \quad (4)$$

The inverse transformation of the expression (3) is represented by the expression (4). When an S-character curve, i.e., a sigmoid function, is applied to probabilities p from 0 to 1, this curve is approximated by a cumulative distribution function of a logistic distribution.

Figure 6:
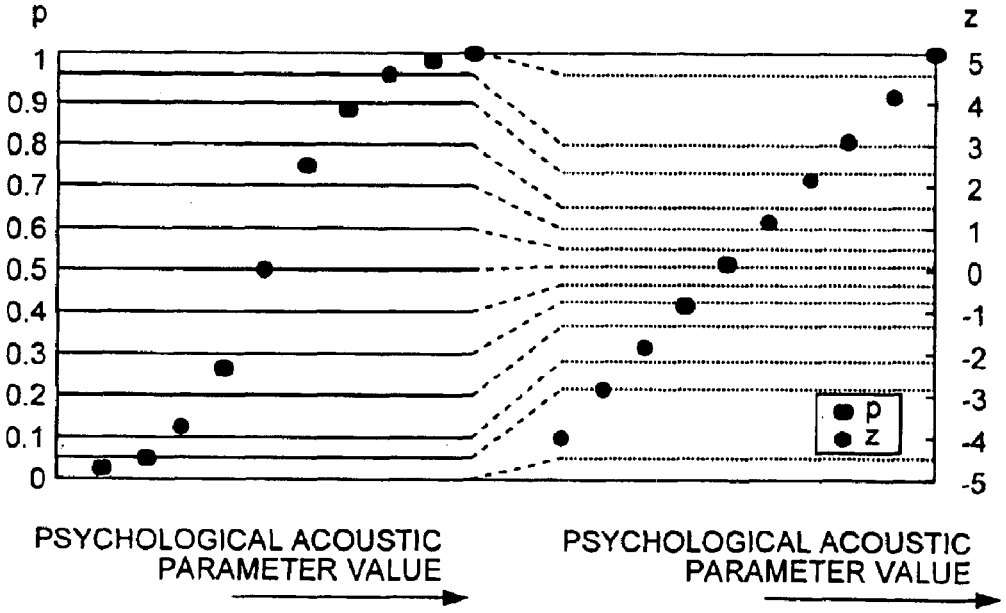
FIG. 6 illustrates the log it transformation of the probability p according to the first embodiment.

FIG. 6 illustrates the logit transformation of the probabilities p. It is known from the graph that linearity works based on the logit transformation. Therefore, an object variable z can be estimated by applying a usual regression analysis, and p can be estimated based on the inverse transformation of the expression (4). In the prediction using a failure rate or proportion p as an object variable, p=r/n may be logit transformed, and regression analysis can be carried out by using this object variable. This analysis is called the logistic regression analysis. However, when r is 0 and n, it is not possible to obtain z, as zero is infinite and n is also infinite. Therefore, the following expression (5) is obtained. This transformation is called empirical logit.

$$z = \ln\frac{r+1/2}{n-r+1/2} \quad (5)$$

In this transformation, all samples including large n and small n are handled equal, and therefore, they need weighting corresponding to the sizes of n. Further, residual variance is different depending on rate. Particularly, when p is in the vicinity of 0 or 1, the variance of the logit z becomes large, which is inconvenient. The original logistic regression analysis takes these points into account.

The calculation method of the sound evaluation expression according to the present invention will be explained. Several sample sounds Ai (i=1, 2, . . . L, . . . a) are prepared, and sample sounds (Ai and Aj) for a paired comparison are prepared. In the present method, it is preferable to carry out experiment according to the method of paired comparison for a×(a−1) times by taking into account a sequence effect, for stimulus pairs of all combinations of "a" sound stimuli. In order to decrease the number of times of experiment, incomplete paired comparison experiment can also be carried out for only important sample pairs by using psychoacoustics parameters. Incomplete paired comparison experiment data are used to derive the present sound quality evaluation expression.

In the derivation of the present sound quality evaluation expression, the evaluation according to the paired comparison is a simple method of selecting which one of Ai and Aj is unpleasant. In principle, a selection of the same discomfort levels is not allowed. However, regarding the Scheffe's method and its improved methods such as the Haga's modified method, the Ura's modified method, and the Nakaya's modified method, a cumulative logistic regression model can be used. For the Bradley-Terry model, the present sound quality evaluation expression can be used. In this way, data of all the paired comparison methods can be used.

An outline of the sound quality evaluation experiment and a flow of the derivation of the sound quality evaluation expression will be explained below.

1. Experiment in Each Speed Region of the Image Formation Apparatus (1) Recording of operation noise from the image formation apparatus with a dummy head (2) Processing of the operation noise, and preparation of a plurality of processing noise (i.e., preparation of sample sound)

(3) Measurement of psycho-acoustics parameters of prepared sample sound (4) Experiment according to the paired comparison method using sample sounds.

2. Logistic Regression Analysis

The inventors carried out experiments using the three types of image formation apparatuses of low speed, intermediate speed, and high speed.

(1) Recording of Operation Noise from the Image Formation Apparatus with a Dummy Head A dummy head HMS (head measurement system) III made by HEAD acoustics GmbH is used to collect operation noise from the front surface of the image formation apparatus. Binaural listening is recorded onto a hard disk.

When binaural listening is recorded and reproduced with a dedicated headphone, the binaural listening can be reproduced in the sense that a person actually listens to the sound from a machine. Measurement conditions are as follows.

(1) Recording environment: Semi-anechoic chamber (2) Position of ear of dummy head: Height 1.2 meters, horizontal distance from machine end surface: 1 meter (3) Recording mode: FF (for free field→anechoic chamber)

(4) HP header: 22 hertz

Among the above measurement conditions, the height of the ear of the dummy head is set to 1.2 meters because a printer is used to print based on a printing instruction from a personal computer as a recent mode of the image formation apparatus. This height takes into account a fact that a person listens to the operation noise from the image formation apparatus by sitting on the chair. Approximately 1.2 meters is the height at which a person sits on a standard chair to listen to the sound. When a person is in a standing state, a standard height of the ear is 1.5 meters. These heights are defined in the ISO7779. In the present embodiment, sounds are collected at the ear height of 1.2 meters. When the sounds are compared at the same height, either one of the heights is acceptable.

Figure 27:
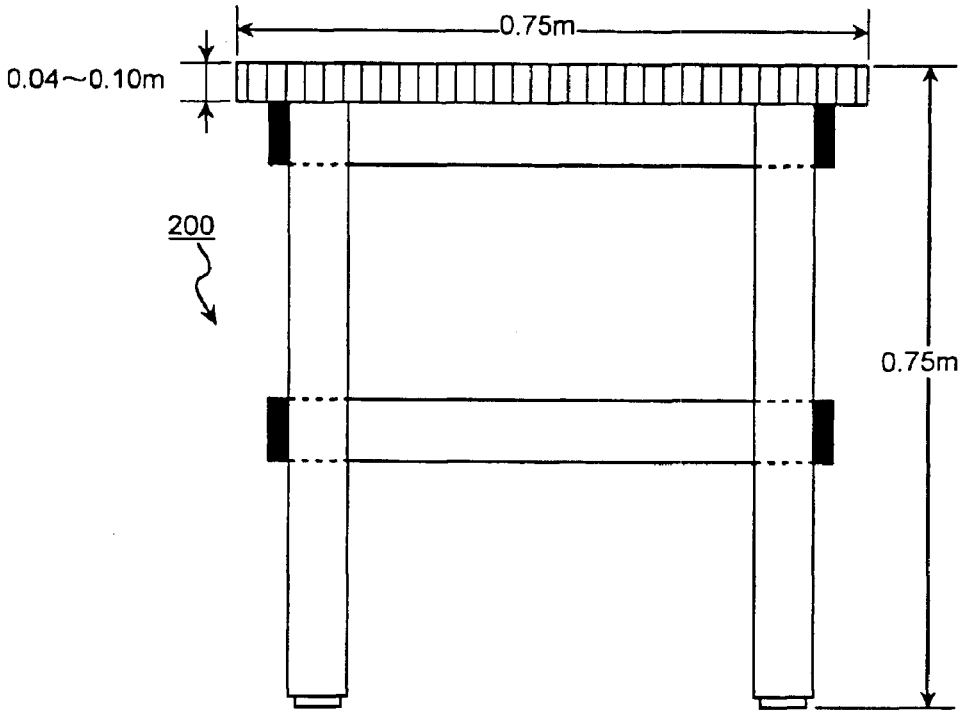
FIG. 27 illustrates a standard sample table used for recording.

FIG. 27 is an explanatory view of a configuration of a standard sample table used for the recording. A standard sample table 200 is based on the specifications as speculated in the attachment A of the ISO7779. The standard sample table 200 is made of combined wooden plates to have a thickness of 0.04 meter to 0.1 meter. The standard sample table 200 has an area of 0.5 square meter or above, and has a length in the horizontal direction of at least 0.7 meter.

The desktop image formation apparatus as shown in FIG. 1, that is, the 20 ppm apparatus in the present embodiment, is installed at the center of the standard sample table 200, thereby to measure and collect sound. On the other hand, the console image formation apparatuses, that is, the 27 ppm apparatus and the 65 ppm apparatus in the present embodiment, are installed on the floor as they are, thereby to measure and collect sound.

Figure 28:
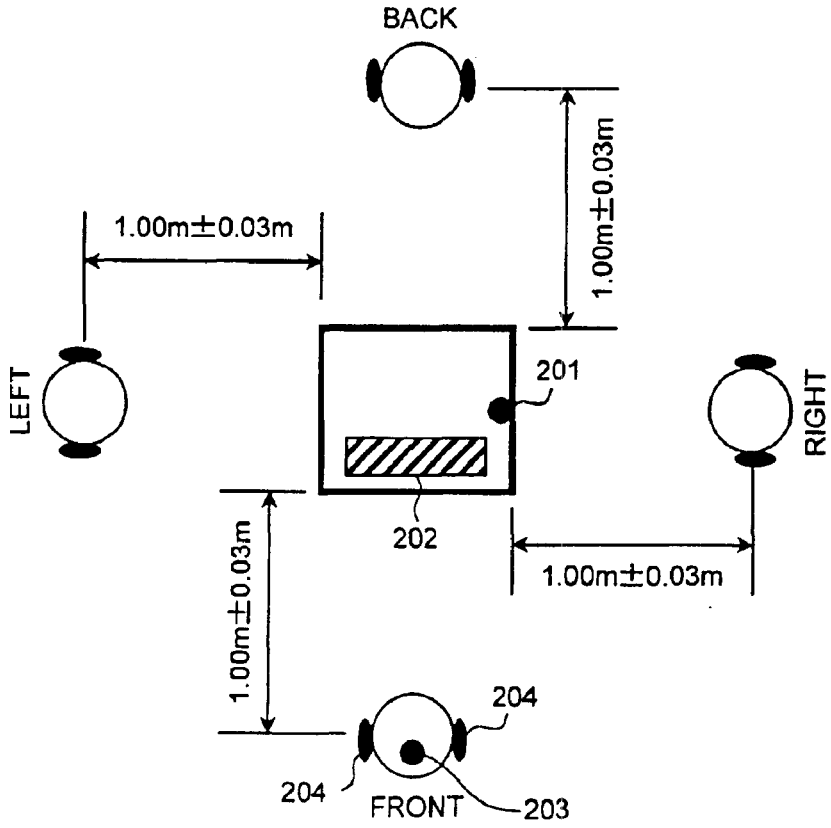
FIG. 28 is an explanatory top plan view of dummy heads and microphones relative to an apparatus that is a target for measurements.

FIG. 28 is an explanatory top plan view of dummy heads 203 and microphones 204 relative to a measured apparatus 201. The measured apparatus 201 is installed at a position within sufficient space in the semi-anechoic chamber. A front-side dummy head is in the direction of an operating section 202. When an operator is at the front, a right-side dummy head is in the right direction of the measured apparatus 201. A left-side dummy head is in the left direction of the measured apparatus 201. A backside dummy head is at the opposite side of the measured apparatus 201. With this arrangement, each dummy head measures and collects sound.

As shown in FIG. 28, the front of each dummy head 203 is directed to the measured apparatus 201, and is installed at the center of each side. A horizontal distance from the dummy head 203 to the end surface of the measured apparatus 201 is set such that the ear position (i.e., microphone position) 204 of the dummy head 203 is 1.00 meter±0.03 meter from the end surface of the measured apparatus 201. With this layout, the dummy heads collect noise emitted from the four directions of the image formation apparatus.

Usually sounds emitted from the image formation apparatus are different depending on directions. This is because frequency distributions and energy amount of noise generated from these surfaces are different depending on a position of a motor driving system, a layout of a paper route, an open state of an external packaging, a position of a paper discharging opening, etc. In other words, depending on the sound source, the sound is audible well at the right side, and is not audible well at the left side. The sound may be audible at the front as an intermediate level between the right-side sound and the left-side sound.

(2) Processing of the Operation Noise, and Preparation of a Plurality of Processing Noise (i.e., Preparation of Sample Sound)

Sound analysis software ArtemiS manufactured by HEAD acoustics GmbH is used to process the operation noise emitted from the image formation apparatus. Sample sound to be used for the experiment may be any one of the sound collected from the four directions. In carrying out the paired comparison experiment, the direction of the collected sample sound needs to be consistently the same. In the present experiment, as the sound from the front of the image formation apparatus reflects average sound of the sound occurred from the left side and the right side of the apparatus, the sound is collected from the front consistently. The user has many chances of listening to the sound of the operating section from the front of the image formation apparatus. The user cannot listen to the sound from the backside of the apparatus at all. The apparatus is usually installed with its backside faced to the wall of the office room. Therefore, the user has little chance of listening to the backside noise. Taking these factors into account, it is optimum to use the sound from the front as the sample sound.

The method of processing sound is such that a main sound source portion of recorded operation noise from the image formation apparatus is attenuated or emphasized on the frequency axis or the time axis. The main sound source includes metal impulse noise, paper impulse noise, paper sliding noise, motor driving system noise, AC charging noise, etc. These main sound sources are different depending on the configuration of the image formation apparatus. For example, the image formation apparatus that employs the DC charging system generates no charging noise.

Sounds from the four directions of the front, back, left, and right of the image formation apparatus are different from each other. It is confirmed that psycho-acoustics parameters can take a larger range of sample sounds when three standards are allocated to the main sound sources of the front, rather than a difference of psycho-acoustics parameters of the sounds from the four directions. In other words, when a subjective evaluation experiment is carried out by preparing sample sounds for a representative main side of the image formation apparatus like in the present system, a sound evaluation system including characteristics of sounds from the four directions of the image formation apparatus can be derived. Based on the derived sound evaluation system, discomfort of the four directions can be calculated. Sound pressure levels of the three standards (i.e., emphasis, the original sound as it is, and attenuation) are allocated to each sound source for one type of apparatus. Nine kinds of sound as combinations of different standards of sound sources are prepared based on an orthogonal table of L9. As a round-robin comparative experiment is necessary, 72 comparative experiments are carried out for the nine kinds of sounds.

(3) Measurement of Psycho-acoustics Parameters of Prepared Sample Sound

The sound analysis software ArtemiS manufactured by HEAD acoustics GmbH is used to obtain psycho-acoustics parameters for the original sound and processed sound from the image formation apparatus.

The psycho-acoustics parameters are calculated as follows.

(1) Loudness

Loudness is an amount that represents a size of sound that a person senses, and uses a unit [sone]. This loudness is calculated according to the E. Zwicker's method of ISO532B that takes into account a critical band and masking.

(2) Sharpness

Sharpness is an evaluation amount having high correlation with discordant noise, and uses a unit [acum]. A loudness density N' (z) is weighted in its high band with a weighting function g (z) and a critical band z. A result is integrated, and is standardized using loudness N, thereby to obtain the sharpness. Specifically, the sharpness is obtained from the following expression:

$$S = C \cdot \frac{\int_0^{24} N'(z) \cdot g(z) \cdot z \cdot dz}{N} acum,$$

where, the weighting function g(z) is given by the following expression:

$$g(z) = \begin{cases} 1 & (z \leqq 16) \\ e^{0.173(z-16)} & (z > 16). \end{cases}$$

The coefficient C is obtained so that the sharpness becomes 1 acum when the center frequency is 1 kilohertz, with a bandwidth equal to or less than 160 hertz, and in band noise at a sound pressure level of 60 decibels.

(3) Tonality

Tonality is an amount used to evaluate what level of pure tone component is included in sound, and uses a unit [tu].

First, all pure tone and narrow-band components are extracted from all the spectra, and all the pure tone and narrow-band components extracted from all the spectra are removed. With this arrangement, a spectrum including only a noise component is obtained. The tonality is calculated from the original loudness and the loudness of only noise component. Specifically, the tonality is calculated at the following steps.

(i) An i-th sound pressure level of a narrow-band spectrum obtained by Fourier transformation or the like is set as $L_i$, and a local peak is detected as follows.

$$L_i - L_{i-1} < L_i > L_i - L_{i+1}$$

(ii) For the local peak to fulfill the following expression, these seven components are set as recording components.

$$L_i - L_{i+1} \geqq 7 \text{ dB} j = -3, -2, +2, +3$$

A total n of the detected $L_i$, a frequency $f_i$ (kilohertz) of $L_i$, a critical band $z_i$ (Bark) corresponding to this frequency $f_i$ (kilohertz), and this bandwidth $\Delta z_i$ (Bark) are also obtained.

(iii) All detected recorded components are removed from the original spectrum. As a result, a spectrum of only noise component is obtained.

(iv) Loudness density $N'_{GR}$ of noise component and loudness $N_{GR}$ are obtained from the spectrum of only noise component.

(v) The following expression $\Delta L_i$ is obtained for all the $L_i$ obtained from the expression in (ii) above.

$$L_i = L_i - (N'_{OR} \text{ in the critical band of } i)$$

(vi) The following value is calculated for only the component of Li≧0.

$$w_T = \sqrt{\sum_{i=1}^{n} [w_1(\Delta z_i) \cdot w_2(f_i) \cdot w_3(\Delta L_i)]^2}$$

$$w_1(\Delta z_i) = \left(\frac{0.13}{\Delta z_i + 0.13}\right)^{1/0.29}$$

$$w_2(f_i) = \frac{1}{\sqrt{1 + 0.2 \cdot \left(\frac{f_i}{0.7} + \frac{0.7}{f_i}\right)^2}}$$

$$w_3(\Delta L_i) = 1 - \exp\left(-\frac{\Delta L_i}{15}\right)$$

(vii) $W_{GR}$ in the following expression is calculated based on the loudness N of the original signal and the loudness $N_{GR}$ for only noise component.

$$W_{GR} = 1 - (N_{GR}/N)$$

(viii) The tonality K is calculated using the following expression.

$$K = C \cdot W_T^{0.29} \cdot W_{GR}^{0.79} [tu]$$

The coefficient C is obtained so that the tonality becomes 1 for the recording of the frequency 1 kilohertz and the sound pressure level of 60 decibels.

(4) Impulsiveness

The following signal listening test is considered.

$$s(t) = [(1-a) + a \cdot i(t)] \cdot f(t)$$

where a: determines impulse overshoot i(t): periodic impulse function (rectangle, triangle, Gauss, cosine impulses) with duration shorter than period f(t): white noise or sinusoids with different frequencies The impulsiveness has the following characteristics (i) Impulsiveness depends on impulse repetition frequency. Impulsiveness increases until the frequency becomes equal to 10 hertz, and decreases when the frequency exceeds 10 hertz. For 20 to 25 hertz or above, the sensation of roughness dominates over impulsiveness.

(ii) Impulsiveness increases monotonically with increasing level.

(iii) Impulsiveness increases monotonically with increasing impulse overshoot a/(1−a).

(iv) Impulsiveness increases with increasing ratio, reaches a maximum and decreases for high values of p.

(v) The sensation of impulsiveness is stronger for impulse functions with a high slope (e.g., rectangle impulse).

The impulsiveness is calculated as follows.

Excitation $e_j$ versus frequency and time is calculated using the hearing model of Sottek. A nonlinear function y ( ) is applied to each band (comprehensive function, approx. linear function for small amplitudes, approx. power law with exponent a=0.15 for large amplitudes), as shown by the following expression:

$$I' = \sum_{j=1}^{N} k_j \cdot \frac{\overline{(y(e_j) - \overline{y(e_i)})^x}}{(\overline{y(e_i)})^m}.$$

All specific impulsiveness values are summed, and scaling is applied to match results of listening tests.

$$I = 0.055556I' + \text{heavi}(I' - 1.8) \cdot (1.271367I' - 2.288461) + \text{heavi}(I' - 7.0) \cdot (-0.326923I' + 2.288461$$

$$\text{heavi}(x) = \begin{cases} 0 & x < 0 \\ 1 & x \geqq 0 \end{cases}$$

A high-frequency component is extracted according to a fourth-order high-pass filtering of $f_{3\ dB}$=10 hertz from the following expression, thereby to fulfill the conditions (i) and (v) in addition to the conditions (ii), (iii), and (iv).

$$y(e_j) - \overline{y(e_i)}$$

(4) Experiment According to the Paired Comparison Method Using Sample Sounds→Calculation of Discomfort Probabilities for Each Sample Pair Evaluating persons who evaluate sample sounds are collected. The evaluating persons carry out a paired comparison of sample sounds, and decide which one of sounds is unpleasant. Experiments are carried out for 382 kinds of data. These data include data for three types of apparatuses for each speed layer, i.e., 72×3=216 kinds of data, and 216 kinds of data for preliminary experiments and mixed experiments of sound for each speed layer.

2. Logistic Regression Analysis

The method of preparing analysis data is explained blow. The paired comparative experiment is carried out, the psycho-acoustics characteristics are measured, and the data are obtained. Then, the data are arranged to make it possible to carry out the logistic regression analysis. Table 1 is an example of an extraction of the paired comparative experiments of four kinds of sample sound from results of experiments of sample sounds of low-speed layers. A first column in Table 1 indicates which sample sound the evaluating persons first listen to. The sample sound that is first listened to is indicated by a symbol 1, and the sample sound that is listened to afterward is indicated by a symbol J.

TABLE 1

| PRESENTATION ORDER | | A1 | | | | A2 | | | | A3 | | | | A4 | | | |
|---|---|---|---|---|---|---|---|---|---|---|---|---|---|---|---|---|---|
| I | J | x1 | x2 | x3 | x4 | x1 | x2 | x3 | x4 | x1 | x2 | x3 | x4 | x1 | x2 | x3 | x4 |
| A1 | A2 | 7.5 | 2.3 | 0.1 | 0.6 | 8.8 | 2.3 | 0.2 | 0.6 | | — | | | | — | | |
| A2 | A1 | 7.5 | 2.3 | 0.1 | 0.6 | 8.8 | 2.3 | 0.2 | 0.6 | | — | | | | — | | |
| A1 | A3 | 7.5 | 2.3 | 0.1 | 0.6 | | — | | | 6.6 | 2.2 | 0.1 | 0.4 | | — | | |
| A3 | A1 | 7.5 | 2.3 | 0.1 | 0.6 | | — | | | 6.6 | 2.2 | 0.1 | 0.4 | | — | | |
| A1 | A4 | 7.5 | 2.3 | 0.1 | 0.6 | | — | | | | — | | | 8.8 | 2.2 | 0.1 | 0.7 |
| A4 | A1 | 7.5 | 2.3 | 0.1 | 0.6 | | — | | | | — | | | 8.8 | 2.2 | 0.1 | 0.7 |
| A2 | A3 | | — | | | 8.8 | 2.3 | 0.2 | 0.6 | 6.6 | 2.2 | 0.1 | 0.4 | | — | | |
| A3 | A2 | | — | | | 8.8 | 2.3 | 0.2 | 0.6 | 6.6 | 2.2 | 0.1 | 0.4 | | — | | |
| A2 | A4 | | — | | | 8.8 | 2.3 | 0.2 | 0.6 | | — | | | 8.8 | 2.2 | 0.1 | 0.7 |
| A4 | A2 | | — | | | 8.8 | 2.3 | 0.2 | 0.6 | | — | | | 8.8 | 2.2 | 0.1 | 0.7 |
| A3 | A4 | | — | | | | — | | | 6.6 | 2.2 | 0.1 | 0.4 | 8.8 | 2.2 | 0.1 | 0.7 |
| A4 | A3 | | — | | | | — | | | 6.6 | 2.2 | 0.1 | 0.4 | 8.8 | 2.2 | 0.1 | 0.7 |

| PRESENTATION ORDER | | (DIFFERENCE BETWEEN I AND J) | | | | FREQUENCY THAT | FREQUENCY THAT | TOTAL NUMBER OF EVALUATING |
|---|---|---|---|---|---|---|---|---|
| I | J | x1 | x2 | x3 | x4 | I IS UNPLEASANT | J IS UNPLEASANT | PERSONS |
| A1 | A2 | −1.25 | 0 | −0.082 | 0.003 | 0 | 31 | 31 |
| A2 | A1 | 1.25 | 0 | 0.082 | −0.003 | 31 | 0 | 31 |
| A1 | A3 | 0.95 | 0.05 | 0.0399 | 0.237 | 27 | 4 | 31 |
| A3 | A1 | −0.95 | −0.05 | −0.0399 | −0.237 | 1 | 30 | 31 |
| A1 | A4 | −1.3 | 0.1 | −0.0207 | −0.05 | 3 | 28 | 31 |
| A4 | A1 | 1.3 | −0.1 | 0.0207 | 0.05 | 27 | 4 | 31 |
| A2 | A3 | 2.2 | 0.05 | 0.1223 | 0.234 | 30 | 1 | 31 |
| A3 | A2 | −2.2 | −0.05 | −0.1223 | −0.234 | 0 | 31 | 31 |
| A2 | A4 | −0.05 | 0.1 | 0.0617 | −0.054 | 19 | 12 | 31 |
| A4 | A2 | 0.05 | −0.1 | −0.0617 | 0.054 | 12 | 19 | 31 |
| A3 | A4 | −2.25 | 0.05 | −0.0606 | −0.288 | 0 | 31 | 31 |
| A4 | A3 | 2.25 | −0.05 | 0.0606 | 0.288 | 30 | 1 | 31 |

In the next block columns from A1 to A4, psycho-acoustics parameters of sample sounds are listed. For simplicity, the parameters are expressed using x1 to x4. x1 represents loudness, x2 represents sharpness, x3 represents tonality, and x4 represents impulsiveness. In Table 1, "-" has the following meaning. When A1 and A2 are used for the paired comparison, for example, the evaluating persons do not evaluate A3 and A4. As there is no influence of A3 and A4, "-" is used in the corresponding rows.

The next block indicates a difference between psycho-acoustics characteristics of sounds that are compared in a pair. Specifically, the evaluating persons compare the sample sound presented first with the sample sound presented later, and determine which one of the sounds is unpleasant. Therefore, it is natural to obtain a difference as J–I. However, as a positive or negative difference between psycho-acoustics parameters finally obtained has no meaning, I–J is used in Table 1. The last three columns indicate a frequency of persons who evaluate I is more unpleasant than J, a frequency of persons who evaluate J is more unpleasant than I, and a total number of the evaluating persons, respectively. In deriving a sound quality evaluation expression, in order to check the influence of an order effect a presentation order may be built into the model as a qualitative variable (i.e., binary data of 0 and 1).

A concept of the sound quality evaluation model is explained next. While a person finds it difficult to straightforwardly evaluate one presented sample sound, the person feels it relatively easy to comparatively evaluate which one of two presented sample sounds is better. A simple example will be explained based on the assumption that discomfort of sample sound is attributable to only loudness.

Discomfort levels of sample sound are expressed as P1, P2, L, and Pa. The following relationship is assumed between a probability Pij of a paired comparison and probabilities Pi and Pj.

$$Pij=Pi/(Pi+Pj) \tag{6}$$

An expression (7) is obtained from the expression (6). When logarithm of both sides of the expression (7) is obtained, the left-hand side is nothing but than the logit transformation.

$$\frac{p_{ij}}{1-p_{ij}} = \frac{p_{ij}}{p_{ji}} = \frac{p_i/(p_i+p_j)}{p_j/(p_i+p_j)} = \frac{p_i}{p_j} \tag{7}$$

$$\ln\left(\frac{p_{ij}}{1-p_{ij}}\right) = \ln p_i - \ln p_j = \alpha_i - \alpha_j = \delta_{ij} \tag{8}$$

When it is assumed that the effect (i is influenced by loudness, the following relationship is obtained.

$$\alpha i=\mu+bx_{loudness\ i} \tag{9}$$

$\mu$ is an absolute average position, and this is unknown. Therefore, the paired comparison method cancels $\mu$ by carrying out a relative paired comparison.

An expression (10) is obtained from the expression (8), when a logarithmic linear effect of loudness is b, using loudness.

$$\ln\left(\frac{p_{ij}}{1-p_{ij}}\right) = (\mu + bx_{loudness\ i}) - (\mu + bx_{loudness\ j}) = b(x_{loudness\ i} - x_{loudness\ j}) \quad (10)$$

From the expression (10), when there are a plurality of psycho-acoustics characteristics that influence the effect αi, it is clear that the model of the expression (2) having a plurality of parameters added, not only loudness, is sufficient.

The sound quality evaluation expression is derived. The data shown in Table 1 are analyzed using the above model. The psycho-acoustics parameters of the sample sounds are as shown in Table 2, which includes the whole regions of the low-speed layer, the intermediate-speed layer, the high-speed layer, the preparatory experiment, and the mixed experiment.

TABLE 2

| SAMPLE SOUND | LOUDNESS (sone) | SHARPNESS (acum) | TONALITY (tu) | IMPULSIVENESS (iu) | SOUND PRESSURE LEVEL dB(A) |
|---|---|---|---|---|---|
| LOW SPEED 21 PPM APPARATUS 1 | 7.5 | 2.3 | 0.12 | 0.61 | 52.8 |
| LOW SPEED 21 PPM APPARATUS 2 | 8.8 | 2.3 | 0.20 | 0.61 | 56.5 |
| LOW SPEED 21 PPM APPARATUS 3 | 6.6 | 2.2 | 0.08 | 0.37 | 49.6 |
| LOW SPEED 21 PPM APPARATUS 4 | 8.8 | 2.2 | 0.14 | 0.66 | 55.9 |
| LOW SPEED 21 PPM APPARATUS 5 | 8.6 | 1.4 | 0.22 | 0.29 | 54.2 |
| LOW SPEED 21 PPM APPARATUS 6 | 8.2 | 2.2 | 0.10 | 0.68 | 54.2 |
| LOW SPEED 21 PPM APPARATUS 7 | 6.8 | 2.4 | 0.11 | 0.43 | 51.8 |
| LOW SPEED 21 PPM APPARATUS 8 | 7.5 | 2.3 | 0.21 | 0.48 | 54.0 |
| LOW SPEED 21 PPM APPARATUS 9 | 7.0 | 2.4 | 0.07 | 0.76 | 53.6 |
| INTERMEDIATE SPEED 27 PPM APPARATUS 1 | 6.9 | 2.4 | 0.05 | 0.40 | 51.0 |
| INTERMEDIATE SPEED 27 PPM APPARATUS 2 | 9.0 | 2.9 | 0.06 | 0.40 | 56.3 |
| INTERMEDIATE SPEED 27 PPM APPARATUS 3 | 4.8 | 2.1 | 0.04 | 0.48 | 47.1 |
| INTERMEDIATE SPEED 27 PPM APPARATUS 4 | 7.9 | 3.1 | 0.04 | 0.45 | 54.6 |
| INTERMEDIATE SPEED 27 PPM APPARATUS 5 | 6.9 | 1.8 | 0.05 | 0.43 | 55.7 |
| INTERMEDIATE SPEED 27 PPM APPARATUS 6 | 7.6 | 2.3 | 0.07 | 0.42 | 57.7 |
| INTERMEDIATE SPEED 27 PPM APPARATUS 7 | 5.7 | 1.8 | 0.08 | 0.42 | 49.2 |
| INTERMEDIATE SPEED 27 PPM APPARATUS 8 | 6.3 | 2.8 | 0.04 | 0.48 | 52.1 |
| INTERMEDIATE SPEED 27 PPM APPARATUS 9 | 6.8 | 3.2 | 0.05 | 0.42 | 50.1 |
| HIGH SPEED 65 PPM APPARATUS 1 | 7.6 | 2.1 | 0.03 | 0.50 | 51.3 |
| HIGH SPEED 65 PPM APPARATUS 2 | 11.9 | 2.4 | 0.08 | 0.49 | 59.1 |
| HIGH SPEED 65 PPM APPARATUS 3 | 10.7 | 2.1 | 0.05 | 0.51 | 57.2 |
| HIGH SPEED 65 PPM APPARATUS 4 | 12.0 | 2.7 | 0.06 | 0.47 | 59.2 |
| HIGH SPEED 65 PPM APPARATUS 5 | 10.0 | 2.4 | 0.04 | 0.48 | 55.3 |
| HIGH SPEED 65 PPM APPARATUS 6 | 11.0 | 1.9 | 0.08 | 0.50 | 58.9 |
| HIGH SPEED 65 PPM APPARATUS 7 | 12.3 | 2.3 | 0.06 | 0.52 | 60.3 |
| HIGH SPEED 65 PPM APPARATUS 8 | 11.5 | 2.1 | 0.05 | 0.54 | 60.3 |
| HIGH SPEED 65 PPM APPARATUS 9 | 10.8 | 3.1 | 0.03 | 0.57 | 58.2 |
| PRELIMINARY EXPERIMENT 1 | 8.7 | 2.2 | 0.03 | 0.47 | 53.3 |
| PRELIMINARY EXPERIMENT 2 | 10.4 | 2.8 | 0.03 | 0.52 | 56.4 |
| PRELIMINARY EXPERIMENT 3 | 9.0 | 2.9 | 0.06 | 0.40 | 56.3 |
| PRELIMINARY EXPERIMENT 4 | 7.6 | 2.3 | 0.07 | 0.42 | 57.7 |
| PRELIMINARY EXPERIMENT 5 | 6.9 | 2.4 | 0.05 | 0.40 | 51.0 |
| PRELIMINARY EXPERIMENT 6 | 6.3 | 2.8 | 0.04 | 0.48 | 52.1 |
| PRELIMINARY EXPERIMENT 7 | 7.0 | 2.4 | 0.07 | 0.76 | 53.6 |
| PRELIMINARY EXPERIMENT 8 | 7.4 | 2.3 | 0.17 | 0.55 | 52.3 |
| MIXED EXPERIMENT FOR THREE APPARATUSES 1 | 10.4 | 2.4 | 0.15 | 0.43 | 56.8 |
| MIXED EXPERIMENT FOR THREE APPARATUSES 2 | 10.4 | 1.9 | 0.11 | 0.46 | 57.4 |
| MIXED EXPERIMENT FOR THREE APPARATUSES 3 | 10.4 | 3.0 | 0.05 | 0.47 | 55.9 |
| MIXED EXPERIMENT FOR THREE APPARATUSES 4 | 8.8 | 1.9 | 0.15 | 0.41 | 58.1 |
| MIXED EXPERIMENT FOR THREE APPARATUSES 5 | 8.7 | 3.0 | 0.09 | 0.39 | 54.6 |
| MIXED EXPERIMENT FOR THREE APPARATUSES 6 | 8.7 | 2.5 | 0.05 | 0.40 | 54.3 |
| MIXED EXPERIMENT FOR THREE APPARATUSES 7 | 7.0 | 2.9 | 0.16 | 0.57 | 51.9 |
| MIXED EXPERIMENT FOR THREE APPARATUSES 8 | 7.0 | 2.3 | 0.10 | 0.64 | 51.6 |
| MIXED EXPERIMENT FOR THREE APPARATUSES 9 | 7.0 | 1.9 | 0.06 | 0.71 | 52.8 |
| TOTAL AVERAGE VALUE | 8.4 | 2.4 | 0.08 | 0.50 | 54.6 |
| AVERAGE OF LOW-SPEED APPARATUS | 7.7 | 2.2 | 0.14 | 0.54 | 53.6 |
| AVERAGE OF INTERMEDIATE-SPEED APPARATUS | 6.9 | 2.5 | 0.05 | 0.43 | 52.6 |
| AVERAGE OF HIGH-SPEED APPARATUS | 10.8 | 2.3 | 0.05 | 0.51 | 57.7 |
| AVERAGE OF PRELIMINARY EXPERIMENT | 7.9 | 2.5 | 0.07 | 0.50 | 54.1 |
| AVERAGE OF MIXED EXPERIMENT | 5.7 | 2.4 | 0.10 | 0.50 | 54.8 |

In the analysis, order effect and interaction effect between the psycho-acoustics characteristics are also examined. As a result, loudness, sharpness, tonality, and impulsiveness are optimum for psycho-acoustics parameters for predicting discomfort. As shown in Table 3, while the order effect is highly significant, chi-square of this effect is sufficiently smaller than that of each of the psycho-acoustics characteristics. Therefore, the chi-square of the order effect is disregarded. The expression (11) is employed by using an average value of estimate values of coefficients of psycho-acoustics parameters as the model. Evaluation results of the model are as shown in Table 3, which is highly significant model.

$$\hat{P}_{ij} = 1 \Big/ \left\{ 1 + \exp\left[ \begin{array}{l} -0.650842(x_{loudness\ i} - x_{loudness\ j}) - \\ 1.022138(x_{sharpness\ i} - x_{sharpness\ j}) \\ -12.08128(x_{tonality\ i} - x_{tonality\ j}) - \\ 3.595879(x_{impulse\ i} - x_{impulse\ j}) \end{array} \right] \right\} \quad (11)$$

TABLE 3

| TERM | ESTIMATE VALUE | STANDARD ERROR | CHI-SQUARE | p VALUE(Prob > ChiSq) |
|---|---|---|---|---|
| | (1) PARAMETER ESTIMATE VALUE (INCLUDING ORDER EFFECT IN MODEL) | | | |
| ORDER EFFECT | −0.2202396 | 0.0227929 | 93.37 | <.0001 |
| LOUDNESS | 0.68771362 | 0.0153519 | 2006.7 | 0.0000 |
| SHARPNESS | 0.95786214 | 0.0404748 | 560.06 | <.0001 |
| TONALITY | 11.4771535 | 0.4268121 | 723.09 | <.0001 |
| IMPULSE | 3.16025754 | 0.1643337 | 369.82 | <.0001 |
| | (2) PARAMETER ESTIMATE VALUE (NOT INCLUDING ORDER EFFECT IN MODEL) | | | |
| LOUDNESS | 0.65084237 | 0.0145633 | 1997.3 | 0.0000 |
| SHARPNESS | 1.0221383 | 0.0401316 | 648.70 | <0.0001 |
| TONALITY | 12.0812836 | 0.4230594 | 815.50 | <.0001 |
| IMPULSE | 3.59587946 | 0.1595061 | 508.22 | <.0001 |

The expression (11) is the model that predicts probabilities of dominance as a result of the paired comparison. A total average value of loudness, sharpness, tonality, and impulsiveness is input to the expression (11). An intercept is obtained by setting discomfort probability in this case as P=0.5. In other words, 0.5=1/{1+exp(−[0.650842(loudness value i−8.4)+1.022138(sharpness value i−2.4)+12.08128 (tonality value i−0.08)+3.595879(impulsiveness value i−0.50)]}

When z is set as the contents of [ ]

$$0.5=1/1+\exp(-z)$$

$$0.5\times\{1+\exp(-z)\}=1$$

$$0.5\times\exp(-z)=0.5$$

$$\exp(-z)=1$$

When natural log of both sides is taken, $$\ln\{\exp(-z)\}=\ln 1=0.$$

In other word, $$\begin{aligned} z &= [0.650842\ (\text{loudness}\ i-8.4)+1.022138\ (\text{sharpness}\ i-2.4)+ \\ &\quad 12.08128\ (\text{tonality}\ i-0.08+3.595879\ (\text{impulsiveness}\ i-0.50)] \\ &= 0.650842\times\text{loudness}\ i+1.022138\ \text{sharpness}\ i+ \\ &\quad 12.08128\times\text{tonality}\ i+3.595879\times\text{impulsiveness}\ i-10.6846459 \end{aligned}$$

Consequently, it is possible to transform the probability that single sample noise is felt unpleasant into the expression (12).

$$\hat{P}_{ij} = 1 \Big/ \left\{ 1 + \exp\left[ \begin{array}{l} 10.68465 - 0.650842\,x_{loudness\ i} - \\ 1.022138\,x_{sharpness\ i} - \\ 12.08128\,x_{tonality\ i} - \\ 3.595879\,x_{impulse\ i} \end{array} \right] \right\} \quad (12)$$

While the average data value is used as the reference value, the reference value can be changed according to a change in the environment. From the expression (11), it is possible to estimate a change in the probabilities of dominance due to a deviation from the average value. A probability when the average value is input is calculated as 0.5. When this probability becomes large, a discomfort level increases. Based on this, a condition for the discomfort probability (using the expression 16) to become at or below a certain probability can be obtained.

Figure 7:
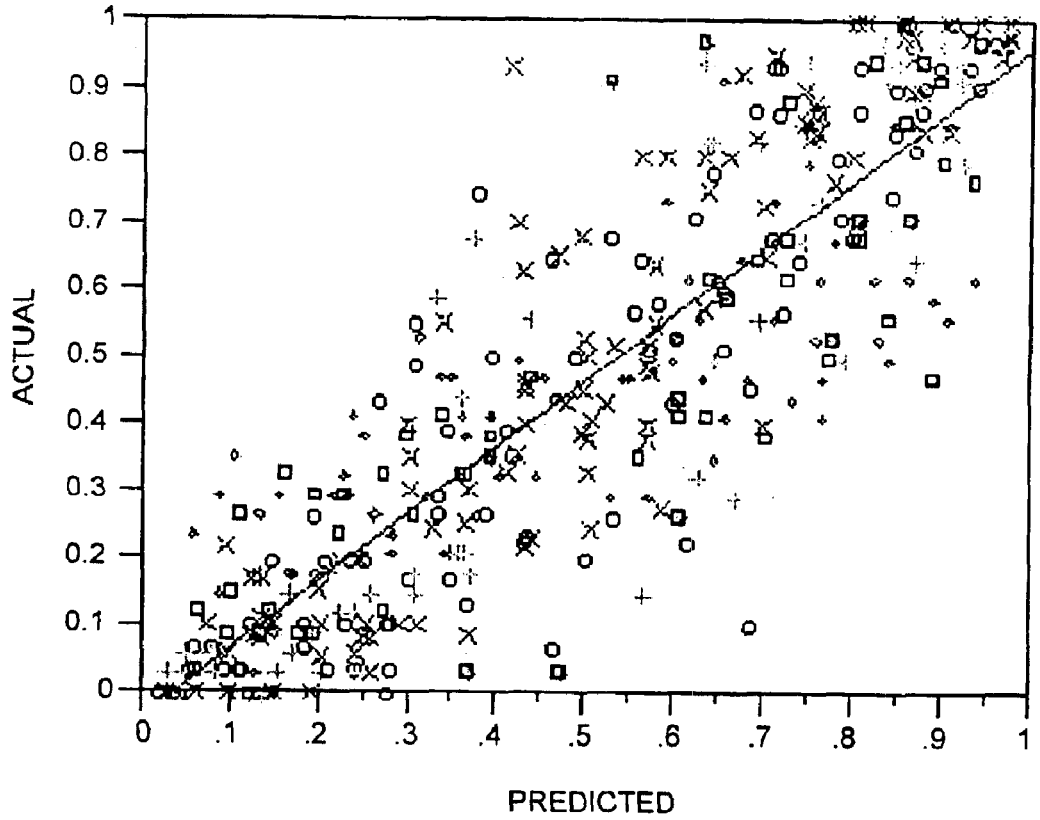
FIG. 7 is a scatter diagram of actual against predicted probabilities according to the first embodiment.

FIG. 7 is a scatter diagram of actual probabilities that I becomes discomfort and predicted probabilities according to the expression (11). As a contribution rate of the scatter diagram is 0.754, the estimation is slightly improved from that according to the linear model of the expression (1).

It is shown in FIG. 7 that the estimation when the real probability is 0 or 1 is not preferable. This problem occurs when sounds having a distinct difference between the two at the beginning are compared. In other words, this problem occurs when all the evaluating persons decide that the same one sound is unpleasant as a result of the comparison between two kinds of sound. This is considered due to a fact that an actual size of a difference is scaled over to make it impossible to carry out the measurement. These individuals are removed from the analysis, and a multiple logistic regression analysis is carried out again. After investigating a physical quantity of a large effect, the following result is obtained.

This time, a model is obtained in which variables include a large sound pressure level having a large correlation with other variables. Like in the expression (12), a total average value of parameters is input to obtain an intercept, thereby to derive a model expression (13) for predicting probabilities that discomfort is sensed from a simple sample sound.

TABLE 4

TEST OF WHOLE MODEL

| MODEL | (−1)* LOGARITHMIC LIKELIHOOD | DEGREE OF FREEDOM | CHI-SQUARE | p VALUE(Prob > ChiSq) |
|---|---|---|---|---|
| DIFFERENCE | 2115.5942 | 5 | 4231.188 | 0.0000 |
| COMPLETE | 7064.7228 | | | |
| COMPACT | 9180.3170 | | | |

PARAMETER ESTIMATE VALUE (NOT INCLUDING ORDER EFFECT IN MODEL)

| TERM | ESTIMATE VALUE | STANDARD ERROR | CHI-SQUARE | p VALUE(Prob > ChiSq) |
|---|---|---|---|---|
| SOUND PRESSURE LEVEL | 0.1625723 | 0.0103554 | 246.47 | <.0001 |
| LOUDNESS | 0.34475769 | 0.0223152 | 238.68 | <.0001 |
| SHARPNESS | 118093783 | 0.0421096 | 786.49 | <.0001 |
| TONALITY | 10.6669829 | 0.4247097 | 630.81 | <.0001 |
| IMPULSE | 2.91380546 | 0.1628838 | 320.01 | <.0001 |

$$\hat{P}_{im} = 1 \Big/ \left\{ 1 + \exp\left[ \begin{array}{l} 16.90601 - 0.1625723\, x_{sound\ pressure\ level} - \\ 0.34475769\, x_{loudness\ i} - \\ 1.18093783\, x_{sharpness\ i} - \\ 10.6669829\, x_{tonality\ i} - \\ 2.91380546\, x_{impulse\ i} \end{array} \right] \right\} \quad (13)$$

Figure 25:
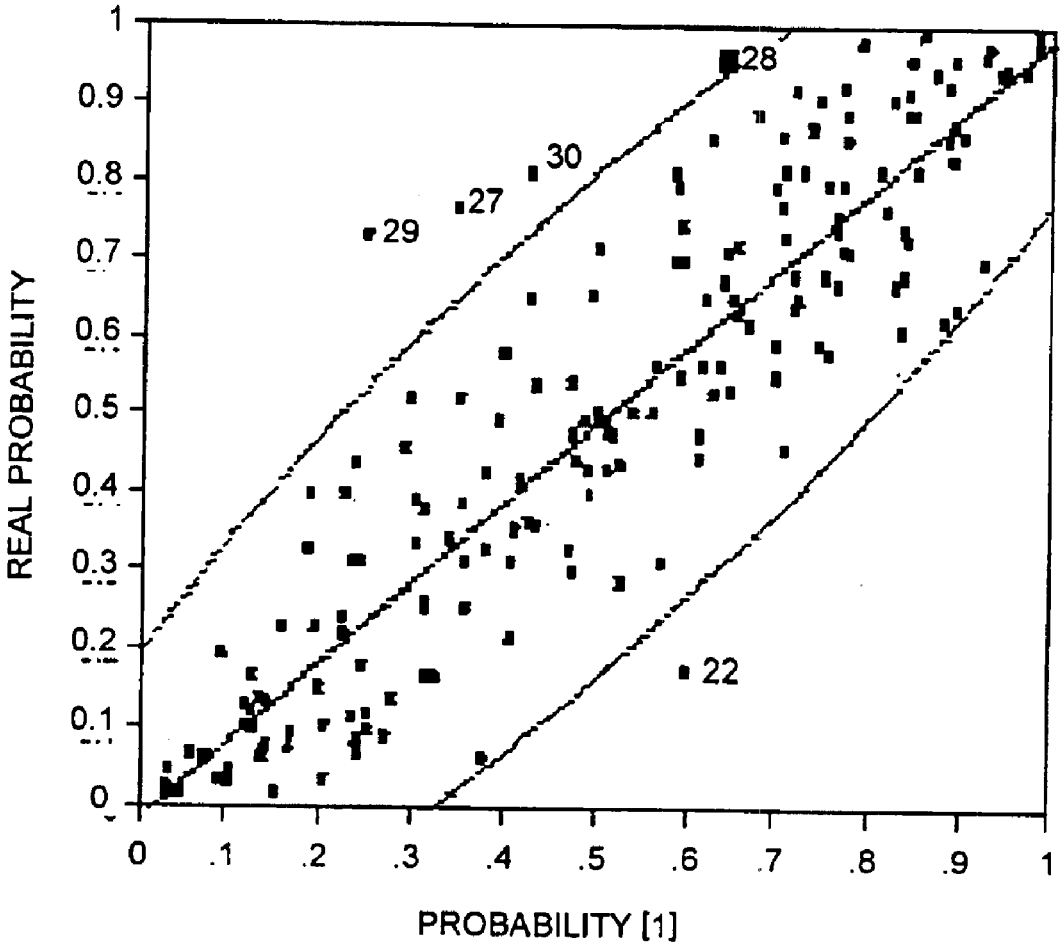
FIG. 25 is a scatter diagram of real probabilities when I represents discomfort and predicted probabilities according to expression (13)

FIG. 25 is a scatter diagram of real probabilities when 1 represents discomfort and predicted probabilities according to the expression (13). From this scatter diagram, a contribution rate is obtained as 0.80, and a standard deviation of errors is obtained as 0.839. These indicate improvement in the estimate from that according to the linear model of the expression (1). An ellipse shown in FIG. 25 is an ellipse of probability 95 percent. Although four points are slightly deviated from the probability ellipse of 95 percent, these points can be regarded to have no problem.

A scatter diagram of a discomfort model for a single sample sound is prepared based on the expression (13). A predicted probability is compared with an actual measurement value for each speed layer or for each experiment. The actual measurement value is obtained by dividing a sum of discomfort levels of sample sounds by a total number of evaluations, without discriminating between sounds for the paired comparative experiment. For example, the experiment is carried out based on 31 evaluating persons for the low-speed apparatus.

For nine kinds of sample sound, one sound is compared with each of the rest eight kinds of sound. Therefore, 496 becomes a denominator. In other words, eight times (i.e. samples to be compared)×two (order)×31=496 persons. The sample sound 1 is compared in pair with each of the sample sounds 2, 3, . . . , and 9. The frequencies that the evaluating persons decide that the sample sound 1 is unpleasant are 0, 57, 7, 19, . . . , from Table 1. Therefore, the sum 221 of these frequencies becomes a numerator. As an average value of the probabilities P of the nine kinds of sample sound is 0.5, a predicted probability is calculated from the expression (13) using an average value of physical quantities obtained by experiment for a low-speed apparatus. Table 5 is obtained as a result.

TABLE 5

| | SOUND PRESSURE LEVEL | LOUDNESS | SHARPNESS | TONALITY | IMPULSIVENESS |
|---|---|---|---|---|---|
| SAMPLE SOUND 1 | 52.8 | 7.5 | 2.3 | 0.12 | 0.61 |
| SAMPLE SOUND 2 | 56.5 | 8.8 | 2.3 | 0.20 | 0.61 |
| SAMPLE SOUND 3 | 49.6 | 6.6 | 2.2 | 0.08 | 0.37 |
| SAMPLE SOUND 4 | 55.9 | 8.8 | 2.2 | 0.14 | 0.66 |
| SAMPLE SOUND 5 | 54.2 | 8.6 | 1.4 | 0.22 | 0.29 |
| SAMPLE SOUND 6 | 54.2 | 8.2 | 2.2 | 0.10 | 0.68 |
| SAMPLE SOUND 7 | 51.8 | 6.8 | 2.4 | 0.11 | 0.43 |
| SAMPLE SOUND 8 | 54.0 | 7.5 | 2.3 | 0.21 | 0.48 |
| SAMPLE SOUND 9 | 53.6 | 7.0 | 2.4 | 0.07 | 0.76 |
| AVERAGE VALUE FOR LOW-SPEED APPARATUS | 53.6 | 7.7 | 2.2 | 0.14 | 0.54 |

| | LOGIT | PREDICTED PROBABILITY | REAL PROBABILITY | REACTION | TOTAL FREQUENCY |
|---|---|---|---|---|---|
| SAMPLE SOUND 1 | −0.12149 | 0.46966 | 0.44556 | 221 | 496 |
| SAMPLE SOUND 2 | 1.77343 | 0.85488 | 0.89113 | 442 | 496 |
| SAMPLE SOUND 3 | −2.14505 | 0.10479 | 0.05242 | 26 | 496 |
| SAMPLE SOUND 4 | 1.08065 | 0.74662 | 0.81653 | 405 | 496 |
| SAMPLE SOUND 5 | −0.41316 | 0.39818 | 0.66532 | 330 | 496 |
| SAMPLE SOUND 6 | 0.22238 | 0.55537 | 0.49798 | 247 | 496 |
| SAMPLE SOUND 7 | −0.98643 | 0.27122 | 0.29839 | 148 | 496 |
| SAMPLE SOUND 8 | 0.71374 | 0.67123 | 0.53427 | 265 | 496 |
| SAMPLE SOUND 9 | −0.12208 | 0.46952 | 0.29839 | 148 | 496 |
| AVERAGE VALUE FOR LOW-SPEED APPARATUS | | | | 2232 | 4464 |

Figure 26A:
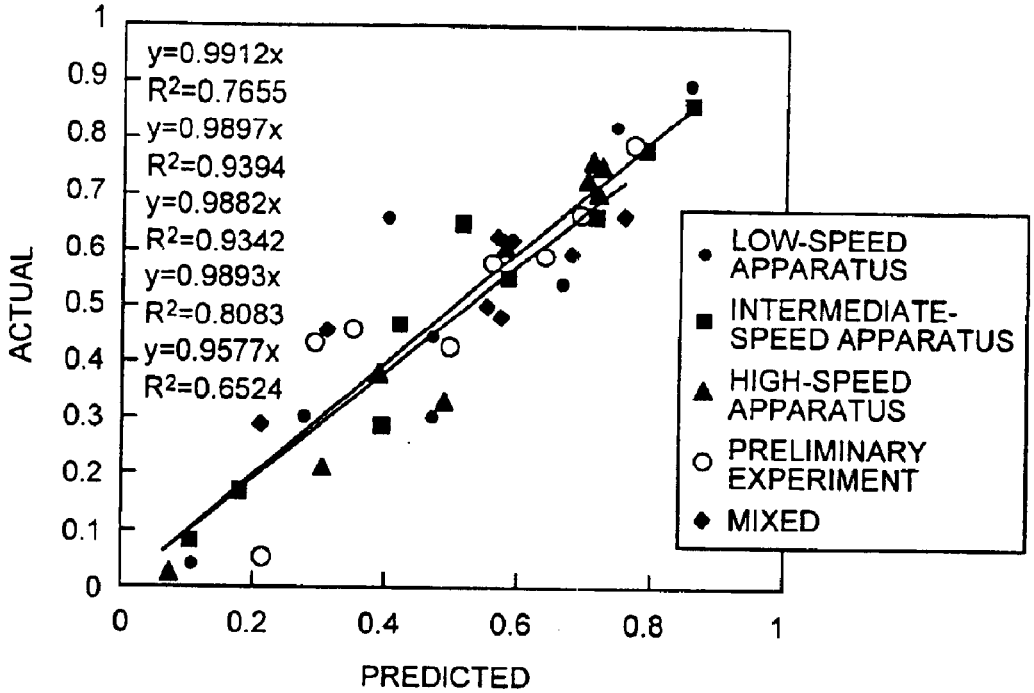
FIGS. 26A and 26B are graphs of actual and predicted probabilities based on a relative model.
Figure 26B:
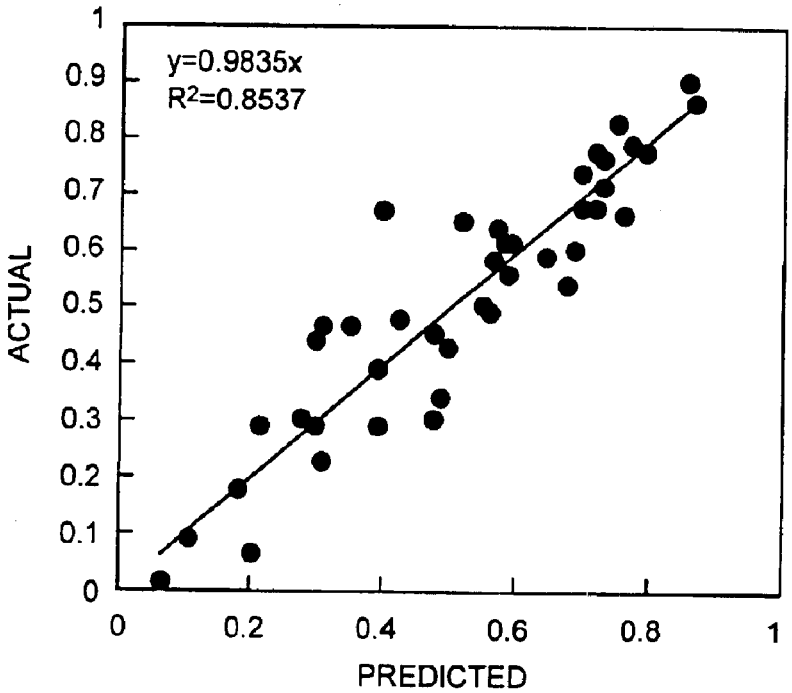

A similar calculation is also carried out for other experiments, thereby to prepare a scatter diagram of predicted probabilities and actual measurement probabilities. As a result, FIGS. 26A and 26B are obtained. FIG. 26A is a graph of a scatter diagram for each experiment. It is clear from this graph that experiments other than mixed experiments fit fairly well with prediction lines. In FIG. 26B, a contribution rate of the model having the experiments integrated together is 0.85. This indicates that the sound pressure level, loudness, sharpness, tonality, and impulsiveness contribute 85 percent to the sensation of discomfort. The slope of the expression is substantially 1, which means that the predicted probability is equal to the actual measurement probability. With this arrangement, a discomfort probability percent can be estimated when the reference value is 50 percent.

From the expression, in order to lower the discomfort level, the following five actions are taken.

(1) Make small the size of an audible level.

(2) Reduce high-frequency components.

(3) Reduce pure tone components.

(4) Reduce impulse noise.

(5) Reduce an acoustic energy.

An estimate value of a regression coefficient of each parameter takes a standard error as shown in Table 4. An estimate value ±2 of a regression coefficient is within a confidence interval of 95 percent. Therefore, it is preferable to include the confidence interval of 95 percent according to the expression (13). When the coefficients are rounded at the third digits below a decimal point, the following results are obtained.

A range of the intercept is obtained by substituting the confidence interval of 95 percent of each regression coefficient. The expression (14) uses this result.

$$\hat{P}_{im} \leqq 1/\{1+\exp[-z]\} \tag{14}$$

where $$z = A \times \text{sound pressure level } i + B \times \text{loudness } i + C \times \text{sharpness } i + D \times \text{tonality } I + E \times \text{impulsiveness } i + F$$

where A, B, C, D, E, and F satisfy the inequalities $0.142 \leqq A \leqq 0.183$ $0.300 \leqq B \leqq 0.389$ $1.097 \leqq C \leqq 1.265$ $9.818 \leqq D \leqq 11.516$ $2.588 \leqq E \leqq 3.240$ $-18.844 \leqq F \leqq -14.968$.

When the estimate value of the regression coefficient is fixed to the estimators shown in Table 4, the following expression (15) is obtained.

$$\hat{P}_{iw} = 1\Bigg/\left\{1+\exp\left[\begin{array}{l} 16.90601 - 0.1625723\, x_{sound\ pressure\ level} - \\ 0.34475769\, x_{loudness\ i} - 1.18093783\, x_{sharpness\ i} - \\ 10.6669829\, x_{tonality\ i} - 2.91380546\, x_{impulse\ i} \pm \\ 2\hat{\sigma} \end{array}\right]\right\} \tag{15}$$

The addition of ±2(=0.839) in the scatter diagram shown in FIG. 25 to z indicates the range of the confidence interval 95 percent. Here represents a standard deviation of errors in discomfort levels.

For the unpleasant sound occurred from the image formation apparatus, the improvement effect needs to be checked for each speed layer. The sound quality evaluation expression is derived this time by using sounds of a wide range of speeds from the low-speed to high-speed apparatuses. A relatively high-speed apparatus having a large sound pressure level and large loudness clearly emits more unpleasant noise than a low-speed apparatus having a small sound pressure level and small loudness.

Therefore, when a discomfort permissible value is obtained in this expression, all the high-speed apparatuses emit unpleasant noise. As some low-speed apparatuses have a high sound pressure level, the image formation speed is not always proportional to the sound pressure level and loudness. However, in the present invention, a relationship between the image formation speed and a discomfort probability is obtained. The discomfort probability of the image formation apparatus is set to a certain value or below. With this arrangement, the image formation apparatus having a probability that sensation of discomfort is low can be provided.

Therefore, it is necessary to obtain the intercept by using an average value of parameters (i.e., average value for each speed layer in Table 2) for the experiment of each speed layer. In other words, the expression (13) is derived using all the data. From this expression (13), each intercept is calculated by setting the probability P as 0.5 when an average value of parameters for each speed layer is input. Next, a difference between the intercept of the total average and the intercept of each speed layer is obtained.

When the probability P that permits discomfort is 0.3 (i.e., the probability that discomfort is sensed is lowered by 20 percent from the current state), a difference of each intercept is corrected to z when the discomfort rate (expression 16) in the expression (14) is 0.3. The discomfort rate is returned to the discomfort rate (expression 16). Then, it is possible to calculate to which discomfort rate (expression 16) P=0.3 in each layer changes to in the expression (14). Table 6 and Table 7 summarize the calculation results.

$$\hat{P}_{i\varpi} = 1\Big/\left\{1+\exp\left[\begin{array}{l}16.90601-0.1625723\,x_{sound\ pressure\ level}-\\0.34475769\,x_{loudness\,i}-1.18093783\,x_{sharpness\,i}-\\10.6669829\,x_{tonality\ i}-2.91380546\,x_{impulse\ i}\pm\\2\hat{\sigma}\end{array}\right]\right\} \tag{15}$$

$$\hat{P}_{im}=0.2725\ \ln(\text{ppm})-0.6331 \tag{16}$$

$$\hat{P}_{im}\leqq 0.2725\ \ln(\text{ppm})-0.6331 \tag{17}$$

The sound quality evaluation expressions indicate that unpleasant sound sources have a high correlation with the sound pressure level, loudness, sharpness, tonality, and impulsiveness. The sound sources of the image formation apparatus having a high correlation with each of the psychoacoustics parameters are as follows.

(1) Sharpness: sliding noise of recording paper, (2) Tonality: AC charging noise, (3) Impulsiveness: Metal impulse noise, and (4) Sound pressure level and loudness: Acoustic energy, and size of audible level from various sound sources.

Therefore, measures for these sound sources are taken as [reduction in charging noise], [reduction in paper sliding noise], and [reduction in metal impulse noise], as explained below.

Figure 9:
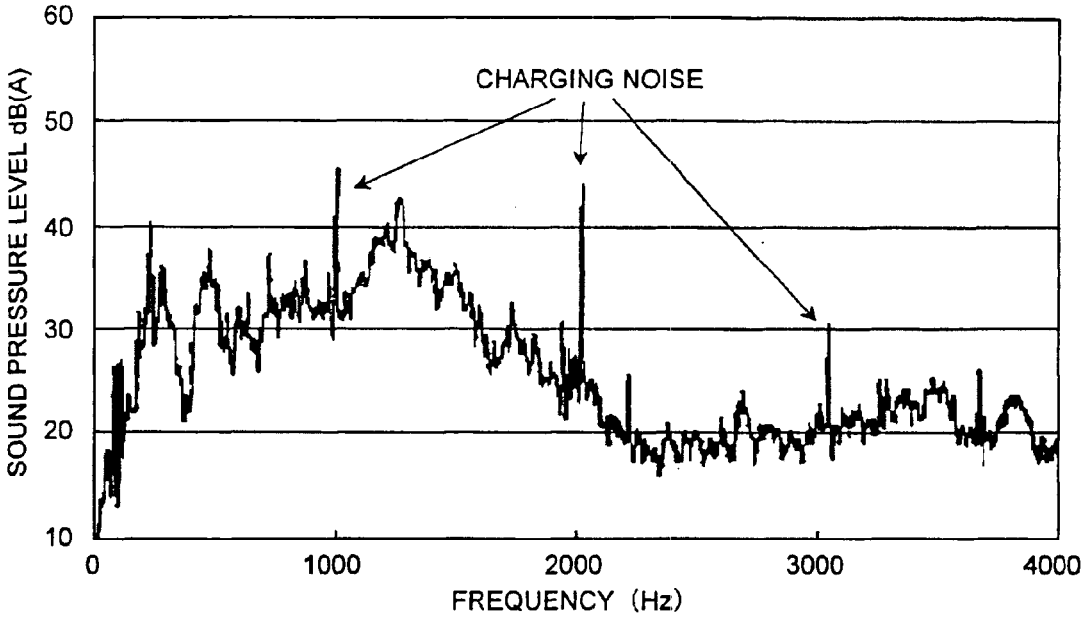
FIG. 9 is a graph of a sound pressure level against frequency of charging noise of the image formation apparatus according to the first embodiment.

FIG. 9 is a graph of a result of analyzing frequency of charging noise from the image formation apparatus. A main object of this graph is to check a frequency distribution. Therefore, while a relative comparison between sound pressure levels of each frequency has meaning, an absolute value of the sound pressure level has no meaning as the sound pressure levels are not corrected accurately. Precipitous peaks of 1 kilohertz, 2 kilohertz, and 3 kilohertz are called charging noise. As is clear from FIG. 9, the charging noise has a sound pressure level higher than that of other surrounding frequencies by at least 10 decibels. Although the pure tone component of this high level forms only a fine portion of the total energy, this sound is not masked by other sound, and is clearly audible as unpleasant noise. This sound has high tonality. The present inventor realizes a method of attenuating this charging noise in the following configurations.

TABLE 6

| TERM | COEFFICIENT ESTIMATE VALUE | TOTAL PARAMETER AVERAGE VALUE | HIGH-SPEED LAYER PARAMETER AVERAGE VALUE | INTERMEDIATE-SPEED LAYER PARAMETER AVERAGE VALUE | LOW-SPEED LAYER PARAMETER AVERAGE VALUE |
|---|---|---|---|---|---|
| SOUND PRESSURE LEVEL | 0.1625723 | 54.6 | 57.7 | 52.6 | 53.6 |
| LOUDNESS | 0.34475769 | 8.4 | 10.8 | 6.9 | 7.7 |
| SHARPNESS | 1.18093783 | 2.4 | 2.3 | 2.5 | 2.2 |
| TONALITY | 10.6669829 | 0.08 | 0.05 | 0.05 | 0.14 |
| IMPULSE | 2.91380546 | 0.50 | 0.51 | 0.43 | 0.54 |
| INTERCEPT | — | −16.906 | −17.910 | −15.662 | −16.987 |
| DIFFERENCE OF INTERCEPT FROM TOTAL AVERAGE | — | — | −1.004 | 1.244 | −0.081 |

TABLE 7

| | IMAGE FORMATION SPEED | $\hat{P}_i$* | z |
|---|---|---|---|
| TOTAL | — | 0.3 | −0.847 |
| HIGH SPEED | 65 | 0.54 | 0.157 |
| INTERMEDIATE SPEED | 27 | 0.11 | −2.091 |
| LOW SPEED | 21 | 0.32 | −0.766 |

Figure 8:
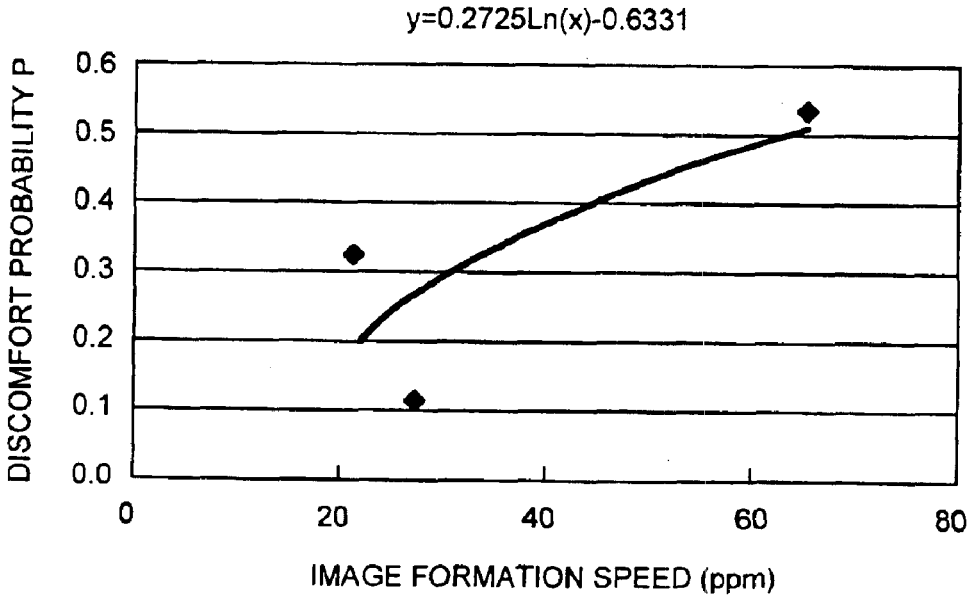
FIG. 8 is a graph of discomfort probability against printing speed of the image formation apparatus according to the first embodiment.

FIG. 8 is an approximation curve obtained from a scatter diagram of an image formation speed and a permissible probability. The expression (16) represents the approximation expression. In other words, when the probability P is equal to or lower than that shown in the expression (16), the probability that the sound is sensed unpleasant becomes small.

EXAMPLE 1

To Reduce Charging Noise

Cylindrical members having high rigidity are pressed into the photosensitive drum 1 as the image holder. The eigen frequency within the photosensitive drum 1 is set to a value different from the frequency that is obtained by multiplying a natural number to the frequency f of the AC bias of the charging roller 21, thereby to lower the charging noise.

The frequency of the oscillation that is generated between the charging roller 21 and the photosensitive drum 1 coincides with or is in the vicinity of the frequency that is obtained by multiplying a natural number to the eigen frequency fd of the photosensitive drum 1 itself. In this case, the photosensitive drum 1 oscillates, and the sound pressure level of the charging noise increases rapidly. As a result, the discomfort probability P rises rapidly. Therefore, the eigen frequency fd of the photosensitive drum 1 is set to a frequency that is different from the frequency obtained in advance by multiplying a natural number to the frequency f of the AC bias at the charging time. With this arrangement, resonance of the photosensitive drum 1 is prevented, thereby to lower the charging noise. In the example shown in FIG. 9 for example, the frequency obtained by multiplying a natural number to 1000 hertz is not coincided with the eigen oscillation fd of the photosensitive drum 1.

Figure 10:
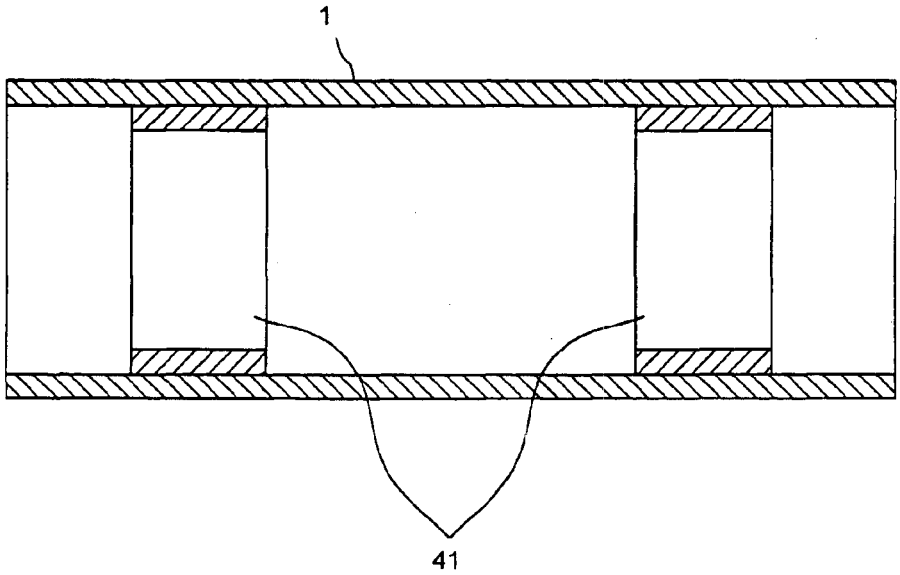
FIG. 10 is a cross-sectional view of a configuration to change the eigen frequency of a photosensitive drum.

FIG. 10 is a cross-sectional view of a configuration example of a change in the eigen frequency of the photosensitive drum 1. Referring to FIG. 10, cylindrical members 41 having high rigidity are pressed into the photosensitive drum 1. As the weight and the rigidity of the photosensitive drum 1 increase when the cylindrical member 41 are pressed in, the eigen frequency of the photosensitive drum 1 changes. Consequently, when the frequency obtained by multiplying a natural number to the frequency f of the AC bias coincides with or is in the vicinity of the eigen frequency of the photosensitive drum 1, the eigen frequency of the photosensitive drum 1 can be changed. Therefore, it is possible to prevent the occurrence of unpleasant charging noise due to the resonance.

EXAMPLE 2

To Reduce Charging Noise

According to the example 2 of reducing charging noise, the image formation apparatus shown in FIG. 1 has a sound absorbing member provided within the photosensitive drum 1 as the image holder. The sound absorbing member absorbs sound reflected within the drum, and lowers charging noise.

Figure 11A:
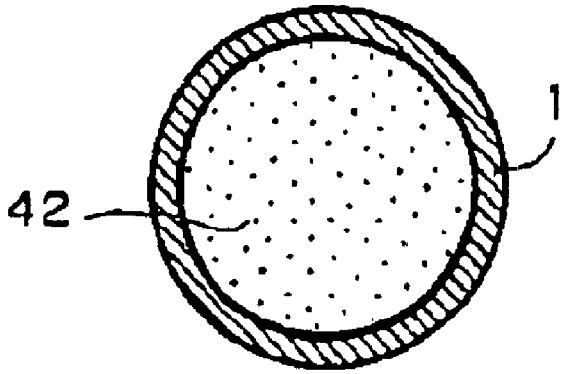
FIGS. 11A and 11B are cross-sectional views of a structure for absorbing sound propagating in the photosensitive drum.
Figure 11B:
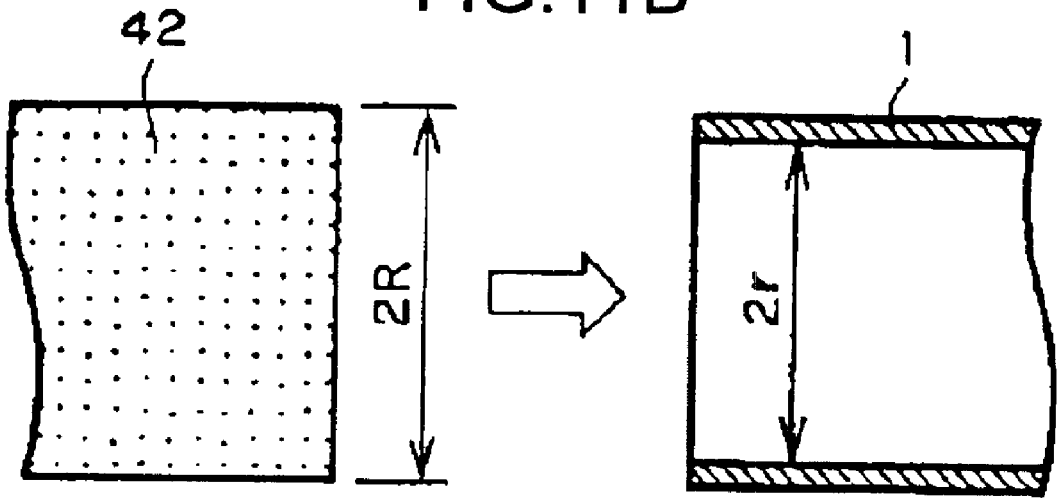

FIGS. 11A and 11B are cross-sectional views of a configuration example of absorption of sound reflected within the photosensitive drum 1. FIG. 1A is a cross-sectional view of a configuration example of the photosensitive drum 1 into which a sound absorbing member 42 is pressed. FIG. 11B is a cross-sectional view of a relationship between the sound absorbing member 42 and the photosensitive drum 1.

As shown in FIG. 11B, the sound absorbing member 42 having a cylindrical shape with a diameter 2R larger than an internal diameter 2r of the photosensitive drum 1 is prepared. The sound absorbing member 42 may be made of foamed polyurethane for easy handling. For example, a sound absorbing member Hama Damper HU-4 made by Yokohama Rubber Co., Ltd., or the like. This material is elastically deformed, and is inserted into the photosensitive drum 1. FIG. 1A is an illustration of a state that the sound absorbing member 42 is pressed into the photosensitive drum 1. The inserted sound absorbing member 42 expands to restore the pre-deformation shape. Therefore, the sound absorbing member 42 can be easily taken out from the photosensitive drum 1. This sound absorbing member 42 can absorb charging sound generated from the photosensitive drum 1.

EXAMPLE 3

To Reduce Charging Noise

According to the example 3 of reducing charging noise, the image formation apparatus shown in FIG. 1 has a damping member 43 adhered to the inside of the photosensitive drum 1 as the image holder. The damping member 43 attenuates oscillation energy within the drum, and lowers charging noise.

Figure 12:
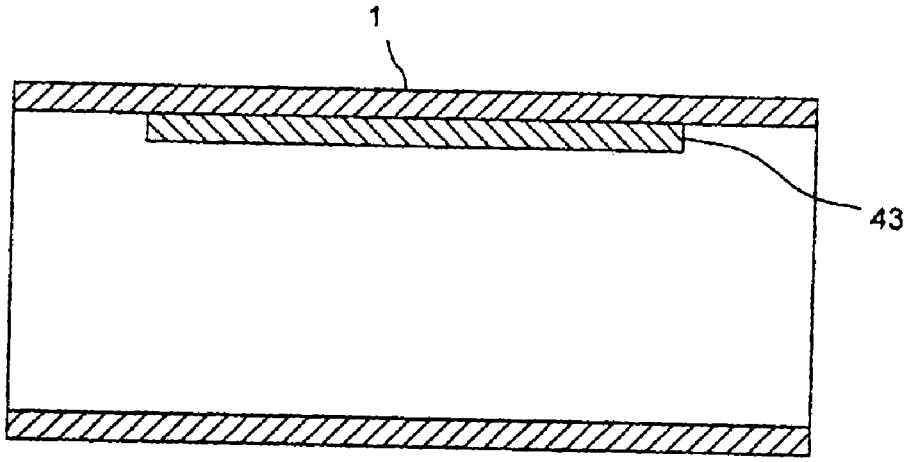
FIG. 12 is a cross-sectional view of a structure for absorbing sound propagating in the photosensitive drum.

FIG. 12 is a cross-sectional view of a configuration example of attenuation of the oscillation energy within the photosensitive drum 1. The damping member 43 is adhered to the inside of the photosensitive drum 1. The damping member 43 absorbs the oscillation energy of the photosensitive drum 1, converts the energy into thermal energy. This has an effect of attenuating the oscillation speed or the oscillation amplitude, thereby to minimize the acoustic radiation. A lightweight damping member called Rejetolex manufactured by Nitto Denko Co., is available, for example, as a material for the damping member 43. This material has a highly viscous adhesive applied to a thin aluminum plate as a substrate. The adhesive absorbs oscillation energy. Therefore, the damping member 43 absorbs the oscillation energy between the charging roller 21 and the photosensitive drum 1 generated due to the frequency f of the AC bias during the charging, and suppresses the generation of charging noise.

EXAMPLE 4

To Reduce Charging Noise

According to the example 4 of reducing charging noise, the image formation apparatus shown in FIG. 1 has a charging roller inside the photosensitive drum 1 as the image holder. The charging roller charges a DC bias, and lowers charging noise.

Figure 13:
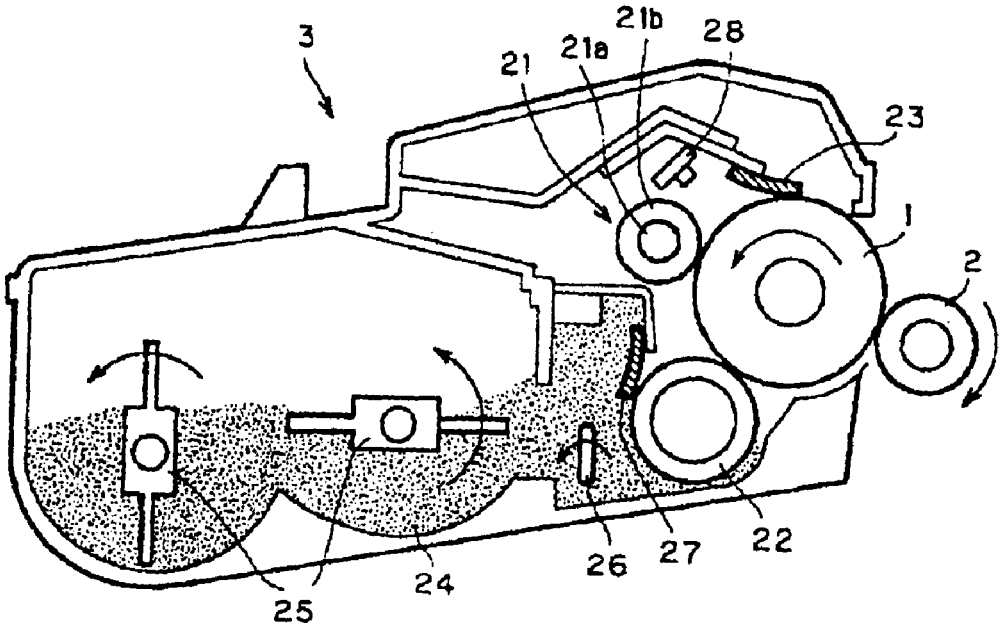
FIG. 13 illustrates a structure of a process cartridge based on a direct current charging system.

FIG. 13 is an explanatory view of a configuration example of the process cartridge 3 using the DC charging system. Around the photosensitive drum 1 as the image holder, the process cartridge 3 comprises the charging roller 21 as a charging unit, the developing roller 22 as a developing unit, the cleaning blade 23 as a cleaning unit, and a charge removing lamp 28. A toner hopper comprises an agitator 25 that agitates the toner 24 and supplies the agitated toner to the developing roller 22, the stirring shaft 26, and the developing blade 27. The charging roller 21 includes the core metal 21*a*, and the charger 21*b*.

The charging roller 21, the developing roller 22, and the cleaning blade 23 are disposed in a predetermined condition, around the photosensitive drum 1 as the image holder. The agitator 25 and the stirring shaft 26 agitate the toner 24 within the process cartridge 3, and convey the agitated toner 24 to the developing roller 22. The toner 24 adheres to the roller surface due to the magnetic force within the developing roller 22. When this toner 24 passes through the developing blade 27, the toner 24 is charged in minus due to frictional charging. The toner charged in minus moves to the photosensitive drum 1 due to a bias voltage, and adheres to an electrostatic latent image.

When the recording paper fed from the resist roller 11 passes through between the photosensitive drum 1 and the transfer roller 2, the toner is transferred from the photosensitive drum 1 onto the recording paper due to plus charge from the transfer roller 2. The cleaning blade 23 scratches the toner that remains on the photosensitive drum 1, and recovers the scratched toner as waste toner into a tank above the cleaning blade 23. The charge removing lamp (i.e., light-emitting lamp, hereinafter, "LED") 28 emits a beam onto the whole surface of the photosensitive drum 1, to remove the residual potential from the surface, thereby to prepare for the next image formation. The portions other than the transfer roller 2 are integrated as the process cartridge 3, which a user can replace.

When the charging roller 21 is charged with an AC bias, the attracting force and the repulsive force alternately work between the surface of the charging roller 21 and the surface of the photosensitive drum 1 due to the AC component of the bias. This may cause the charging roller 21 to generate oscillation. On the other hand, when the charging roller 21 is charged with a DC bias, the charging roller 21 generates no oscillation. Consequently, no charging noise is generated. When only the DC bias is applied to the charging roller 21, a charge remover is necessary to remove the residual charge, which is not required when AC bias is charged. As explained above, when the charging system is changed from the AC charging to the DC charging, generation of unpleasant charging noise can be prevented.

In the present embodiment, the method of lowering the AC charging noise is explained. As the sound sources of pure tone, there are also rotation driving noise from a polygon motor and a polygon mirror, and noise from driving frequency of a stepping motor. Therefore, these unpleasant noises also require removal.

Figure 14:
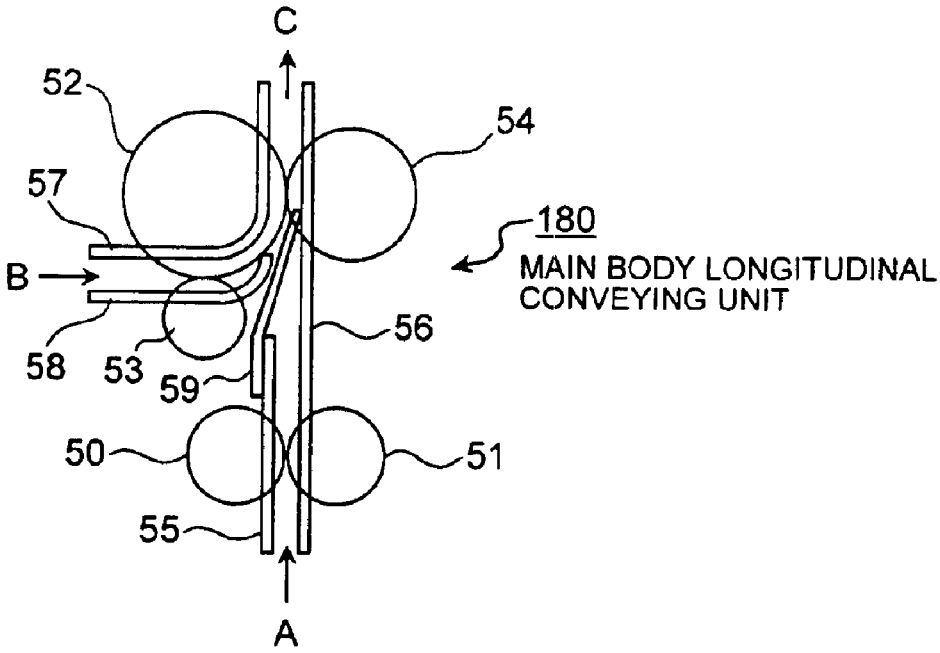
FIG. 14 illustrates a detailed structure of a main body longitudinal conveying unit in the console-type image formation apparatus.
Figure 15:
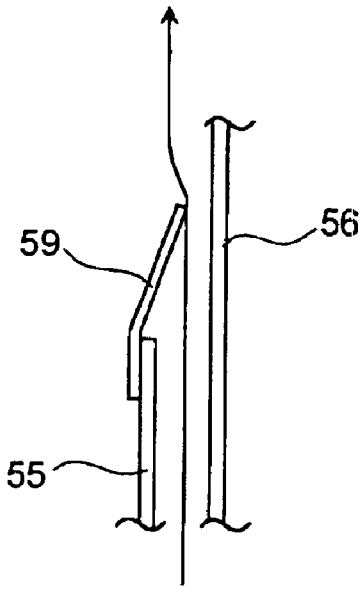
FIG. 15 is an explanatory view of a flexible sheet and a conveyance state according to this flexible sheet when noise prevention measure is not taken.

A configuration of a conveying route as a sound source of paper sliding noise, and causes of generation of the noise will be explained. FIG. 14 is an explanatory view of a detailed configuration of rollers and guide plates of the main body longitudinal conveying unit 180 in the image formation apparatus shown in FIG. 4. In other words, FIG. 14 is a cross-sectional view of a conveyer portion that guides the conveyance from the paper feed tray and the conveyance from the intermediate tray to carry out two-sided printing, to the resist roller direction. FIG. 15 is an explanatory view showing a relationship between recording paper and a flexible sheet 59 when noise prevention measure is not taken.

In FIG. 14, reference numerals 50 and 51 denote rollers having a plurality of skids provided on a shaft bunching up together. The roller 50 and the roller 51 are formed as a first pair of conveyer rollers that convey the recording paper. The roller 50 and the roller 51 rotate the recording paper conveyed from the paper feed tray to further convey the paper to a direction A shown in the drawing. Reference numerals 52, 53, and 54 denote rollers having a plurality of skids provided on a shaft bunching up together. The roller 52 and the roller 53 are formed as a second pair of conveyer rollers that convey the recording paper. The roller 52 and the roller 53 rotate the recording paper conveyed from the intermediate tray to further convey the paper to a direction B shown in the drawing. The roller 52 and the roller 54 are formed as a third pair of conveyer rollers that convey the recording paper. The roller 52 and the roller 54 rotate the recording paper to a direction C, that is, the resist roller direction shown in the drawing.

Guide plates 55 and 56 are provided on the conveying route for the first pair of conveyer rollers that rotate to convey the paper to the arrow direction A. Holes are provided on the guide plates 55 and 56 to escape from the skids of the rollers 50 and 51. Similarly, guide plates 57 and 58 are provided on the conveying route for the second pair of conveyer rollers that rotate to convey the paper to the arrow direction B. Holes are provided on the guide plates 57 and 58 to escape from the skids of the rollers 52 and 53. The conveying route for the third pair of rollers that rotate to convey the paper to the arrow direction C has an extension of the guide plates 56 and 57. Holes are provided on the extension portions of the guide plates 56 and 57 to escape from the skids of the rollers 52 and 54. In other words, the conveying force of the pairs of conveyer rollers and easiness of the conveyance of the guide plates are secured based on this configuration.

The flexible sheet 59 that extends to the recording paper conveying direction is fitted to the end of the downstream of the guide plate 55, thereby to guide the recording paper. The conveying route is formed to convey the recording paper conveyed from the direction A to the direction C.

In many cases, the recording paper conveyed from the intermediate tray to the direction B is curled downward. In order to prevent the occurrence of bending or jamming (i.e. jamming of paper), the flexible sheet (specifically, polyester film, product name: Mylar) 59 is bent to the right direction in the drawing. Therefore, the recording paper conveyed from the paper feed tray to the direction A bypasses the front end of the flexible sheet 59, and proceeds into between the rollers 52 and 54.

Figure 19:
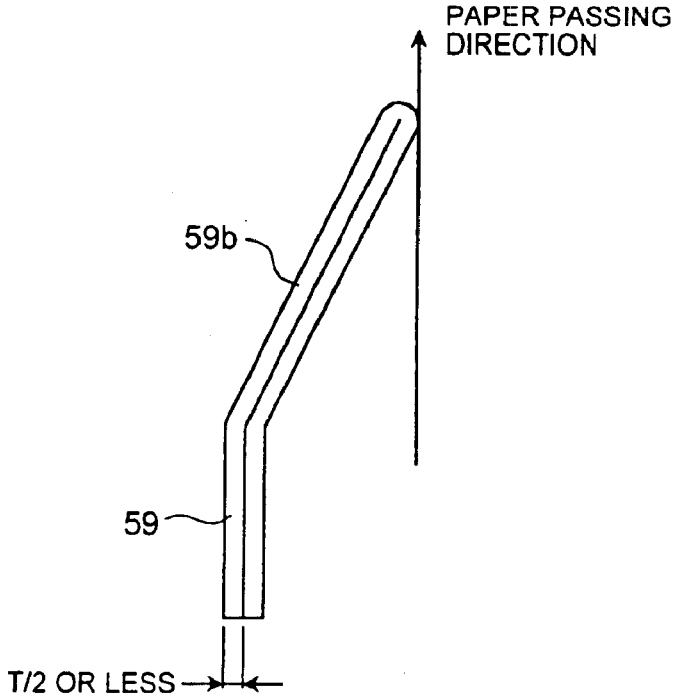
FIG. 19 is an explanatory view of a state that a measure is taken for a front edge of the flexible sheet.

When no measure is taken for the flexible sheet 59 as shown in FIG. 19, the recording paper is conveyed while sliding on the front end of the flexible sheet 59. However, the recording paper has uneven fiber surface. Further, the flexible sheet 59 has flash at the end surface due to shearing. Therefore, as the unevenness of the fiber on the surface of the recording paper further progresses, the flash of the edge of the flexible sheet 59 and the recording paper vibrate to generate large noise. It takes much cost and time to remove the flash from the edge of each flexible sheet 59. To overcome this difficulty, the flexile sheet 59 is devised as follows, thereby to lower the paper sliding noise.

Figure 16:
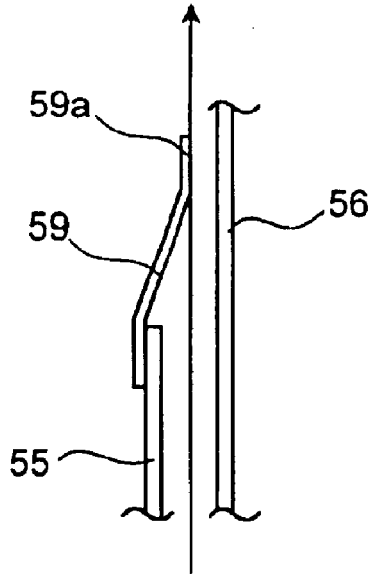
FIG. 16 is an explanatory view of a flexible sheet and a conveyance state according to this flexible sheet when noise prevention measure is taken.
Figure 17:
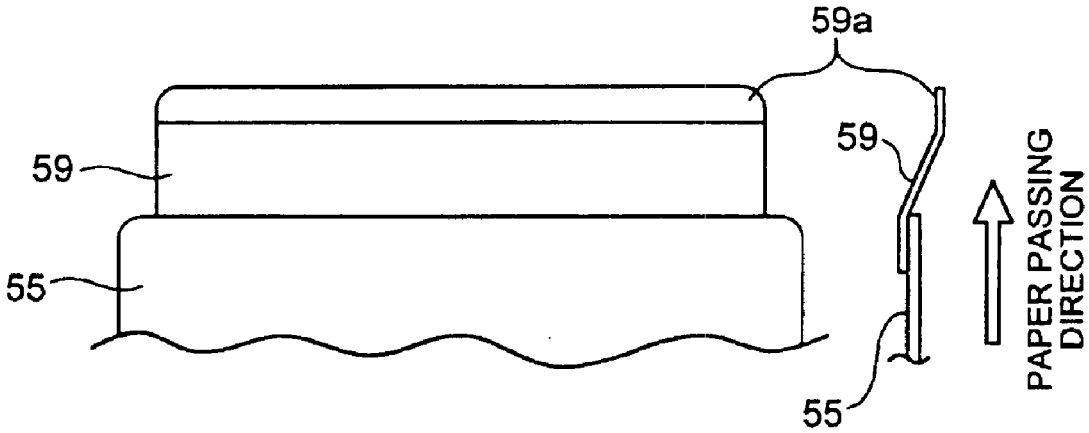
FIG. 17 is a top plan view and a side view of the flexible sheet.

FIG. 16 and FIG. 17 are illustrations of an example of the flexible sheet 59 according to the embodiment of the present invention. In order to lower the sliding noise generated when the recording paper conveyed from the arrow direction A in FIG. 14 is scratched (i.e., noise including a higher harmonic component generated when the edge of the paper having some coarseness is slid), a bending 59*a* is provided on the front end of the flexible sheet 59 that is fitted to the guide plate 55, in FIG. 16 and FIG. 17. As the front surface of the flexible sheet 59 is extremely smooth, this smoothness is not lost even when the bending 59*a* is provided. FIG. 16 is an illustration of a state that the recording paper is conveyed while sliding along the bending 59*a* of the flexible sheet 59.

Figure 18:
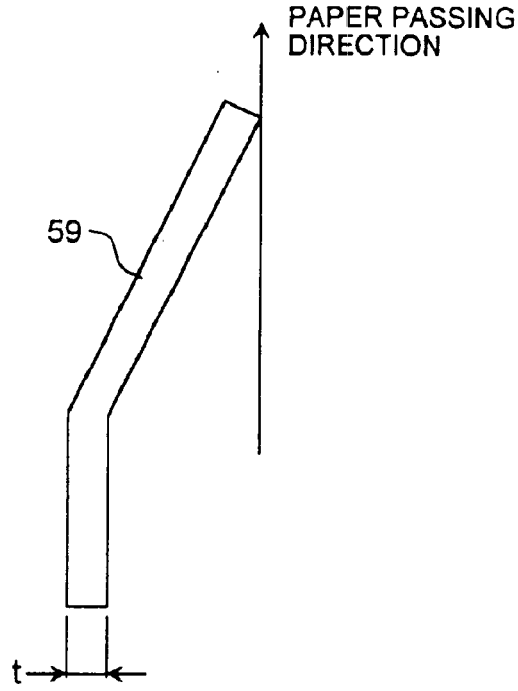
FIG. 18 is an explanatory view of a state that a measure is not taken for a front edge of the flexible sheet.

Shapes of the front end of the flexible sheet 59 are shown in FIG. 18 and FIG. 19. FIG. 18 is the illustration of a state that a measure is not taken for the front edge of the flexible sheet. FIG. 19 is the illustration of two sheets, each having a thickness of a half of a sheet thickness t or smaller, are superimposed with each other in a bent state. In FIG. 19, a front end 59*b* of the sheet is rounded in an R shape, without changing the thickness of the flexible sheet 59. With this arrangement, the vibration of the flexible sheet 59 with the recording paper is reduced. Therefore, the paper sliding noise is lowered.

Figure 20:
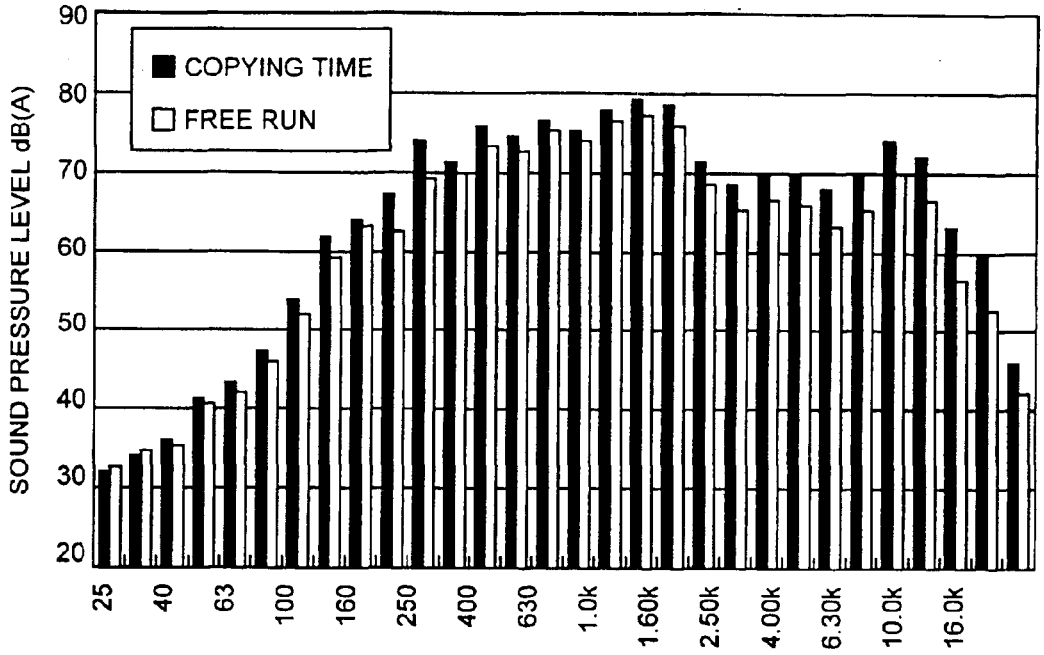
FIG. 20 is a graph of a comparison between sound pressure levels during a copying time and sound pressure levels during a free-run time.

FIG. 20 is a graph representing a result of one-third octave band analysis as frequency analysis of noise of the image formation apparatus. FIG. 20 is a comparison between a paper-passing copying mode and a free run mode (i.e., copying mode without passing paper).

Figure 21:
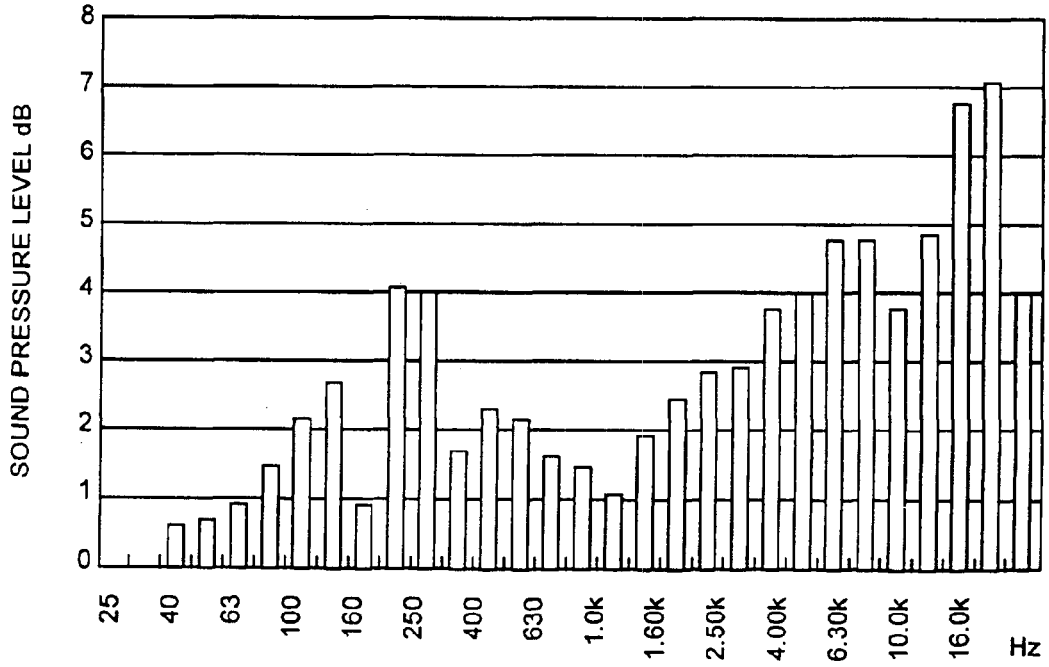
FIG. 21 is a graph representing a result of one-third octave band analysis as frequency analysis of noise of an image formation apparatus.

FIG. 21 is a graph of a comparison between sound pressure levels during a copying time and sound pressure levels during a free-run time. A main object of this graph is to check a frequency distribution. Therefore, while a relative comparison between sound pressure levels of each frequency has meaning, an absolute value of the sound pressure level has no meaning as the sound pressure levels are not corrected accurately. A difference between sound pressure levels for each frequency bandwidth in FIG. 21 occurs depending on whether the recording paper is passed. In other words, this frequency distribution of sound is attributable to the conveying of the recording paper.

In FIG. 21, a difference equal to or more than 3 decibels occurs in relatively low frequency bands around 200 to 250 hertz, and in relatively high frequency band equal to or more than 3.15 kilohertz. When there is a difference of 3 decibels or above, a double difference occurs in the acoustic energy.

As a result of the analysis, it is made clear that the sound in bands around the relatively low frequency of 200 to 250 hertz is impulse noise between the recording paper and the conveyer roller. Based on the sound quality evaluation experiment, it is known in advance that this sound has no relationship with discomfort. Therefore, no measure needs to be taken to improve the sound quality.

It is made clear that the sound in a band of 3.15 kilohertz or above is sliding noise of the recording paper. In other words, this noise occurs due to the vibration of the recording paper generated based on the sliding of the recording paper with the front edge of the flexible sheet 59. As is clear from FIG. 21, there is a remarkable difference of about 7 decibels in the frequency bands around 12.5 kilohertz to 16 kilohertz. Therefore, when the flexible sheet 59 has the configurations or shapes as shown in FIG. 16, FIG. 17, and FIG. 19, the sound sources of the sliding noise of the recording paper can be removed, and the frequency of 3.15 kilohertz or above can be lowered. This frequency band has a large contribution to sharpness. As the audible size also becomes small, this also contributes to loudness.

Figure 22:
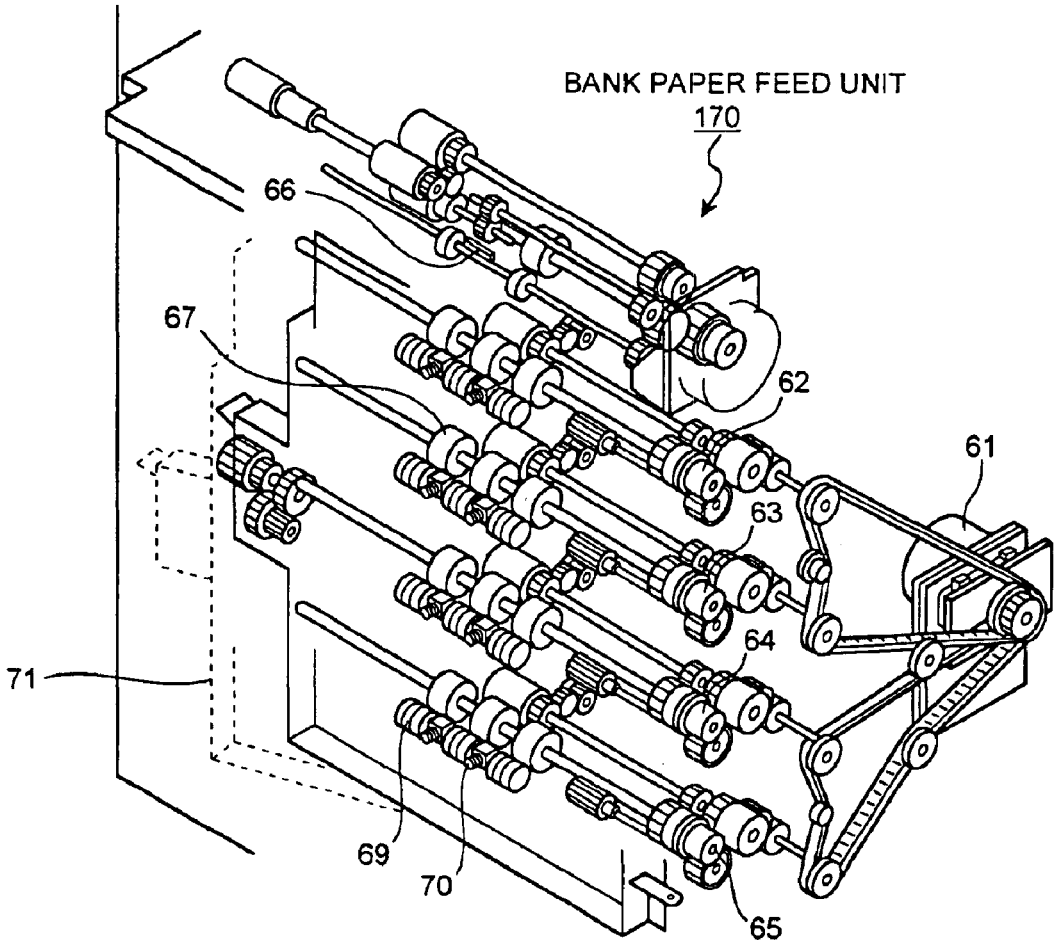
FIG. 22 is an explanatory view of a configuration of a paper feeding and driving system of a bank paper feed unit.

FIG. 22 is an explanatory view of a configuration of a paper feeding and driving system of the bank paper feed unit 170 shown in FIG. 4. As shown in FIG. 4, the image formation apparatus according to the present embodiment has four trays of paper supply. As an upper tray has a longer conveying route, the image formation of the first sheet of paper becomes faster. Therefore, the recording paper of A4 size sheets, which are most commonly used, are set to the first tray (i.e., the top tray), and the B4 and A3 size sheets of recording paper used at a lower frequency in general are set to the third and fourth (i.e., the lowest tray) trays.

In FIG. 22, a grip roller 67 is disposed in each of the four-tray paper feed units. The recording paper fed from each paper feed unit is directed upward via the grip roller 67. Driven rollers 69 are oppositely disposed on each grip roller 67, and are pressed by pressing springs 70. A bank motor 61 drives the grip rollers 67 and a paper separating mechanism not shown, and conveys the recording paper to the upper part 100.

Each shaft of the grip roller 67 is provided with an intermediate clutch 62, an intermediate clutch 63, an intermediate clutch 64, and an intermediate clutch 65. These intermediate clutches 62 to 65 consist of electromagnetic clutches, which rotate or stop rotating the grip rollers 67 by turning on and off the current to the bank motor 51 as the driving source for the gears of the electromagnetic clutches via the timing belt and the gear rows. This driving mechanism is provided to feed the recording paper while minimizing a distance between the sheets of paper during the image formation, thereby to improve the processing efficiency. An intermediate sensor 66 is used to take timing of writing an image and detect a paper jam.

It is known that a main factor of metal impulse noise from the image formation apparatus is the operation noise of the intermediate clutches of the bank paper feed unit 170. These four intermediate clutches operate each time when one sheet of recording paper is fed. In order to simplify the control, the bank paper feed unit 170 is configured to operate when any one of the trays feeds the paper. Therefore, even when the first tray of the bank paper feed unit 170 feeds the paper, the second to fourth grip rollers 67 that are not necessary for the driving also operate. When the fourth tray (i.e., the lowest tray) feeds the paper, the recording paper is not conveyed upward unless all the grip rollers 67 operate. Therefore, all the intermediate clutches 62 to 65 need to operate.

As explained above, the top tray or second tray of the bank paper feed unit 170 has the highest frequency of supplying the paper. The sheets of recording paper of sizes having a low using frequency are set in the third and fourth trays. Therefore, these trays have a low using frequency.

Large metal impulse noise is generated when the intermediate clutches 62 to 65 of the bank paper feed unit 170 operate simultaneously. Therefore, the generation of the energy of the metal impulse noise can be minimized to one fourth by operating only the intermediate clutch 62 when the first tray of the bank is used. By controlling only the top tray intermediate clutch of the bank to operate to feed the paper, noise and consumption of electric energy can be suppressed.

Figure 23:
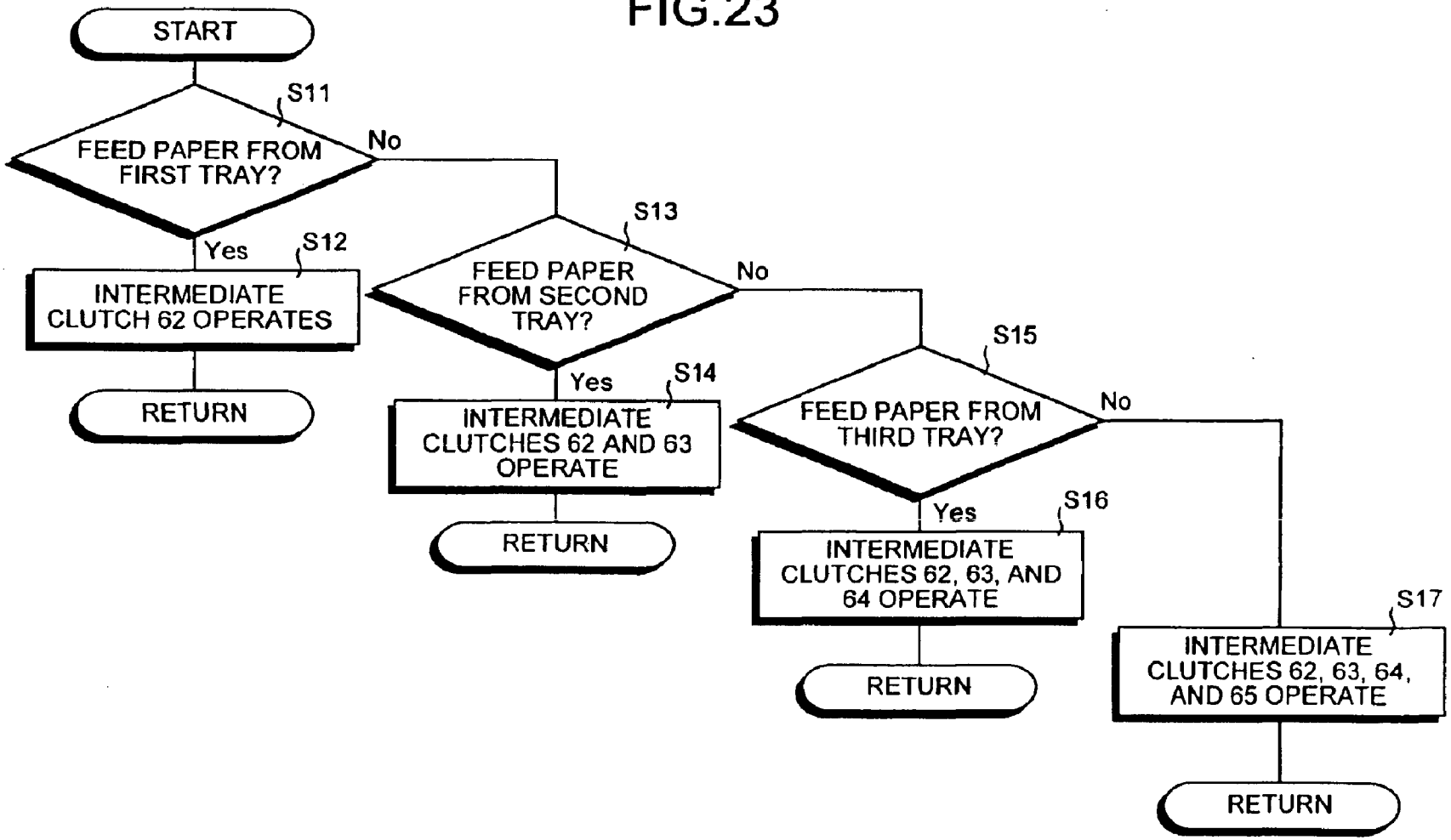
FIG. 23 is a flowchart of a control example of intermediate clutches of the bank paper feed unit.

FIG. 23 is a flowchart of a control example of the intermediate clutches of the bank paper feed unit 170. First, it is decided whether the paper is fed from the first tray (step S11). When the paper is fed from the first tray, the intermediate clutch 62 operates (step S12). When the paper is not fed from the first tray at step S11, it is decided whether the paper is fed from the second tray (step S13). When the paper is fed from the second tray, the intermediate clutches 62 and 63 operate (step S14). When the paper is not fed from the second tray at step S13, it is decided whether the paper is fed from the third tray (step S15). When the paper is fed from the third tray, the intermediate clutches 62 to 64 operate (step S16). When the paper is not fed from the third tray, that is, when the paper is fed from the fourth tray (the lowest tray) tray, the intermediate clutches 62 to 65 operate (step S17).

As explained above, by controlling only the necessary intermediate clutch to be turned on, thereby not operating the lower tray clutches of a low using frequency, it is possible to suppress the generation of metal impulse noise.

Figure 24:
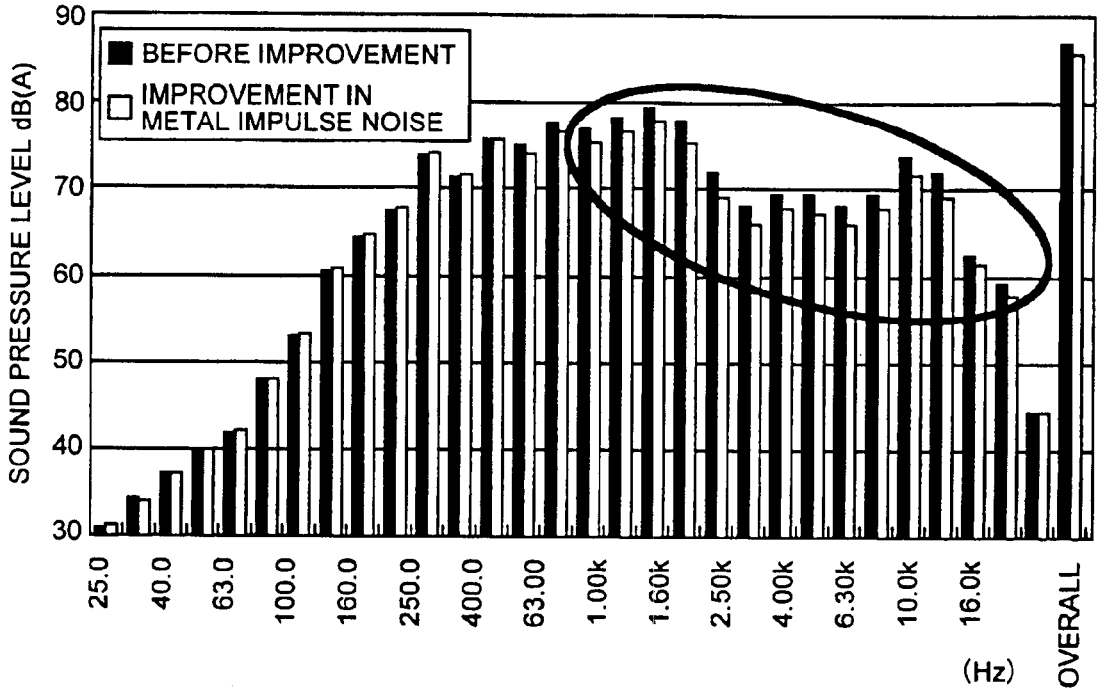
FIG. 24 is a graph of a change in metal impulse noise before and after improvement in control of intermediate clutches.

FIG. 24 is a graph of a change in metal impulse noise before and after improvement in control of intermediate clutches. In the graph, bars of "before improvement" show a change in the noise when the four intermediate clutches are operated at the same time. Bars of "improvement in metal impact noise" show a change in the noise when only the intermediate clutch 62 at the first tray is operated. The graph indicates that the clutch impact noise is that of wide frequency bands of about 1 kilohertz to 20 kilohertz, which contribute to not only impulsiveness but also sharpness and loudness. By suppressing the sound sources of the impulse noise, it is possible to reduce unpleasant noise.

The present invention is not limited to the above embodiment. It is also possible to implement the present invention by suitably modifying the invention within a range not deviating from the gist of the present invention. For example, the sound quality evaluation expressions and their conditions according to the present invention are not limited to the image formation apparatus shown in FIG. 1 and FIG. 4 according to the present embodiment. These sound quality evaluation expressions and conditions can also be applied to a wide range of general image formation apparatuses such as an electronic copying machine, a laser printer, and a laser facsimile apparatus.

In the image formation apparatus, the sound quality evaluation method, the method of manufacturing an image formation apparatus, and the method of remodeling an image formation apparatus according to a second embodiment, "derivation of expression for evaluating sound quality of image formation apparatus", and "measure for reducing unpleasant noise of image formation apparatus" will be explained in detail in this order. A configuration of the image formation apparatus according to the present embodiment is similar to that of the image formation apparatus according to the first embodiment. Therefore, the explanation of the configuration will be omitted.

An outline and a process of sound quality evaluation experiments, and a flow of a derivation of a sound quality evaluation expression will be explained next.

1. Experiment in Each Speed Region of the Image Formation Apparatus (1) Recording of operation noise from the image formation apparatus with a dummy head (2) Processing of the operation noise, and preparation of a plurality of processing noise (i.e., preparation of sample sound)

(3) Measurement of psycho-acoustics parameters of prepared sample sound (4) Experiment according to the paired comparison method using sample sounds.

2. Logistic Regression Analysis

In the present embodiment, experiments are carried out for the three types of image formation apparatuses of low speed, intermediate speed, and high speed, in a similar manner to that according to the first embodiment.

"(1) Recording of operation noise from the image formation apparatus with a dummy head", and "(2) Processing of the operation noise, and preparation of a plurality of processing noise (i.e., preparation of sample sound)" are carried out in a similar manner to that according to the first embodiment. Therefore, their explanation will be omitted.

(3) Measurement of Psycho-acoustics Parameters of Prepared Sample Sound

The sound analysis software ArtemiS manufactured by HEAD acoustics GmbH is used to obtain psycho-acoustics parameters for the original sound and processed sound from the image formation apparatus. In the software ArtemiS, various kinds of setting can be selected to obtain psycho-acoustics parameters. Default is employed in this case. A detailed method of calculating each psycho-acoustics parameter is as explained in the first embodiment.

For loudness, it is possible to select one of the following three calculation methods: "FFT/ISO532", "Filter/ISO532", and "FFT/HEAD". In this case, the default "FFT/ISO532" is employed, and default 4096 is employed for spectrum size. For sharpness, the default "FFT/ISO532" is employed as the calculation method. Default "Aures" is employed from among "Aures" and "von Bismarck" as a sharpness method. Default 4096 is employed for spectrum size. Other psycho-acoustics parameters have correlation with loudness, and are automatically changed based on the setting of loudness. Tables 1 to 4 summarize a calculation result of physical quantity. In Table 8 to Table 11, the original sound of a low-speed apparatus is 1, the original sound of an intermediate-speed apparatus is 1, and the original sound of a high-speed apparatus is 5.

TABLE 8

| SAMPLE SOUND | SOUND PRESSURE LEVEL dB(A) | LOUDNESS (sone) | SHARPNESS (acum) | TONALITY (tu) |
|---|---|---|---|---|
| LOW SPEED 20 PPM APPARATUS 1 | 52.8 | 7.5 | 2.3 | 0.12 |
| LOW SPEED 20 PPM APPARATUS 2 | 58.5 | 8.8 | 2.8 | 0.20 |
| LOW SPEED 20 PPM APPARATUS 3 | 49.6 | 6.6 | 2.2 | 0.08 |
| LOW SPEED 20 PPM APPARATUS 4 | 55.9 | 6.8 | 2.2 | 0.14 |
| LOW SPEED 20 PPM APPARATUS 5 | 54.2 | 8.6 | 1.4 | 0.22 |
| LOW SPEED 20 PPM APPARATUS 6 | 54.2 | 8.2 | 2.2 | 0.10 |
| LOW SPEED 20 PPM APPARATUS 7 | 51.8 | 6.8 | 2.4 | 0.11 |
| LOW SPEED 20 PPM APPARATUS 8 | 54.0 | 7.5 | 2.3 | 0.21 |
| LOW SPEED 20 PPM APPARATUS 9 | 53.6 | 7.0 | 2.4 | 0.07 |
| INTERMEDIATE SPEED 27 PPM APPARATUS 1 | 51.0 | 6.9 | 2.4 | 0.06 |
| INTERMEDIATE SPEED 27 PPM APPARATUS 2 | 56.3 | 9.0 | 2.9 | 0.06 |
| INTERMEDIATE SPEED 27 PPM APPARATUS 3 | 47.1 | 4.8 | 2.1 | 0.04 |
| INTERMEDIATE SPEED 27 PPM APPARATUS 4 | 54.6 | 7.9 | 3.1 | 0.04 |
| INTERMEDIATE SPEED 27 PPM APPARATUS 5 | 55.7 | 6.9 | 1.6 | 0.06 |
| INTERMEDIATE SPEED 27 PPM APPARATUS 6 | 57.7 | 7.6 | 2.3 | 0.07 |
| INTERMEDIATE SPEED 27 PPM APPARATUS 7 | 49.2 | 5.7 | 1.8 | 0.08 |
| INTERMEDIATE SPEED 27 PPM APPARATUS 8 | 52.1 | 8.3 | 2.8 | 0.04 |
| INTERMEDIATE SPEED 27 PPM APPARATUS 9 | 50.1 | 5.8 | 3.2 | 0.05 |
| HIGH SPEED 65 PPM APPARATUS 1 | 51.3 | 7.6 | 2.1 | 0.03 |
| HIGH SPEED 65 PPM APPARATUS 2 | 59.1 | 11.9 | 2.4 | 0.08 |
| HIGH SPEED 65 PPM APPARATUS 3 | 67.2 | 10.7 | 2.1 | 0.06 |
| HIGH SPEED 65 PPM APPARATUS 4 | 59.2 | 12.0 | 2.7 | 0.05 |
| HIGH SPEED 65 PPM APPARATUS 5 | 55.3 | 10.0 | 2.4 | 0.04 |
| HIGH SPEED 65 PPM APPARATUS 6 | 58.9 | 11.0 | 1.9 | 0.08 |
| HIGH SPEED 65 PPM APPARATUS 7 | 60.3 | 12.3 | 2.3 | 0.06 |
| HIGH SPEED 65 PPM APPARATUS 8 | 60.3 | 11.5 | 2.1 | 0.05 |
| HIGH SPEED 65 PPM APPARATUS 9 | 58.2 | 10.8 | 3.1 | 0.03 |
| PRELIMINARY EXPERIMENT 1 | 63.3 | 8.7 | 2.2 | 0.03 |
| PRELIMINARY EXPERIMENT 2 | 56.4 | 10.4 | 2.8 | 0.03 |
| PRELIMINARY EXPERIMENT 3 | 56.3 | 9.0 | 2.9 | 0.06 |
| PRELIMINARY EXPERIMENT 4 | 57.7 | 7.6 | 2.3 | 0.07 |
| PRELIMINARY EXPERIMENT 5 | 51.0 | 6.9 | 2.4 | 0.05 |
| PRELIMINARY EXPERIMENT 6 | 52.1 | 6.3 | 2.8 | 0.04 |
| PRELIMINARY EXPERIMENT 7 | 53.6 | 7.0 | 2.4 | 0.07 |
| PRELIMINARY EXPERIMENT 8 | 52.3 | 7.4 | 2.3 | 0.17 |

| | IMPULSIVENESS (iu) | ROUGHNESS (asper) | RELATIVE APPROACH | PPM | PPM Ave |
|---|---|---|---|---|---|

TABLE 8-continued

| | | | | | |
|---|---|---|---|---|---|
| LOW SPEED 20 PPM APPARATUS 1 | 0.61 | 1.90 | 1.76 | 20.0 | 20.0 |
| LOW SPEED 20 PPM APPARATUS 2 | 0.61 | 2.00 | 1.93 | 20.0 | 20.0 |
| LOW SPEED 20 PPM APPARATUS 3 | 0.37 | 1.40 | 1.53 | 20.0 | 20.0 |
| LOW SPEED 20 PPM APPARATUS 4 | 0.56 | 2.20 | 1.82 | 20.0 | 20.0 |
| LOW SPEED 20 PPM APPARATUS 5 | 0.29 | 1.40 | 1.89 | 20.0 | 20.0 |
| LOW SPEED 20 PPM APPARATUS 6 | 0.68 | 2.10 | 1.61 | 20.0 | 20.0 |
| LOW SPEED 20 PPM APPARATUS 7 | 0.43 | 1.60 | 1.64 | 20.0 | 20.0 |
| LOW SPEED 20 PPM APPARATUS 8 | 0.48 | 1.65 | 1.88 | 20.0 | 20.0 |
| LOW SPEED 20 PPM APPARATUS 9 | 0.76 | 2.15 | 1.54 | 20.0 | 20.0 |
| INTERMEDIATE SPEED 27 PPM APPARATUS 1 | 0.40 | 1.45 | 1.31 | 27.0 | 27.0 |
| INTERMEDIATE SPEED 27 PPM APPARATUS 2 | 0.40 | 1.65 | 1.41 | 27.0 | 27.0 |
| INTERMEDIATE SPEED 27 PPM APPARATUS 3 | 0.48 | 1.05 | 1.09 | 27.0 | 27.0 |
| INTERMEDIATE SPEED 27 PPM APPARATUS 4 | 0.45 | 1.55 | 1.28 | 27.0 | 27.0 |
| INTERMEDIATE SPEED 27 PPM APPARATUS 5 | 0.43 | 1.45 | 1.29 | 27.0 | 27.0 |
| INTERMEDIATE SPEED 27 PPM APPARATUS 6 | 0.42 | 1.55 | 1.40 | 27.0 | 27.0 |
| INTERMEDIATE SPEED 27 PPM APPARATUS 7 | 0.42 | 1.15 | 1.23 | 27.0 | 27.0 |
| INTERMEDIATE SPEED 27 PPM APPARATUS 8 | 0.48 | 1.35 | 1.13 | 27.0 | 27.0 |
| INTERMEDIATE SPEED 27 PPM APPARATUS 9 | 0.42 | 1.35 | 1.34 | 27.0 | 27.0 |
| HIGH SPEED 65 PPM APPARATUS 1 | 0.50 | 1.60 | 1.84 | 65.0 | 65.0 |
| HIGH SPEED 65 PPM APPARATUS 2 | 0.49 | 1.90 | 2.20 | 65.0 | 65.0 |
| HIGH SPEED 65 PPM APPARATUS 3 | 0.51 | 2.00 | 2.13 | 65.0 | 65.0 |
| HIGH SPEED 65 PPM APPARATUS 4 | 0.47 | 1.95 | 2.04 | 65.0 | 65.0 |
| HIGH SPEED 65 PPM APPARATUS 5 | 0.48 | 1.85 | 2.00 | 65.0 | 65.0 |
| HIGH SPEED 65 PPM APPARATUS 6 | 0.50 | 1.85 | 2.21 | 65.0 | 65.0 |
| HIGH SPEED 65 PPM APPARATUS 7 | 0.52 | 2.05 | 2.13 | 65.0 | 65.0 |
| HIGH SPEED 65 PPM APPARATUS 8 | 0.54 | 2.15 | 2.18 | 65.0 | 65.0 |
| HIGH SPEED 65 PPM APPARATUS 9 | 0.57 | 1.95 | 1.96 | 65.0 | 65.0 |
| PRELIMINARY EXPERIMENT 1 | 0.47 | 1.70 | 1.86 | 65.0 | 34.8 |
| PRELIMINARY EXPERIMENT 2 | 0.62 | 1.90 | 2.05 | 65.0 | 34.8 |
| PRELIMINARY EXPERIMENT 3 | 0.40 | 1.45 | 1.31 | 27.0 | 34.8 |
| PRELIMINARY EXPERIMENT 4 | 0.42 | 1.65 | 1.41 | 27.0 | 34.8 |
| PRELIMINARY EXPERIMENT 5 | 0.40 | 1.55 | 1.40 | 27.0 | 34.8 |
| PRELIMINARY EXPERIMENT 6 | 0.48 | 1.35 | 1.13 | 27.0 | 34.8 |
| PRELIMINARY EXPERIMENT 7 | 0.76 | 2.15 | 1.64 | 20.0 | 34.8 |
| PRELIMINARY EXPERIMENT 8 | 0.55 | 1.70 | 1.80 | 20.0 | 34.8 |

TABLE 9

| SAMPLE SOUND | SOUND PRESSURE LEVEL dB(A) | LOUDNESS (sone) | SHARPNESS (acum) | TONALITY (tu) |
|---|---|---|---|---|
| MIXED EXPERIMENT FOR THREE APPARATUSES 1 | 56.8 | 10.4 | 2.4 | 0.15 |
| MIXED EXPERIMENT FOR THREE APPARATUSES 2 | 57.4 | 10.4 | 1.9 | 0.11 |
| MIXED EXPERIMENT FOR THREE APPARATUSES 3 | 55.9 | 10.4 | 3.0 | 0.05 |
| MIXED EXPERIMENT FOR THREE APPARATUSES 4 | 58.1 | 8.8 | 1.9 | 0.15 |
| MIXED EXPERIMENT FOR THREE APPARATUSES 5 | 54.6 | 8.7 | 3.0 | 0.09 |
| MIXED EXPERIMENT FOR THREE APPARATUSES 6 | 54.3 | 8.7 | 2.5 | 0.05 |
| MIXED EXPERIMENT FOR THREE APPARATUSES 7 | 51.9 | 7.0 | 2.9 | 0.16 |
| MIXED EXPERIMENT FOR THREE APPARATUSES 8 | 51.6 | 7.0 | 2.3 | 0.10 |
| MIXED EXPERIMENT FOR THREE APPARATUSES 9 | 52.8 | 7.0 | 1.9 | 0.06 |

| | IMPULSIVENESS (iu) | ROUGHNESS (asper) | RELATIVE APPROACH | PPM | PPM Ave |
|---|---|---|---|---|---|
| MIXED EXPERIMENT FOR THREE APPARATUSES 1 | 0.43 | 1.72 | 1.96 | 65.0 | 37.3 |
| MIXED EXPERIMENT FOR THREE APPARATUSES 2 | 0.46 | 1.83 | 1.97 | 65.0 | 37.3 |
| MIXED EXPERIMENT FOR THREE APPARATUSES 3 | 0.47 | 1.82 | 1.99 | 65.0 | 37.3 |
| MIXED EXPERIMENT FOR THREE APPARATUSES 4 | 0.41 | 1.39 | 1.60 | 27.0 | 37.3 |
| MIXED EXPERIMENT FOR THREE APPARATUSES 5 | 0.39 | 1.51 | 1.61 | 27.0 | 37.3 |
| MIXED EXPERIMENT FOR THREE APPARATUSES 6 | 0.40 | 1.68 | 1.66 | 27.0 | 37.3 |
| MIXED EXPERIMENT FOR THREE APPARATUSES 7 | 0.57 | 1.69 | 1.68 | 20.0 | 37.3 |
| MIXED EXPERIMENT FOR THREE APPARATUSES 8 | 0.64 | 1.83 | 1.74 | 20.0 | 37.3 |
| MIXED EXPERIMENT FOR THREE APPARATUSES 9 | 0.71 | 1.83 | 1.75 | 20.0 | 37.3 |

TABLE 10

| SAMPLE SOUND | SOUND PRESSURE LEVEL dB(A) | LOUDNESS (sone) | SHARPNESS (acum) | TONALITY (tu) |
|---|---|---|---|---|
| LOW-SPEED APPARATUS VERIFICATION EXPERIMENT 1 | 49.6 | 6.6 | 2.2 | 0.08 |
| LOW-SPEED APPARATUS VERIFICATION EXPERIMENT 2 | 51.8 | 6.8 | 2.4 | 0.11 |

TABLE 10-continued

| | | | | |
|---|---|---|---|---|
| LOW-SPEED APPARATUS VERIFICATION EXPERIMENT 3 | 51.1 | 6.1 | 2.5 | 0.05 |
| LOW-SPEED APPARATUS VERIFICATION EXPERIMENT 4 | 52.8 | 7.5 | 2.3 | 0.12 |
| LOW-SPEED APPARATUS VERIFICATION EXPERIMENT 5 | 54.0 | 7.5 | 2.3 | 0.21 |
| LOW-SPEED APPARATUS VERIFICATION EXPERIMENT 6 | 51.0 | 6.7 | 2.3 | 0.20 |
| LOW-SPEED APPARATUS VERIFICATION EXPERIMENT 7 | 49.6 | 6.6 | 2.2 | 0.08 |
| LOW-SPEED APPARATUS VERIFICATION EXPERIMENT 8 | 53.6 | 7.0 | 2.4 | 0.07 |
| LOW-SPEED APPARATUS VERIFICATION EXPERIMENT 9 | 49.7 | 6.7 | 2.3 | 0.11 |
| HIGH-SPEED APPARATUS VERIFICATION EXPERIMENT 1 | 51.3 | 7.6 | 2.1 | 0.03 |
| HIGH-SPEED APPARATUS VERIFICATION EXPERIMENT 2 | 53.3 | 9.0 | 2.2 | 0.03 |
| HIGH-SPEED APPARATUS VERIFICATION EXPERIMENT 3 | 54.4 | 8.9 | 2.3 | 0.09 |
| HIGH-SPEED APPARATUS VERIFICATION EXPERIMENT 4 | 54.7 | 9.0 | 2.3 | 0.07 |
| HIGH-SPEED APPARATUS VERIFICATION EXPERIMENT 5 | 55.3 | 10.4 | 2.4 | 0.04 |
| HIGH-SPEED APPARATUS VERIFICATION EXPERIMENT 6 | 51.3 | 7.9 | 2.1 | 0.03 |
| HIGH-SPEED APPARATUS VERIFICATION EXPERIMENT 7 | 55.6 | 9.7 | 2.5 | 0.08 |
| HIGH-SPEED APPARATUS VERIFICATION EXPERIMENT 8 | 56.5 | 10.4 | 2.2 | 0.05 |
| HIGH-SPEED APPARATUS VERIFICATION EXPERIMENT 9 | 57.3 | 11.3 | 2.1 | 0.05 |
| HIGH-SPEED APPARATUS VERIFICATION EXPERIMENT 10 | 57.3 | 11.3 | 2.1 | 0.05 |
| HIGH-SPEED APPARATUS VERIFICATION EXPERIMENT 11 | 56.4 | 11.3 | 2.8 | 0.03 |
| HIGH-SPEED APPARATUS VERIFICATION EXPERIMENT 12 | 60.2 | 12.5 | 2.2 | 0.05 |

| | IMPULSIVENESS (iu) | ROUGHNESS (asper) | RELATIVE APPROACH | PPM | PPM Ave |
|---|---|---|---|---|---|
| LOW-SPEED APPARATUS VERIFICATION EXPERIMENT 1 | 0.37 | 1.40 | 1.53 | 20.0 | 19.1 |
| LOW-SPEED APPARATUS VERIFICATION EXPERIMENT 2 | 0.43 | 1.60 | 1.64 | 20.0 | 19.1 |
| LOW-SPEED APPARATUS VERIFICATION EXPERIMENT 3 | 0.75 | 1.89 | 1.84 | 16.0 | 19.1 |
| LOW-SPEED APPARATUS VERIFICATION EXPERIMENT 4 | 0.61 | 1.90 | 1.76 | 20.0 | 19.1 |
| LOW-SPEED APPARATUS VERIFICATION EXPERIMENT 5 | 0.48 | 1.65 | 1.88 | 20.0 | 19.1 |
| LOW-SPEED APPARATUS VERIFICATION EXPERIMENT 6 | 0.59 | 1.69 | 1.70 | 16.0 | 19.1 |
| LOW-SPEED APPARATUS VERIFICATION EXPERIMENT 7 | 0.37 | 1.40 | 1.53 | 20.0 | 19.1 |
| LOW-SPEED APPARATUS VERIFICATION EXPERIMENT 8 | 0.76 | 2.15 | 1.64 | 20.0 | 19.1 |
| LOW-SPEED APPARATUS VERIFICATION EXPERIMENT 9 | 0.60 | 1.60 | 1.63 | 20.0 | 19.1 |
| HIGH-SPEED APPARATUS VERIFICATION EXPERIMENT 1 | 0.50 | 1.60 | 1.64 | 65.0 | 60.4 |
| HIGH-SPEED APPARATUS VERIFICATION EXPERIMENT 2 | 0.52 | 0.74 | 1.86 | 65.0 | 60.4 |
| HIGH-SPEED APPARATUS VERIFICATION EXPERIMENT 3 | 0.58 | 1.82 | 1.91 | 45.0 | 60.4 |
| HIGH-SPEED APPARATUS VERIFICATION EXPERIMENT 4 | 0.57 | 1.80 | 1.91 | 55.0 | 60.4 |
| HIGH-SPEED APPARATUS VERIFICATION EXPERIMENT 5 | 0.53 | 0.98 | 2.00 | 65.0 | 60.4 |
| HIGH-SPEED APPARATUS VERIFICATION EXPERIMENT 6 | 0.55 | 0.52 | 1.64 | 65.0 | 60.4 |
| HIGH-SPEED APPARATUS VERIFICATION EXPERIMENT 7 | 0.48 | 1.82 | 1.79 | 45.0 | 60.4 |
| HIGH-SPEED APPARATUS VERIFICATION EXPERIMENT 8 | 0.44 | 1.82 | 1.80 | 60.0 | 60.4 |
| HIGH-SPEED APPARATUS VERIFICATION EXPERIMENT 9 | 0.55 | 1.18 | 2.13 | 65.0 | 60.4 |
| HIGH-SPEED APPARATUS VERIFICATION EXPERIMENT 10 | 0.55 | 1.18 | 2.13 | 65.0 | 60.4 |
| HIGH-SPEED APPARATUS VERIFICATION EXPERIMENT 11 | 0.57 | 1.08 | 2.05 | 65.0 | 60.4 |
| HIGH-SPEED APPARATUS VERIFICATION EXPERIMENT 12 | 0.62 | 1.49 | 2.18 | 65.0 | 60.4 |

TABLE 11

| SAMPLE SOUND | SOUND PRESSURE LEVEL dB(A) | LOUDNESS (sone) | SHARPNESS (acum) | TONALITY (tu) |
|---|---|---|---|---|
| TOTAL AVERAGE VALUE | 54.3 | 8.5 | 2.3 | 0.08 |
| AVERAGE OF LOW-SPEED APPARATUS | 53.6 | 7.7 | 2.2 | 0.14 |
| AVERAGE OF INTERMEDIATE-SPEED APPARATUS | 52.6 | 6.9 | 2.5 | 0.05 |
| AVERAGE OF HIGH-SPEED APPARATUS | 57.7 | 10.8 | 2.3 | 0.05 |
| AVERAGE OF PRELIMINARY EXPERIMENT | 54.1 | 7.9 | 2.5 | 0.07 |
| AVERAGE OF MIXED EXPERIMENT | 54.8 | 8.7 | 2.4 | 0.10 |
| AVERAGE OF LOW-SPEED APPARATUS VERIFICATION | 51.5 | 6.8 | 2.3 | 0.11 |
| AVERAGE OF HIGH-SPEED APPARATUS VERIFICATION | 55.3 | 9.9 | 2.3 | 0.05 |

| | IMPULSIVENESS (iu) | ROUGHNESS (asper) | RELATIVE APPROACH | PPM | PPM Ave |
|---|---|---|---|---|---|
| TOTAL AVERAGE VALUE | 0.51 | 1.64 | 1.74 | 38.8 | 38.8 |
| AVERAGE OF LOW-SPEED APPARATUS | 0.54 | 1.82 | 1.74 | 20.0 | 20.0 |
| AVERAGE OF INTERMEDIATE-SPEED APPARATUS | 0.43 | 1.39 | 1.28 | 27.0 | 27.0 |
| AVERAGE OF HIGH-SPEED APPARATUS | 0.51 | 1.92 | 2.08 | 65.0 | 65.0 |
| AVERAGE OF PRELIMINARY EXPERIMENT | 0.50 | 1.68 | 1.58 | 34.8 | 34.8 |
| AVERAGE OF MIXED EXPERIMENT | 0.50 | 1.70 | 1.77 | 37.3 | 37.3 |
| AVERAGE OF LOW-SPEED APPARATUS VERIFICATION | 0.55 | 1.70 | 1.68 | 19.1 | 19.1 |
| AVERAGE OF HIGH-SPEED APPARATUS VERIFICATION | 0.54 | 1.34 | 1.95 | 60.4 | 60.4 |

(4) Experiment According to the Paired Comparison Method Using Sample Sounds→Calculation of Discomfort Probabilities for Each Sample Pair Evaluating persons who evaluate sample sounds are collected. The evaluating persons carry out a paired comparison of sample sounds, and decide which one of sounds is unpleasant. Experiments are carried out for 400 kinds of data. These data include data for three types of apparatuses for each speed layer, i.e., 72×3=216 kinds of data, and 184 kinds of data for preliminary experiments and mixed experiments of sound for each speed layer.

2. Logistic Regression Analysis

The paired comparative experiment is carried out, the psycho-acoustics characteristics are measured, and the data are obtained. Then, the data (each sample sound) in Table 8 to Table 11 are arranged in the form of Table 12 to make it possible to carry out the logistic regression analysis. Table 12 is an example of an extraction of the paired comparative experiments of three kinds of sample sound from results of experiments of sample sounds of low-speed layers. Actually, tables are prepared for the paired comparisons for the 400 kinds of data.

sents ppm. The ppm represents a number of sheets of paper to form an image per minute by feeding the A4 size paper in a horizontal direction. An average ppm value is omitted.

In Table 12, "-" has the following meaning. When A1 and A2 are used for the paired comparison, for example, the evaluating persons do not evaluate A3. As there is no influence of A3, "-" is used in the corresponding rows. The next block indicates a difference between psycho-acoustics parameters of sounds that are compared in a pair. Specifically, the evaluating persons compare the sample sound presented first with the sample sound presented later, and determine which one of the sounds is unpleasant. Therefore, it is natural to obtain a difference as J–I. However, as a positive or negative difference between psycho-acoustics characteristics finally obtained has no meaning, I–J is used in Table 1. The last three columns

TABLE 12

| PRESENTATION ORDER | | A1 | | | | | | | | A2 | | | | | | | |
|---|---|---|---|---|---|---|---|---|---|---|---|---|---|---|---|---|---|
| I | J | x1 | x2 | x3 | x4 | x5 | x6 | x7 | x8 | x1 | x2 | x3 | x4 | x5 | x6 | x7 | x8 |
| A1 | A2 | 52.8 | 7.5 | 2.3 | 0.12 | 0.61 | 1.90 | 1.76 | 20 | 56.5 | 8.8 | 2.3 | 0.20 | 0.61 | 2.00 | 1.93 | 20 |
| A2 | A1 | 52.8 | 7.5 | 2.3 | 0.12 | 0.61 | 1.90 | 1.76 | 20 | 56.5 | 8.8 | 2.3 | 0.20 | 0.61 | 2.00 | 1.93 | 20 |
| A1 | A3 | 52.8 | 7.5 | 2.3 | 0.12 | 0.61 | 1.90 | 1.76 | 20 | | | | | — | | | |
| A3 | A1 | 52.8 | 7.5 | 2.3 | 0.12 | 0.61 | 1.90 | 1.76 | 20 | | | | | — | | | |
| A2 | A3 | | | | | — | | | | 56.5 | 8.8 | 2.3 | 0.20 | 0.61 | 2.00 | 1.93 | 20 |
| A3 | A2 | | | | | — | | | | 56.5 | 8.8 | 2.3 | 0.20 | 0.61 | 2.00 | 1.93 | 20 |

| PRESENTATION ORDER | | A3 | | | | | | | | I–J (DIFFERENCE BETWEEN I AND J) | | | | | | | |
|---|---|---|---|---|---|---|---|---|---|---|---|---|---|---|---|---|---|
| I | J | x1 | x2 | x3 | x4 | x5 | x6 | x7 | x8 | x1 | x2 | x3 | x4 | x5 | x6 | x7 | x8 |
| A1 | A2 | | | | | — | | | | −3.7 | −1.3 | 0 | −0.08 | 0 | −0.10 | −0.17 | 0 |
| A2 | A1 | | | | | — | | | | 3.7 | 1.3 | 0 | 0.08 | 0 | 0.10 | 0.17 | 0 |
| A1 | A3 | 49.6 | 6.6 | 2.2 | 0.08 | 0.37 | 1.40 | 1.53 | 20 | 3.2 | 1.0 | 0.05 | 0.04 | 0.24 | 0.50 | 0.22 | 0 |
| A3 | A1 | 49.6 | 6.6 | 2.2 | 0.08 | 0.37 | 1.40 | 1.53 | 20 | −3.2 | −1.0 | −0.05 | −0.04 | −0.24 | −0.50 | −0.22 | 0 |
| A2 | A3 | 49.6 | 6.6 | 2.2 | 0.08 | 0.37 | 1.40 | 1.53 | 20 | −6.9 | 2.2 | 0.05 | 0.12 | 0.23 | 0.60 | 0.39 | 0 |
| A3 | A2 | 49.6 | 6.6 | 2.2 | 0.08 | 0.37 | 1.40 | 1.53 | 20 | 6.9 | −2.2 | −0.05 | 0.12 | −0.23 | −0.60 | −0.39 | 0 |

| PRESENTATION ORDER | | FREQUENCY THAT | FREQUENCY THAT | TOTAL NUMBER OF OF EVALUATING |
|---|---|---|---|---|
| I | J | I IS UNPLEASANT | J IS UNPLEASANT | PERSONS |
| A1 | A2 | 0 | 31 | 31 |
| A2 | A1 | 31 | 0 | 31 |
| A1 | A3 | 27 | 4 | 31 |
| A3 | A1 | 1 | 30 | 31 |
| A2 | A3 | 30 | 1 | 31 |
| A3 | A2 | 0 | 31 | 31 |

The first column in Table 12 indicates which sample sound the evaluating persons first listen to. The sample sound that is first listened to is indicated by the symbol I, and the sample sound that is listened to afterward is indicated by the symbol J. In the next block columns from A1 to A3, psycho-acoustics characteristic values of sample sounds are listed. For simplicity, the characteristic values are expressed using x1 to x8. X1 represents sound pressure level, x2 represents loudness, x3 represents sharpness, x4 represents tonality, x5 represents impulsiveness, x6 represents roughness, x7 represents relative approach, and x8 repreindicate a frequency of persons who evaluate I is more unpleasant than J, a frequency of persons who evaluate J is more unpleasant than I, and a total number of the evaluating persons, respectively. From Table 12, when the sound of A1 (presented first) is compared with the sound of A3 (present later), physical differences are as follows.

Difference of sound pressure: 3.2 (decibels)

Difference of loudness: 1.01 (sone)

Difference of sharpness: 0.05 (acum)

Difference of tonality: 0.04 (tu)

Difference of impulsiveness: 0.24 (iu)

Difference of roughness: 0.5 (asper)

Difference of relative approach: 0.22

Difference of ppm: 0

A discomfort probability is obtained by dividing 27 persons who respond that A1 is unpleasant and 4 persons who respond that A3 is unpleasant, by the total number of evaluating persons 31. Table 12 summarizes 400 ways of relationship between a difference of physical quantities when two kinds of sound are compared with each other, and discomfort probability of the two kinds of sound.

According to the sound quality evaluation models explained in the first embodiment, like in the first embodiment, when there are a plurality of psycho-acoustics characteristics that influence the effect $\alpha i$ in the expression (9), it is clear that the model of the expression (2) having a plurality of parameters added, not only loudness, is sufficient.

cal quantities to predict discomfort. Roughness and relative approach are not selected as significant physical quantity. While order effect is also significant, this is excluded from the model as this effect is smaller than the acoustic physical effect. When the printing speed in Table 1 to Table 4 and a ppm average value for each experiment are added to terms, a contribution rate improves. Therefore, these values are also added to the model expression. While the ppm average value for each experiment is a parameter that is important to position between experiments, these values are offset within the same experiment and, are therefore, unnecessary. The ppm term is also offset within the same experiment, and is unnecessary. However, these values are necessary to carry out the analysis by combining a plurality of experiments for different speed regions.

Table 13 and Table 14 summarize the results of the analysis. A 95 percent confidence level between the lower limit and the upper limit represents estimates of regression coefficients of each term.

TABLE 13

| MODEL | (−1)* LOGARITHMIC LIKELIHOOD | DEGREE OF FREEDOM | CHI-SQUARE | p VALUE (Prob > ChiSq) |
|---|---|---|---|---|
| DIFFERENCE | 1897.2088 | 6 | 3794.418 | 0.0000 |
| COMPLETE | 6926.8451 | | | |
| COMPACT | 8824.0539 | | | |

TABLE 14

| TERM | ESTIMATE VALUE | STANDARD ERROR | CHI-SQUARE | p VALUE (Prob > ChiSq) | LOWER SIDE 95% | HIGHER SIDE 95% |
|---|---|---|---|---|---|---|
| SOUND PRESSURE LEVEL | 0.12808364 | 0.0115342 | 123.31 | <.0001 | 0.10547717 | 0.15069022 |
| LOUDNESS | 0.47043907 | 0.0324293 | 210.44 | <.0001 | 0.40687921 | 0.53399976 |
| SHARPNESS | 1.07885872 | 0.0446293 | 584.37 | <.0001 | 0.99138725 | 1.166331 |
| TONALITY | 9.27879937 | 0.4557852 | 414.44 | <.0001 | 8.38547981 | 10.1721249 |
| IMPULSIVENESS | 2.89529674 | 0.164067 | 311.42 | <.0001 | 2.57373312 | 3.21686388 |
| PPM | −0.0114246 | 0.0019653 | 33.11 | <.0001 | −0.0153158 | −0.0075334 |
| PPM AVERAGE VALUE | −0.0040762 | 0.0004857 | 70.42 | <.0001 | −0.0050282 | −0.0031242 |

The sound quality evaluation expression is derived. The data shown in Table 5 are analyzed using the above model. The psycho-acoustics parameters of the sample sounds are as shown in Table 1 to Table 4, which include the whole regions of the low-speed layer, the intermediate-speed layer, the high-speed layer, the preparatory experiment, the mixed experiment, and the verification experiment. For a result of the comparison that the whole evaluating persons decide that the same one kind of sound is unpleasant in the paired comparative experiment (for example, in the comparison between A1 and A2 in Table 12), it is decided that the measurement is impossible because of scaling over of human sense. This comparison result is excluded from the analysis. Out of the 400 comparisons, results of 31 comparisons are excluded. Therefore, 369 comparative data are used to carry out the analysis. In the analysis, order sequence and interaction between psycho-acoustics parameters are also investigated.

Statistical analysis software JMP manufactured by SAS Institute Inc. is used to carry out the above analysis. As a result of the analysis, sound pressure, loudness, sharpness, tonality, and impulsiveness are optimum as acoustic physi- Table 14 represents the model expression (18) for predicting discomfort probability by using the estimates shown in Table 14.

$$P = \frac{1}{1 + \exp(-z)} \tag{18}$$

where $$\begin{aligned} z = {} & 0.12808364 \times (\text{sound pressure level } i + \\ & \text{sound pressure level } j) + \\ & 0.47043907 \times (\text{loudness } i - \text{loudness } j) + \\ & 1.0785872 \times (\text{sharpness } i - \text{sharpness } j) + \\ & 9.27879937 \times (\text{tonality } i - \text{tonality } j) + \\ & 2.89529674 \times (\text{impulsiveness } i - \text{impulsiveness } j) - \\ & 0.0114246 \times (\text{ppm } i - \text{ppm } j) - \\ & 0.0040762 \times (\text{ppm average velue } i - \text{ppm average velue } j) \end{aligned}$$

Table 13 represents evaluations of this model. As the p value is 0, this is a highly significant model. Table 14 indicates that the p values of physical quantities that predict discomfort levels are all 0.0001 or below. Each physical quantity is highly significant for discomfort.

Figure 29:
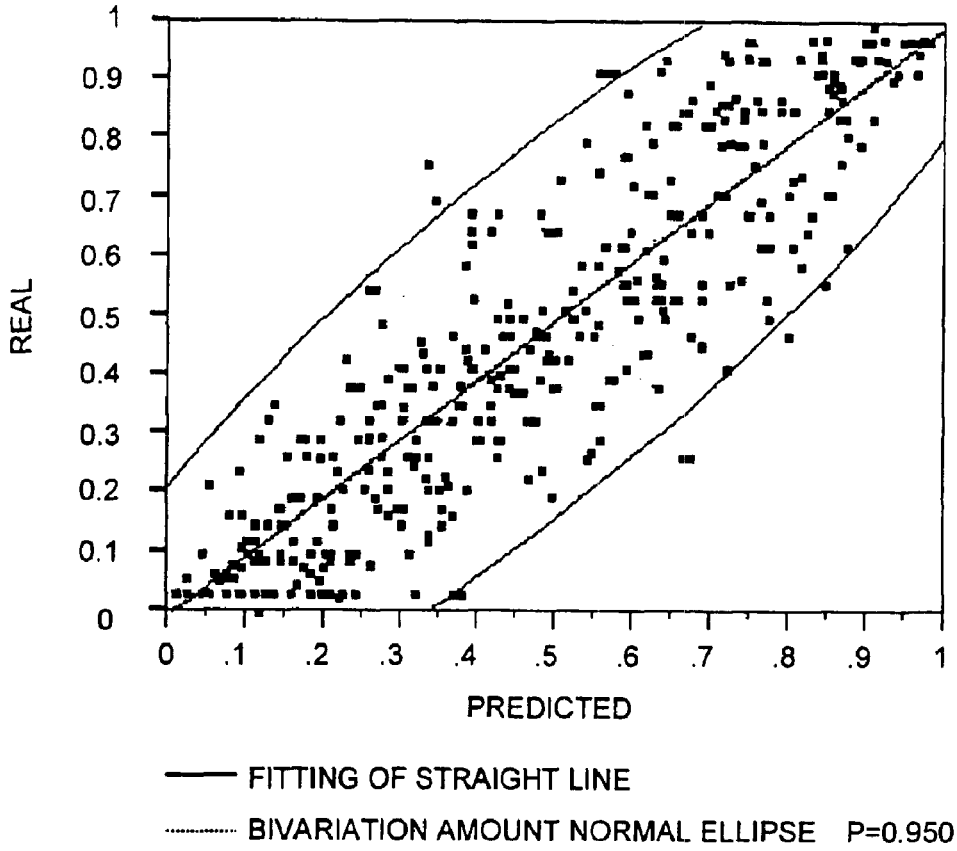
FIG. 29 is a scatter diagram of real and predicted probabilities according to the second embodiment of the present invention.

FIG. 29 is a scatter diagram of real probabilities that I becomes discomfort and predicted probabilities according to the expression (18). Both the real probabilities and the predicted probabilities are within a range from 0 to 1. Therefore, irrational portions as observed in the scatter diagram of the linear model according to the expression shown in FIG. 5 are not present. The contribution rate of the scatter diagram in FIG. 29 is 0.78, which is an improvement from the contribution rate 0.72 of the scatter diagram shown in FIG. 5. An ellipse shown in FIG. 29 is a probability ellipse of 95 percent. Although six points are slightly deviated from this probability ellipse of 95 percent, these points can be regarded to have no problem.

The expression (18) is the model that predicts probabilities of dominance as a result of the paired comparison. In order to predict discomfort of single noise, the expression is transformed. A total average value of sound pressure level, loudness, sharpness, tonality, impulsiveness, ppm, and ppm average value is input to the expression (18). An intercept is obtained by setting discomfort probability in this case as P=0.5. When sound of an average value is extracted from the population, and when the sound of the average value is compared in pair with all the rest of the sounds in the population, the probability that the sound of the average value is sensed as discomfort is defined as 0.5. The intercept of the expression is obtained in this way.

The total average value is input to the expression (18). In other words, 0.5=1/{1+exp(−[0.12808364×(sound pressure level i−54.3)+0.47043907×(loudness value i−8.5)+1.07885872×(sharpness value i−2.3)+9.27879937×(tonality value i−0.08)+2.89529674×(impulsiveness value i−0.51)−0.0114246×(ppm i−38.8)−0.0040762×(ppm average value i−38.8)]

When z is set as the contents of [ ], $$0.5=1/1+\exp(-z)$$

$$0.5\times\{1+\exp(-z)\}=1$$

$$0.5\times\exp(-z)=0.5$$

$$\exp(-z)=1.$$

When natural log of both sides is taken, $$\ln\{\exp(-z)\}=\ln 1=0$$

−z=0 z=0.

In other words, $$z=0=[0.12808364\times(\text{sound pressure level } i-54.3)$$
$$+0.47043907\times(\text{loudness value } i-8.5)$$
$$+1.07885872\times(\text{sharpness value } i-2.3)+9.27879937$$
$$\times(\text{tonality value } i-0.08)+2.89529674$$
$$\times(\text{impulsiveness value } i-0.51)-0.0114246$$
$$\times(\text{ppm } i-38.8)-0.0040762\times(\text{ppm average value } i-38.8)]$$

$$z=0.12808364\times\text{sound pressure level } i+$$
$$0.47043907\times\text{loudness value } i+$$
$$1.07885872\times\text{sharpness value } i+$$
$$9.27879937\times\text{tonality value } i+$$
$$2.89529674\times\text{impulsiveness value } i-$$
$$0.0114246\times\text{ppm } i-0.0040762\times$$
$$\text{ppm average velue } i-15.09832827.$$

Consequently, it is possible to transform the probability that single sample noise is felt unpleasant into the expression (19).

$$P=\frac{1}{1+\exp(-z)} \tag{19}$$

where $$z=0.12808364\times\text{sound pressure level } i+$$
$$0.47043907\times\text{loudness } i+1.07885872\times\text{sharpness } i+$$
$$9.27879937\times\text{tonality } i+2.89529674\times\text{impulsiveness } i-$$
$$0.0114246\times\text{ppm } i-0.0040762\times\text{ppm average velue } i-$$
$$15.09832827$$

While the average value term of ppm for each experiment is a parameter that is necessary to derive an expression, it is felt difficult to decide about what data is to be input to actually evaluate sound. In this case, a ppm value of the sound to be evaluated is input as an average value of the ppm. Within the same experiment, the ppm value and the ppm average value are the same. Therefore, the ppm term and the ppm average value term in the expression (19) are given as shown in the expression (20).

$$P=\frac{1}{1+\exp(-z)} \tag{20}$$

where $$z=0.12808364\times\text{sound pressure level } i+$$
$$0.47043907\times\text{loudness } i+1.07885872\times\text{sharpness } i+$$
$$9.27879937\times\text{tonality } i+2.89529674\times\text{impulsiveness } i-$$
$$0.0155008\times\text{ppm } i-15.09832827$$

While the average data value is used as the reference value, the reference value can be changed according to a change in the environment. From the expression (18), it is possible to estimate a change in the probabilities of dominance due to a deviation from the average value. A probability when the average value is input is calculated as 0.5. When this probability becomes large, a discomfort level increases. Based on this, a condition for the discomfort probability Pi to become at or below a certain probability can be obtained.

A scatter diagram of a discomfort model for a single sample sound is prepared based on the expression (20). A-predicted probability is compared with an actual measurement value for each speed layer or for each experiment. Table 15 to Table 19 summarize real probabilities and predicted probabilities of discomfort for each experiment.

The actual measurement value is obtained by dividing a sum of discomfort levels of sample sounds by a total number of evaluations, without discriminating between sounds for the paired comparative experiment.

TABLE 15

| | SOUND PRESSURE LEVEL | LOUDNESS | SHARPNESS | TONALITY | IMPULSIVENESS |
|---|---|---|---|---|---|
| LOW-SPEED APPARATUS 1 | 52.8 | 7.5 | 2.3 | 0.12 | 0.61 |
| LOW-SPEED APPARATUS 2 | 56.5 | 8.8 | 2.3 | 0.20 | 0.61 |
| LOW-SPEED APPARATUS 3 | 49.6 | 6.6 | 2.2 | 0.08 | 0.37 |
| LOW-SPEED APPARATUS 4 | 55.9 | 8.8 | 2.2 | 0.14 | 0.66 |
| LOW-SPEED APPARATUS 5 | 54.2 | 8.6 | 1.4 | 0.22 | 0.29 |
| LOW-SPEED APPARATUS 6 | 54.2 | 8.2 | 2.2 | 0.10 | 0.68 |
| LOW-SPEED APPARATUS 7 | 51.8 | 6.8 | 2.4 | 0.11 | 0.43 |
| LOW-SPEED APPARATUS 8 | 54.0 | 7.5 | 2.3 | 0.21 | 0.48 |
| LOW-SPEED APPARATUS 9 | 53.6 | 7.0 | 2.4 | 0.07 | 0.76 |
| AVERAGE VALUE FOR LOW-SPEED APPARATUS | 53.6 | 7.7 | 2.2 | 0.14 | 0.54 |

| | PPM | LOGIT | PREDICTED PROBABILITY | REAL PROBABILITY | REACTION | TOTAL FREQUENCY |
|---|---|---|---|---|---|---|
| LOW-SPEED APPARATUS 1 | 20.0 | −0.10419 | 0.47398 | 0.44556 | 221 | 496 |
| LOW-SPEED APPARATUS 2 | 20.0 | 1.70756 | 0.84652 | 0.89113 | 442 | 496 |
| LOW-SPEED APPARATUS 3 | 20.0 | −2.07193 | 0.11185 | 0.05242 | 26 | 496 |
| LOW-SPEED APPARATUS 4 | 20.0 | 1.13493 | 0.75675 | 0.81653 | 405 | 496 |
| LOW-SPEED APPARATUS 5 | 20.0 | −0.35681 | 0.41173 | 0.66532 | 330 | 496 |
| LOW-SPEED APPARATUS 6 | 20.0 | 0.30503 | 0.57567 | 0.49798 | 247 | 496 |
| LOW-SPEED APPARATUS 7 | 20.0 | −1.02488 | 0.26408 | 0.29839 | 148 | 496 |
| LOW-SPEED APPARATUS 8 | 20.0 | 0.55239 | 0.63469 | 0.53427 | 265 | 496 |
| LOW-SPEED APPARATUS 9 | 20.0 | −0.14210 | 0.46454 | 0.29839 | 148 | 496 |
| AVERAGE VALUE FOR LOW-SPEED APPARATUS | 20.0 | | | | 2232 | 4464 |

TABLE 16

| | SOUND PRESSURE LEVEL | LOUDNESS | SHARPNESS | TONALITY | IMPULSIVENESS |
|---|---|---|---|---|---|
| INTERMEDIATE-SPEED APPARATUS 1 | 51.0 | 6.9 | 2.4 | 0.05 | 0.40 |
| INTERMEDIATE-SPEED APPARATUS 2 | 56.3 | 9.0 | 2.9 | 0.06 | 0.40 |
| INTERMEDIATE-SPEED APPARATUS 3 | 47.1 | 4.8 | 2.1 | 0.04 | 0.48 |
| INTERMEDIATE-SPEED APPARATUS 4 | 54.6 | 7.9 | 3.1 | 0.04 | 0.45 |
| INTERMEDIATE-SPEED APPARATUS 5 | 55.7 | 6.9 | 1.8 | 0.05 | 0.43 |
| INTERMEDIATE-SPEED APPARATUS 6 | 57.7 | 7.6 | 2.3 | 0.07 | 0.42 |
| INTERMEDIATE-SPEED APPARATUS 7 | 49.2 | 5.7 | 1.8 | 0.08 | 0.42 |
| INTERMEDIATE-SPEED APPARATUS 8 | 52.1 | 6.3 | 2.8 | 0.04 | 0.45 |
| INTERMEDIATE-SPEED APPARATUS 9 | 50.1 | 6.8 | 3.2 | 0.05 | 0.42 |
| AVERAGE VALUE FOR INTERMEDIATE-SPEED APPARATUS | 52.6 | 6.9 | 2.5 | 0.05 | 0.43 |

| | PPM | LOGIT | PREDICTED PROBABILITY | REAL PROBABILITY | REACTION | TOTAL FREQUENCY |
|---|---|---|---|---|---|---|
| INTERMEDIATE-SPEED APPARATUS 1 | 27.0 | −0.37222 | 0.40800 | 0.28676 | 156 | 544 |
| INTERMEDIATE-SPEED APPARATUS 2 | 27.0 | 1.88498 | 0.86818 | 0.85294 | 464 | 544 |
| INTERMEDIATE-SPEED APPARATUS 3 | 27.0 | −2.14619 | 0.10469 | 0.06640 | 47 | 544 |
| INTERMEDIATE-SPEED APPARATUS 4 | 27.0 | 1.32438 | 0.78991 | 0.77206 | 420 | 544 |
| INTERMEDIATE-SPEED APPARATUS 5 | 27.0 | −0.34433 | 0.41476 | 0.47059 | 256 | 544 |
| INTERMEDIATE-SPEED APPARATUS 6 | 27.0 | 0.84630 | 0.69979 | 0.58728 | 363 | 544 |
| INTERMEDIATE-SPEED APPARATUS 7 | 27.0 | −1.54868 | 0.17528 | 0.16544 | 90 | 544 |
| INTERMEDIATE-SPEED APPARATUS 8 | 27.0 | −0.00246 | 0.49938 | 0.64706 | 352 | 544 |
| INTERMEDIATE-SPEED APPARATUS 9 | 27.0 | 0.35824 | 0.58862 | 0.55147 | 300 | 544 |
| AVERAGE VALUE FOR INTERMEDIATE-SPEED APPARATUS | 27.0 | | | | 2448 | 4896 |

TABLE 17

| | SOUND PRESSURE LEVEL | LOUDNESS | SHARPNESS | TONALITY | IMPULSIVENESS |
|---|---|---|---|---|---|
| HIGH-SPEED APPARATUS 1 | 51.3 | 7.6 | 2.1 | 0.03 | 0.50 |
| HIGH-SPEED APPARATUS 2 | 59.1 | 11.9 | 2.4 | 0.08 | 0.49 |
| HIGH-SPEED APPARATUS 3 | 57.2 | 10.7 | 2.1 | 0.05 | 0.51 |

TABLE 17-continued

| | | | | | |
|---|---|---|---|---|---|
| HIGH-SPEED APPARATUS 4 | 59.2 | 12.0 | 2.7 | 0.06 | 0.47 |
| HIGH-SPEED APPARATUS 5 | 55.3 | 10.0 | 2.4 | 0.04 | 0.48 |
| HIGH-SPEED APPARATUS 6 | 58.9 | 11.0 | 1.9 | 0.08 | 0.50 |
| HIGH-SPEED APPARATUS 7 | 60.3 | 12.3 | 2.3 | 0.06 | 0.52 |
| HIGH-SPEED APPARATUS 8 | 60.3 | 11.5 | 2.1 | 0.05 | 0.54 |
| HIGH-SPEED APPARATUS 9 | 58.2 | 10.8 | 3.1 | 0.03 | 0.57 |
| AVERAGE VALUE FOP HIGH-SPEED APPARATUS | 57.7 | 10.8 | 2.3 | 0.05 | 0.51 |

| | PPM | LOGIT | PREDICTED PROBABILITY | REAL PROBABILITY | REACTION | TOTAL FREQUENCY |
|---|---|---|---|---|---|---|
| HIGH-SPEED APPARATUS 1 | 65.0 | −2.80781 | 0.05690 | 0.02031 | 13 | 640 |
| HIGH-SPEED APPARATUS 2 | 65.0 | 0.90812 | 0.71262 | 0.72813 | 466 | 640 |
| HIGH-SPEED APPARATUS 3 | 65.0 | −0.43044 | 0.39402 | 0.38281 | 245 | 640 |
| HIGH-SPEED APPARATUS 4 | 65.0 | 1.01018 | 0.73308 | 0.70313 | 450 | 640 |
| HIGH-SPEED APPARATUS 5 | 65.0 | −0.84901 | 0.29964 | 0.21406 | 137 | 640 |
| HIGH-SPEED APPARATUS 6 | 65.0 | −0.06751 | 0.48313 | 0.33125 | 212 | 640 |
| HIGH-SPEED APPARATUS 7 | 65.0 | 1.04000 | 0.73885 | 0.75156 | 481 | 640 |
| HIGH-SPEED APPARATUS 8 | 65.0 | 0.35365 | 0.58750 | 0.60625 | 386 | 640 |
| HIGH-SPEED APPARATUS 9 | 65.0 | 0.84281 | 0.69906 | 0.76250 | 488 | 640 |
| AVERAGE VALUE FOP HIGH-SPEED APPARATUS | 65.0 | | | | 2880 | 5760 |

TABLE 18

| | SOUND PRESSURE LEVEL | LOUDNESS | SHARPNESS | TONALITY | IMPULSIVENESS |
|---|---|---|---|---|---|
| PRELIMINARY EXPERIMENT 1 | 53.3 | 8.7 | 2.2 | 0.03 | 0.47 |
| PRELIMINARY EXPERIMENT 2 | 56.4 | 10.4 | 2.8 | 0.03 | 0.52 |
| PRELIMINARY EXPERIMENT 3 | 51.0 | 6.9 | 2.4 | 0.05 | 0.40 |
| PRELIMINARY EXPERIMENT 4 | 56.3 | 9.0 | 2.9 | 0.06 | 0.40 |
| PRELIMINARY EXPERIMENT 5 | 57.7 | 7.6 | 2.3 | 0.07 | 0.42 |
| PRELIMINARY EXPERIMENT 6 | 62.1 | 5.3 | 2.8 | 0.04 | 0.48 |
| PRELIMINARY EXPERIMENT 7 | 53.6 | 7.0 | 2.4 | 0.07 | 0.76 |
| PRELIMINARY EXPERIMENT 8 | 52.3 | 7.4 | 2.3 | 0.17 | 0.55 |
| AVERAGE VALUE FOR PRELIMINARY EXPERIMENT | 54.1 | 7.9 | 2.5 | 0.07 | 0.50 |

| | PPM | LOGIT | PREDICTED PROBABILITY | REAL PROBABILITY | REACTION | TOTAL FREQUENCY |
|---|---|---|---|---|---|---|
| PRELIMINARY EXPERIMENT 1 | 65.0 | −0.77313 | 0.31580 | 0.45798 | 218 | 476 |
| PRELIMINARY EXPERIMENT 2 | 65.0 | 1.11774 | 0.75357 | 0.78571 | 374 | 476 |
| PRELIMINARY EXPERIMENT 3 | 27.0 | −1.28741 | 0.21629 | 0.06513 | 31 | 476 |
| PRELIMINARY EXPERIMENT 4 | 27.0 | 0.98979 | 0.72506 | 0.66597 | 317 | 476 |
| PRELIMINARY EXPERIMENT 5 | 27.0 | −0.06889 | 0.48278 | 0.42647 | 203 | 476 |
| PRELIMINARY EXPERIMENT 6 | 27.0 | −0.91767 | 0.28543 | 0.43597 | 206 | 476 |
| PRELIMINARY EXPERIMENT 7 | 20.0 | 0.33491 | 0.58295 | 0.57773 | 275 | 476 |
| PRELIMINARY EXPERIMENT 8 | 20.0 | 0.62466 | 0.65128 | 0.58403 | 278 | 476 |
| AVERAGE VALUE FOR PRELIMINARY EXPERIMENT | 34.8 | | | | 1904 | 3808 |

TABLE 19

| | SOUND PRESSURE LEVEL | LOUDNESS | SHARPNESS | TONALITY | IMPULSIVENESS |
|---|---|---|---|---|---|
| MIXED EXPERIMENT 1 | 56.8 | 10.4 | 2.4 | 0.15 | 0.43 |
| MIXED EXPERIMENT 2 | 57.4 | 10.4 | 1.9 | 0.11 | 0.46 |
| MIXED EXPERIMENT 3 | 55.9 | 10.4 | 3.0 | 0.05 | 0.47 |
| MIXED EXPERIMENT 4 | 58.1 | 8.8 | 1.9 | 0.15 | 0.41 |
| MIXED EXPERIMENT 5 | 54.6 | 8.7 | 3.0 | 0.09 | 0.39 |
| MIXED EXPERIMENT 6 | 54.3 | 8.7 | 2.5 | 0.05 | 0.40 |
| MIXED EXPERIMENT 7 | 51.9 | 7.0 | 2.9 | 0.16 | 0.57 |
| MIXED EXPERIMENT 8 | 51.6 | 7.0 | 2.3 | 0.10 | 0.64 |
| MIXED EXPERIMENT 9 | 52.8 | 7.0 | 1.9 | 0.06 | 0.71 |
| AVERAGE VALUE FOR MIXED EXPERIMENT | 54.8 | 8.7 | 2.4 | 0.10 | 0.50 |

| | PPM | LOGIT | PREDICTED PROBABILITY | REAL PROBABILITY | REACTION | TOTAL FREQUENCY |
|---|---|---|---|---|---|---|
| MIXED EXPERIMENT 1 | 65.0 | 0.89660 | 0.71066 | 0.65993 | 359 | 544 |
| MIXED EXPERIMENT 2 | 65.0 | 0.13108 | 0.53272 | 0.48162 | 262 | 544 |
| MIXED EXPERIMENT 3 | 65.0 | 0.64013 | 0.65478 | 0.59375 | 323 | 544 |
| MIXED EXPERIMENT 4 | 27.0 | 0.20033 | 0.54992 | 0.49816 | 271 | 544 |

TABLE 19-continued

| | | | | | | |
|---|---|---|---|---|---|---|
| MIXED EXPERIMENT 5 | 27.0 | 0.38102 | 0.59412 | 0.62132 | 338 | 544 |
| MIXED EXPERIMENT 6 | 27.0 | −0.67315 | 0.33779 | 0.28650 | 157 | 544 |
| MIXED EXPERIMENT 7 | 20.0 | 0.31414 | 0.57790 | 0.61029 | 332 | 544 |
| MIXED EXPERIMENT 8 | 20.0 | −0.70776 | 0.33009 | 0.45588 | 248 | 544 |
| MIXED EXPERIMENT 9 | 20.0 | −1.18439 | 0.23426 | 0.29044 | 158 | 544 |
| AVERAGE VALUE FOR MIXED EXPERIMENT | 37.3 | | | | 2448 | 4895 |

For example, the experiment is carried out based on 31 evaluating persons for the low-speed apparatus. For nine kinds of sample sound, one sound is compared with each of the rest eight kinds of sound. Therefore, 496 becomes a denominator. In other words, 8 (i.e. samples to be compared)×2 (order)×31=496 persons.

The sample sound 1 is compared in pair with each of the sample sounds 2, 3, . . . , and 9. The frequencies that the evaluating persons decide that the sample sound 1 is unpleasant are 0, 57, 7, 19, . . . . Therefore, the sum 221 (reacted number) of these frequencies becomes a numerator. In Table 5, a discomfort probability of the sample sound according to the actual measurement is expressed as a real probability, which is "reaction over total frequency". As an average value of the probabilities P of the nine kinds of sample sound is 0.5, the logit z and a predicted probability are calculated from the expression (19) using an average value of physical quantities obtained by experiment for a low-speed apparatus. Table 15 is obtained as a result. A similar operation is also carried out for other experiments, and Table 16 to Table 19 are obtained. Verification experiments will be omitted here.

Figure 31A:
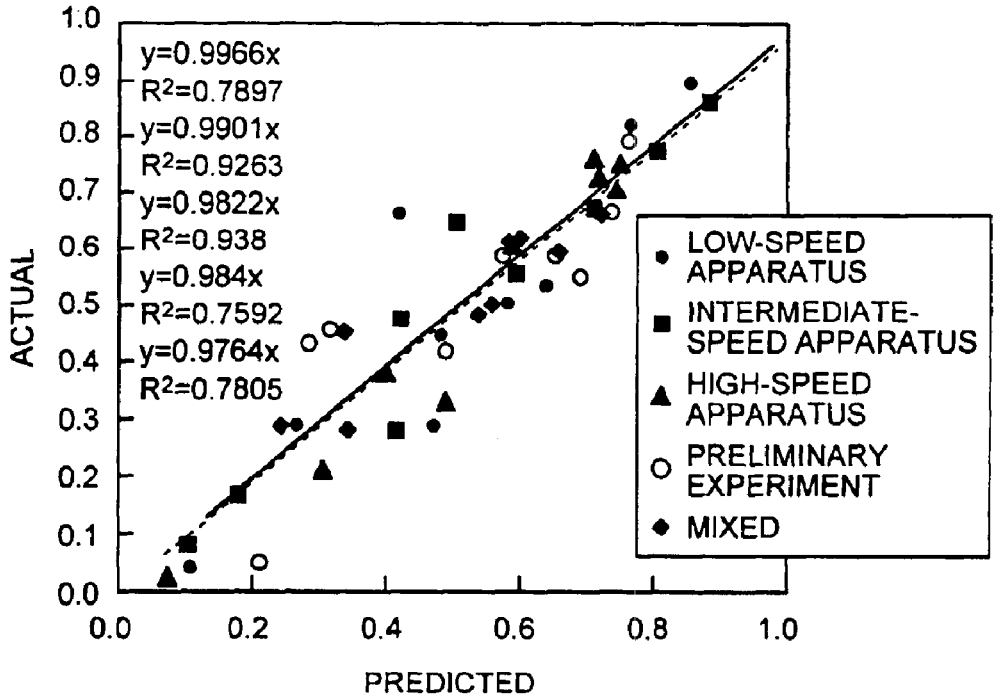
FIGS. 31A and 31B are graphs of actual and predicted probabilities based on a relative model according to the second embodiment.
Figure 31B:
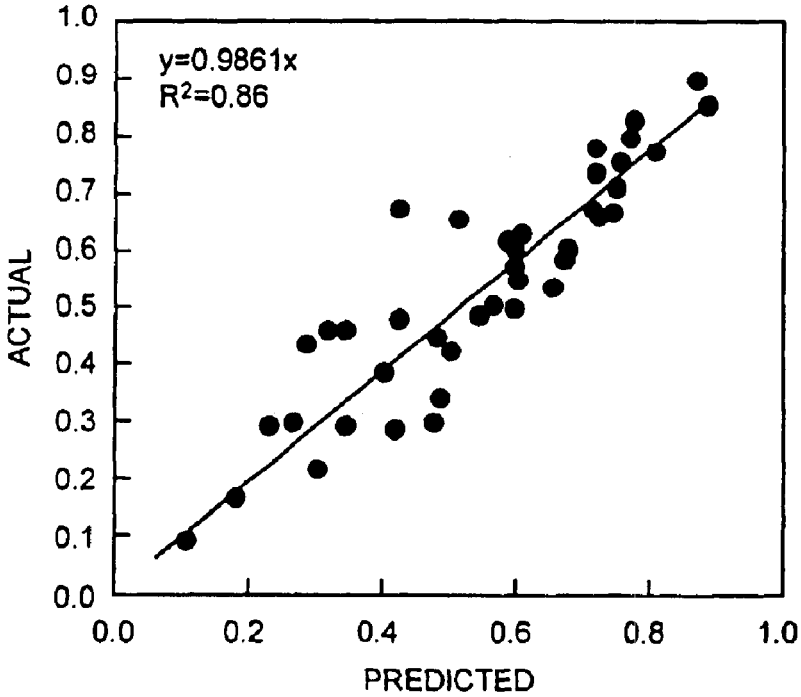

A scatter diagram of predicted probabilities and actual measurement probabilities in Table 15 to Table 19 is prepared. As a result, FIGS. 31A and 31B are obtained. FIG. 31A is a graph of a scatter diagram for each experiment. It is clear from this graph that the contribution rate is near 0.8 for the low-speed apparatus experiment, the mixed preparatory experiment, and the mixed experiment. The contribution rate is 0.9 or above for the intermediate-speed apparatus experiment, and the high-speed apparatus experiment. These experiments fit fairly well with prediction lines.

In FIG. 31B, a contribution rate of the model having the experiments integrated together is 0.86. This indicates that the sound pressure level, loudness, sharpness, tonality, and impulsiveness contribute 86 percent to the sensation of discomfort. The slope of the expression is substantially 1, which means that the predicted probability is equal to the actual measurement probability. With this arrangement, a discomfort probability percent can be estimated when the average value of physical characteristics of the population is the reference value 50 percent.

From the expression, in order to lower the discomfort level, the following five actions are taken.

(1) Lower the sound pressure level (2) Make small the size of an audible level.

(3) Reduce high-frequency components.

(4) Reduce pure tone components.

(5) Reduce impulse noise.

An estimate value of a regression coefficient of each parameter takes a standard error as shown in Table 7. An estimate value ±2 of a regression coefficient is within a confidence interval of 95 percent. Therefore, from the expression (20), when the estimate values include the confidence interval 95 percent of the regression coefficients, the regression coefficients and expressions become as follows. A range of the intercept is obtained by substituting the confidence interval 95 percent of each regression coefficient. The expression (21) uses this result.

[Expression 49]

$$P = \frac{1}{1 + \exp(-z)} \tag{21}$$

where 0.10547717≦regression coefficient of sound pressure level≦0.15069022

0.40687921≦region coefficient of loudness≦0.5399976

0.99138725≦partial regression coefficient of sharpness≦1.166331

8.38547981≦partial regression coefficient of impulsiveness≦3.21686388

2.57373312≦partial regression coefficient of ppm≦−0.0106576

−17.49359273≦intercept≦−12.70308101

$z = A \times$ sound pressure level $o + B \times$ loudness $i + C \times$ sharpness $i + D \times$ tonality $i + E \times$ impulsiveness $i + F \times$ ppm $i + G$ where A, B, C, D, E, F, and G satisfy the inequalities 0.10547717≦A≦0.15069022

0.40687921≦B≦0.53399976

0.99138725≦C≦1.166331

8.38547981≦D≦10.1721249

2.57373312≦E≦3.21686388

−0.020344≦F≦−0.0106576

−17.49359273≦G≦−12.70308101.

When the estimate values of the regression coefficients are fixed the estimate values shown in Table 7, the addition of ±2 to the logit z indicates the range of the confidence interval 95 percent. Here represents a standard deviation of errors in discomfort levels. The standard error of the logit z is obtained in a state of a difference model. The logit z is expressed in the following expression (3) explained in the first embodiment. Therefore, z is calculated using the real probability P of discomfort, i.e., discomfort probability when two kinds of sounds are compared.

$$z = \ln(p) - \ln(1 - p) = \ln\left(\frac{p}{1 - p}\right) \tag{3}$$

An output using the statistical analysis software JMP is used to predict the logit z of a discomfort level. When JMP is used to obtain a standard deviation of a difference (i.e., errors) of the predicted logit z, the standard deviation of the errors becomes =0.871894. Therefore, the following expression (22) includes these errors.

$$P = \frac{1}{1 + \exp(-z \pm 2\sigma)} \quad (22)$$

where $$z = 0.12808364 \times \text{sound pressure level } i + 0.47043907 \times \text{loudness } i + 1.07885872 \times \text{sharpness } i + 9.27879937 \times \text{tonality } i + 2.89529674 \times \text{impulsiveness } i - 0.0155008 \times ppmi - 15.09832827$$

$\sigma$=0.871894

The following expression (23) can also be obtained by using the predicted probability P and the standard deviation of a difference (i.e., errors) of the real probability P. However, in this case, the discomfort probability P is out of the range from 0 to 1, which is not suitable.

$$P = \frac{1}{1 + \exp(-z)} \pm 2\sigma \quad (23)$$

In the paired comparative experiment, combinations of a decision that all the evaluating persons decide that the same one kind of sound is unpleasant, and a difference in physical quantities are calculated from the data in Table 1 to Table 4. As explained above, there are 31 combinations. The combinations of the same kinds of sound such as 1-2, and 2-1 are all expressed in the form of 1-2. In the comparative combination, an absolute value of a difference of discomfort probabilities is calculated using the real probabilities of discomfort shown in Table 15 to Table 19.

Table 20 summarizes the calculation result. When the difference of discomfort probability of sample sound is a minimum of 0.13 (i.e, 13 percent), all the evaluating persons decide that the same one kind of sound is unpleasant. However, when a difference of discomfort probability is about 18 percent in the combination not shown in Table 13 and 27 evaluating persons out of 34 persons decide that the same one kind of sound is unpleasant. When there is this level of difference in the number of persons, it can be said that one same kind of sound is clearly unpleasant. In other words, when the discomfort probability is lowered by about 0.2 from the current level, it is clear that the sensation of discomfort is reduced, and the users are considered to be satisfied. Consequently, when the physical quantity is reduced such that the discomfort probability is lowered by 0.2 or more, the sensation of discomfort of noise from the image formation apparatus in offices is mitigated. As a result, the users can operate the apparatus comfortably without the trouble of operation noise.

TABLE 20

| COMPARISON | DIFFERENCE OF SOUND PRESSURE LEVEL | DIFFERENCE OF LOUDNESS | DIFFERENCE OF SHARPNESS |
|---|---|---|---|
| LOW-SPEED APPARATUS 1-2 | −3.7 | −1.3 | 0.0 |
| LOW-SPEED APPARATUS 2-3 | 6.9 | 2.2 | 0.1 |
| LOW-SPEED APPARATUS 3-4 | −6.3 | −2.3 | 0.1 |
| LOW-SPEED APPARATUS 3-5 | −4.6 | −2.0 | 0.8 |
| LOW-SPEED APPARATUS 5-6 | 0.0 | 0.4 | −0.8 |
| LOW-SPEED APPARATUS 5-8 | 0.2 | 1.1 | −0.9 |
| LOW-SPEED APPARATUS 5-9 | 0.6 | 1.6 | −1.0 |
| INTERMEDIATE-SPEED APPARATUS 1-2 | −5.4 | −2.2 | −0.5 |
| INTERMEDIATE-SPEED APPARATUS 1-4 | −3.7 | −1.0 | −0.7 |
| INTERMEDIATE-SPEED APPARATUS 3-6 | −10.7 | −2.8 | −0.2 |
| HIGH-SPEED APPARATUS 1-2 | −7.8 | −4.3 | −0.3 |
| HIGH-SPEED APPARATUS 1-3 | −5.9 | −3.1 | 0.0 |
| HIGH-SPEED APPARATUS 1-4 | −7.9 | −4.4 | −0.6 |
| HIGH-SPEED APPARATUS 1-7 | −9.0 | −4.7 | −0.2 |
| HIGH-SPEED APPARATUS 1-8 | −9.0 | −3.9 | 0.0 |
| HIGH-SPEED APPARATUS 1-9 | −6.9 | −3.2 | −1.0 |
| HIGH-SPEED APPARATUS 2-3 | 1.9 | 1.2 | 0.3 |
| HIGH-SPEED APPARATUS 2-5 | 3.9 | 2.0 | −0.1 |
| HIGH-SPEED APPARATUS 4-5 | 3.9 | 2.0 | 0.3 |
| HIGH-SPEED APPARATUS 5-7 | −5.1 | −2.3 | 0.1 |
| HIGH-SPEED APPARATUS 5-9 | −3.0 | −0.9 | −0.7 |

| COMPARISON | DIFFERENCE OF TONALITY | DIFFERENCE OF IMPULSIVENESS | DIFFERENCE OF DISCOMFORT PROBABILITY (ABSOLUTE VALUE) |
|---|---|---|---|
| LOW-SPEED APPARATUS 1-2 | −0.08 | 0.00 | 0.45 |
| LOW-SPEED APPARATUS 2-3 | 0.12 | 0.23 | 0.84 |
| LOW-SPEED APPARATUS 3-4 | −0.06 | −0.29 | 0.76 |
| LOW-SPEED APPARATUS 3-5 | −0.14 | 0.08 | 0.61 |
| LOW-SPEED APPARATUS 5-6 | 0.12 | −0.38 | 0.17 |
| LOW-SPEED APPARATUS 5-8 | 0.01 | −0.19 | 0.13 |
| LOW-SPEED APPARATUS 5-9 | 0.15 | −0.47 | 0.37 |
| INTERMEDIATE-SPEED APPARATUS 1-2 | −0.01 | 0.01 | 0.57 |
| INTERMEDIATE-SPEED APPARATUS 1-4 | 0.01 | −0.05 | 0.49 |
| INTERMEDIATE-SPEED APPARATUS 3-6 | −0.03 | 0.06 | 0.58 |
| HIGH-SPEED APPARATUS 1-2 | −0.05 | 0.01 | 0.71 |
| HIGH-SPEED APPARATUS 1-3 | −0.02 | 0.00 | 0.39 |
| HIGH-SPEED APPARATUS 1-4 | −0.03 | 0.03 | 0.21 |
| HIGH-SPEED APPARATUS 1-7 | −0.03 | −0.02 | 0.73 |

TABLE 20-continued

| | | | |
|---|---|---|---|
| HIGH-SPEED APPARATUS 1-8 | −0.02 | −0.03 | 0.59 |
| HIGH-SPEED APPARATUS 1-9 | 0.00 | −0.07 | 0.74 |
| HIGH-SPEED APPARATUS 2-3 | 0.03 | −0.01 | 0.35 |
| HIGH-SPEED APPARATUS 2-5 | 0.04 | 0.01 | 0.51 |
| HIGH-SPEED APPARATUS 4-5 | 0.02 | −0.01 | 0.49 |
| HIGH-SPEED APPARATUS 5-7 | −0.02 | −0.04 | 0.54 |
| HIGH-SPEED APPARATUS 5-9 | 0.01 | −0.09 | 0.55 |

The sound quality evaluation expression (20) and others are derived this time using sounds from a wide range of operating speeds of low-speed to high-speed apparatuses. A relatively high-speed apparatus having a large sound pressure level and large loudness clearly emits noise more unpleasant than the noise from a low-speed apparatus having a small sound pressure level and small loudness. Consequently, a calculated discomfort probability becomes higher for the high-speed apparatus. Therefore, when a discomfort permissible value is obtained from the expression (20), all the high-speed apparatus emit unpleasant noise. As some low-speed apparatuses have a high sound pressure level, the image formation speed is not always proportional to the sound pressure level and loudness. However, in the present invention, a relationship between the image formation speed and a discomfort probability P in this image formation speed is obtained. The discomfort probability P of the image formation apparatus is set to a certain value or below. With this arrangement, the image formation apparatus having a probability that sensation of discomfort is low can be provided. In other words, a permissible value of discomfort is obtained for each speed layer, and a relationship between the speed and the discomfort permissible value are obtained, as shown in Tables 15, 16, and 17.

A physical quantity of the original sound is used for each experiment of the low-speed apparatus, the intermediate-speed apparatus, and the high-speed apparatus. Three sound quality evaluation expressions are generated in which the discomfort probability of the original sound is defined as 0.5. In other words, three intercepts are obtained. From Table 8, the physical quantities of the original sound are 1 for the low-speed apparatus (20 ppm), 1 for the intermediate-speed apparatus (27 ppm), and 5 for the high-speed apparatus (65 ppm).

From the expression (18), each intercept is calculated by setting the probability P as 0.5 when the original sound value is input for each speed layer. Next, a difference between the intercept of the total average and the intercept of each speed layer in the three expressions is obtained. Table 21 summarizes the result of the calculation. From the result shown in Table 20, the probability P that permits discomfort is set to 0.3 (i.e., the probability that discomfort is sensed is lowered by 20 percent from the current state). In other words, a difference of each intercept is corrected from the logit z when P is equal to 0.3 in the expression (20). The permissible probability P is calculated from the corrected logit z. The calculated permissible probability represents the value of P in the expression (13) when the discomfort level of each original sound is reduced by 20 percent. Table 15 summarizes the result. Table 21 and Table 22 summarize the above calculation results.

TABLE 21

| TERM | COEFFICIENT ESTIMATE VALUE | TOTAL PARAMETER AVERAGE VALUE | HIGH-SPEED LAYER PARAMETER ORIGINAL SOUND VALUE | INTERMEDIATE-SPEED LAYER PARAMETER ORIGINAL SOUND VALUE | LOW-SPEED LAYER PARAMETER ORIGINAL SOUND VALUE |
|---|---|---|---|---|---|
| SOUND PRESSURE LEVEL | 0.12808364 | 54.3 | 55.3 | 51.0 | 52.8 |
| LOUDNESS | 0.47043907 | 8.5 | 10.0 | 6.9 | 7.5 |
| SHARPNESS | 1.07885872 | 2.3 | 2.4 | 2.4 | 2.3 |
| TONALITY | 9.27879937 | 0.08 | 0.04 | 0.05 | 0.12 |
| IMPULSE | 2.89529674 | 0.51 | 0.48 | 0.40 | 0.61 |
| PPM | −0.0155008 | 38.75 | 65.00 | 27.00 | 20.00 |
| INTERCEPT | — | −15.098 | −15.105 | −13.584 | −15.583 |
| DIFFERENCE OF INTERCEPT FROM TOTAL AVERAGE | — | — | −0.007 | 1.514 | −0.485 |

TABLE 22

| | IMAGE FORMATION SPEED PPM | PERMISSIBLE PROBABILITY P | LOGIT z |
|---|---|---|---|
| TOTAL | | 0.30 | −0.847 |
| HIGH SPEED | 65 | 0.80 | −0.840 |
| INTERMEDIATE SPEED | 27 | 0.09 | −2.361 |
| LOW SPEED | 20 | 0.41 | −0.363 |

Figure 30:
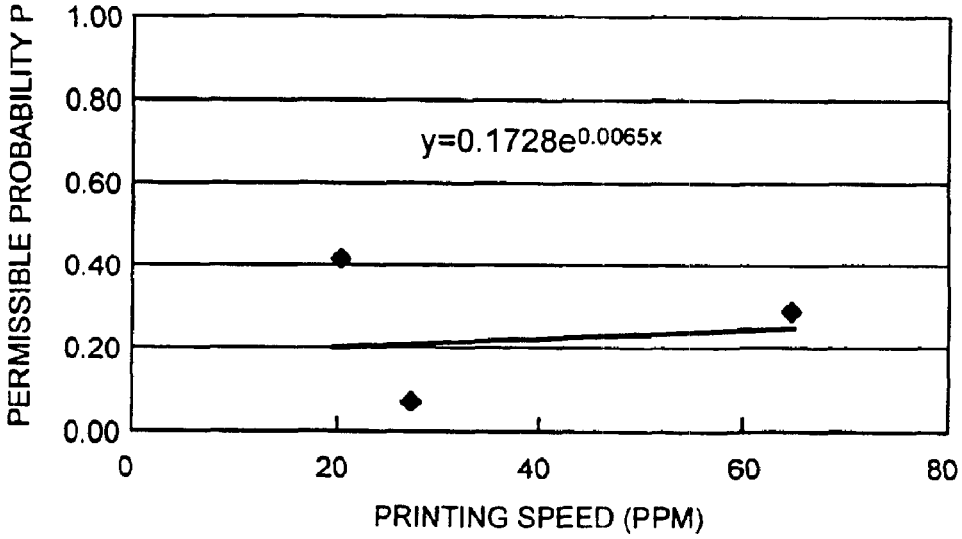
FIG. 30 is a graph of discomfort probabilities relative to a printing speed of an image formation apparatus according to the second embodiment.

FIG. 30 is an approximation curve obtained from the relationship between the image formation speed and the permissible probability P The expression (24) represents this approximation expression. In other words, when the probability P is equal to or less than that obtained using the expression (25), the probability that the sound is sensed unpleasant becomes small.

$$y=0.1728e^{0.0065x} \quad (24)$$

$$P \leqq 0.1728e^{0.0065\ ppm} \quad (25)$$

Unpleasant sound sources have a high correlation with the sound pressure level, loudness, sharpness, tonality, and impulsiveness. The sound sources of the image formation apparatus having a high correlation with each of the psycho-acoustics parameters are as follows.

Sharpness: sliding noise of recording paper,

Tonality: AC charging noise,

Impulsiveness: Metal impulse noise, and

Sound pressure level and loudness: Acoustic energy, and size of audible level from various sound sources.

Therefore, measures for these sound sources are taken as [reduction in charging noise], [reduction in paper sliding noise], and [reduction in metal impulse noise]. The measures taken are similar to those explained in [reduction in charging noise], [reduction in paper sliding noise], and [reduction in metal impulse noise] according to the first embodiment. Therefore, their explanation will be omitted here.

The present invention is not limited to the above embodiments. It is also possible to implement the present invention by suitably modifying the invention within a range not deviating from the gist of the present invention. For example, the sound quality evaluation expressions and their conditions according to the present invention are not limited to the image formation apparatus shown in FIG. 1 and FIG. 4 according to the present embodiment. These sound quality evaluation expressions and conditions can also be applied to a wide range of general image formation apparatuses such as an electronic copying machine, a laser printer, and a laser facsimile apparatus.

The present document incorporates by reference the entire contents of Japanese priority documents, 2002-220404 filed in Japan on Jul. 29, 2002, 2002-244063 filed in Japan on Aug. 23, 2002, 2002-274110 filed in Japan on Sep. 19, 2002 and 2002-334270 filed in Japan on Nov. 18, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image formation apparatus having an arrangement so that a discomfort probability P, calculated from an expression (a), fulfills a condition (b), wherein the discomfort probability P is calculated using a sound pressure level value, a loudness value of a psycho-acoustics parameter, a sharpness value, a tonality value, and an impulsiveness value obtained from operation noise at a position with a distance from an end surface of the image formation apparatus, $$\hat{P}_{im}=1/\{1+\exp[-z]\} \quad (a)$$

$$\hat{P}_{im} \leqq 0.2725 \cdot \ln(\text{ppm})-0.6331 \quad (b)$$

where $$z=A\times\text{sound pressure level } i+B\times\text{loudness } i+C\times\text{sharpness } i+D\times\text{tonality } i+E\times\text{impulsiveness } i+F$$

i=1, 2, 3, . . . , n

A, B, C, D, and E are regression coefficients of parameters, and F is intercept, and A, B, C, D, E, and F satisfy the inequalities $0.142 \leqq A \leqq 0.183$
$0.300 \leqq B \leqq 0.389$
$1.097 \leqq C \leqq 1.265$
$9.818 \leqq D \leqq 11.516$
$2.588 \leqq E \leqq 3.240$
$-18.844 \leqq F \leqq -14.968$ ppm is a printing speed per minute for A4 horizontal size recording medium.

2. The image formation apparatus according to claim 1, wherein values of A to F are in a range of ±2σ, where σ is standard error, with respect to an estimate value of each coefficient.

3. The image formation apparatus according to claim 1, wherein a multiple logistic regression model $$\hat{P}_{ij} = 1 \Big/ \left\{1 + \exp\left[-\left(\sum_{l=1}^{L} b_l(x_{li} - x_{ij})\right)\right]\right\},$$

where $b_l$ is regression coefficient $x_{li}$ and $x_{ij}$ are psychological acoustic parameter values of sounds that are compared in pair i=1, 2, 3, . . . n j=1, 2, 3, . . . , n l=1, 2, 3, . . . , L, that predicts a probability of dominance of sound based on a paired comparison of sounds transforms the expression (a) for calculating the discomfort probabilities into an expression that predicts a discomfort probability of single noise by using an average value of psycho-acoustics parameter values of whole samples used to derive a regression model expression.

4. The image formation apparatus according to claim 1, comprising a higher-frequency-component reducing unit that reduces a higher-frequency-component to fulfill the condition (b).

5. The image formation apparatus according to claim 4, wherein the higher-frequency-component reducing unit includes a guiding member in a medium conveying unit and a sliding noise reducing unit that reduces sliding of a recording medium.

6. The image formation apparatus according to claim 1, comprising an impulse-noise reducing unit that reduces impulse noise to fulfill the condition (b).

7. The image formation apparatus according to claim 6, wherein the impulse-noise reducing unit includes a medium conveyance control unit that controls electromagnetic clutches, each provided on each of routes for conveying a recording medium, having a plurality of medium feed trays, such that only electromagnetic clutches positioned on or above a used medium feed tray or above operate.

8. The image formation apparatus according to claim 1, wherein the discomfort probability (P), in at least a direction of an operating section, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

9. The image formation apparatus according to claim 1, wherein an average value of the discomfort probability (P), in four directions of front, back, left, and right sides, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

10. The image formation apparatus according to claim 1, wherein the discomfort probability (P), on at least one side, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

11. The image formation apparatus according to claim 1, wherein the discomfort probability (P), on all the four sides, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

12. An image formation apparatus having an arrangement so that a discomfort probability P, calculated from an expression (c), fulfills a condition (b), wherein the discomfort probability P is calculated using a sound pressure level value, a loudness value of a psycho-acoustics parameter, a sharpness value, a tonality value, and an impulsiveness value obtained from operation noise at a position with a distance from an end surface of the image formation apparatus, $$\hat{P}_{i\varpi} = 1 \Big/ \left\{ 1 + \exp\left[ \begin{array}{l} 16.90601 - 0.1625723\chi_{\text{sound pressure level}} - \\ 0.34475769\chi_{\text{loudness } i} - 1.18093783\chi_{\text{sharpness } i} - \\ 10.6669829\chi_{\text{tonality } i} - 2.91380546\varphi_{\text{impulse } i} \pm \\ 2\hat{\sigma} \end{array} \right] \right\} \quad \text{(c)}$$

$$\hat{P}_{im} \leqq 0.2725 \cdot \ln(\text{ppm}) - 0.6331 \quad \text{(b)}$$

where i=1, 2, 3, . . . , n

σ is standard error ppm is a printing speed per minute for A4 horizontal size recording medium.

13. The image formation apparatus according to claim 12, wherein the standard error σ is 0.839.

14. The image formation apparatus according to claim 12, wherein a multiple logistic regression model $$\hat{P}_{ij} = 1 \Big/ \left\{ 1 + \exp\left[ -\left( \sum_{l=1}^{L} b_l (x_{li} - x_{lj}) \right) \right] \right\},$$

where $b_l$ is regression coefficient $x_{li}$ and $x_{lj}$ are psychological acoustic parameter values of sounds that are compared in pair i=1, 2, 3, . . . , n j=1, 2, 3, . . . , n l=1, 2, 3, . . . , L, that predicts a probability of dominance of sound based on a paired comparison of sounds transforms the expression (c) for calculating the discomfort probabilities into an expression that predicts a discomfort probability of single noise by using an average value of psycho-acoustics parameter values of whole samples used to derive a regression model expression.

15. The image formation apparatus according to claim 12, comprising a higher-frequency-component reducing unit that reduces a higher-frequency-component to fulfill the condition (b).

16. The image formation apparatus according to claim 15, wherein the higher-frequency-component reducing unit includes a guiding member in a medium conveying unit and a sliding noise reducing unit that reduces sliding of a recording medium.

17. The image formation apparatus according to claim 12, comprising an impulse-noise reducing unit that reduces impulse noise to fulfill the condition (b).

18. The image formation apparatus according to claim 17, wherein the impulse noise reducing unit includes a medium conveyance control unit that controls electromagnetic clutches, each provided on each of routes for conveying a recording medium, having a plurality of medium feed trays, such that only electromagnetic clutches positioned on or above a used medium feed tray or above operate.

19. The image formation apparatus according to claim 12, wherein the discomfort probability (P), in at least a direction of an operating section, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

20. The image formation apparatus according to claim 12, wherein an average value of the discomfort probability (P), in four directions of front, back, left, and right sides, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

21. The image formation apparatus according to claim 12, wherein the discomfort probability (P), on at least one side, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

22. The image formation apparatus according to claim 12, wherein the discomfort probability (P), on all the four sides, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

23. An image formation apparatus having an arrangement so that a discomfort probability P, calculated from an expression (d), fulfills a condition (b), wherein the discomfort probability P is calculated using a sound pressure level value, a loudness value of a psycho-acoustics parameter, a sharpness value, a tonality value, and an impulsiveness value obtained from operation noise at a position with a predetermined distance from an end surface of the image formation apparatus, $$\hat{P}_{iw} = 1 \Big/ \left\{ 1 + \exp\left[ \begin{array}{l} 16.90601 - 0.1625723_{x_{\text{sound pressure level}}} - \\ 0.34475769_{x_{\text{loudness } i}} - 1.18093783_{x_{\text{sharpness } i}} - \\ 10.6669829_{x_{\text{tonality } i}} - 2.91380546_{x_{\text{impulse } i}} \end{array} \right] \right\} \quad \text{(d)}$$

$$\hat{P}_{im} \leqq 0.2725 \cdot \ln(\text{ppm}) - 0.6331 \quad \text{(b)}$$

where i=1, 2, 3, . . . , n ppm is a printing speed per minute for A4 horizontal size recording medium.

24. The image formation apparatus according to claim 23, wherein a multiple logistic regression model $$\hat{P}_{ij} = 1 \Big/ \left\{ 1 + \exp\left[ -\left( \sum_{l=1}^{L} b_l (x_{li} - x_{lj}) \right) \right] \right\},$$

where $b_l$ is regression coefficient $x_{li}$ and $x_{lj}$ are psychological acoustic parameter values of sounds that are compared in pair i=1, 2, 3, . . . , n j=1, 2, 3, . . . , n l=1, 2, 3, . . . , L, that predicts a probability of dominance of sound based on a paired comparison of sounds transforms the expression (d) for calculating the discomfort probabilities into an expression that predicts a discomfort probability of single noise by using an average value of psycho-acoustics parameter values of whole samples used to derive a regression model expression.

25. The image formation apparatus according to claim 24, comprising a higher-frequency-component reducing unit that reduces a higher-frequency-component to fulfill the condition (b).

26. The image formation apparatus according to claim 25, wherein the higher-frequency-component reducing unit includes a guiding member in a medium conveying unit and a sliding noise reducing unit that reduces sliding noise of a recording medium.

27. The image formation apparatus according to claim 23, comprising an impulse-noise reducing unit that reduces impulse noise to fulfill the condition (b).

28. The image formation apparatus according to claim 27, wherein the impulse-noise reducing unit includes a medium conveyance control unit that controls electromagnetic clutches, each provided on each of routes for conveying a recording medium, having a plurality of medium feed trays, such that only electromagnetic clutches positioned on or above a used medium feed tray operate.

29. The image formation apparatus according to claim 23, wherein the discomfort probability P, in at least a direction of an operating section, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

30. The image formation apparatus according to claim 23, wherein an average value of the discomfort probability P, in four directions of front, back, left, and right sides, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

31. The image formation apparatus according to claim 23, wherein the discomfort probability P, on at least one side, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

32. The image formation apparatus according to claim 23, wherein the discomfort probability P, on all the four sides, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

33. An image formation apparatus having an arrangement so that a discomfort probability P, calculated from an expression (e), fulfills a condition (f), wherein the discomfort probability P is calculated using a sound pressure level value (A) in decibels, a loudness value of a psycho-acoustics parameter, a sharpness value, a tonality value, an impulsiveness value, and a printing speed ppm, obtained from operation noise at a position with a distance from an end surface of the image formation apparatus, $$P = \frac{1}{1 + \exp(-z)} \quad \text{(e)}$$

$$P \leqq 0.1728 e^{0.0065\, ppm} \quad \text{(f)}$$

where $z = A \times \text{sound pressure level } i + B \times \text{loudness } i + C \times \text{sharpness } i + D \times \text{tonality } i + E \times \text{impulsiveness } i + F \times \text{ppm } i + G$ i=1, 2, 3, . . . , n A, B, C, D, E, and F are regression coefficients of parameters, and G is intercept, and A, B, C, D, E, F, and G satisfy the inequalities $0.10547717 \leqq A \leqq 0.15069022$ $0.40687921 \leqq B \leqq 0.53399976$ $0.99138725 \leqq C \leqq 1.166331$ $8.38547981 \leqq D \leqq 10.1721249$ $2.57373312 \leqq E \leqq 3.21686388$ $-0.020344 \leqq F \leqq 0.0106576$ $-17.49359273 \leqq G \leqq 12.70308101$ ppm is a printing speed per minute for A4 horizontal size recording medium.

34. The image formation apparatus according to claim 33, wherein values of A to F are in a range of ±2σ, where σ is standard error, with respect to an estimate value of each coefficient.

35. The image formation apparatus according to claim 33, wherein a multiple logistic regression model $$\hat{P}_{ij} = 1 \Big/ \left\{1 + \exp\left[-\left(\sum_{l=1}^{L} b_l(x_{li} - x_{lj})\right)\right]\right\},$$

where $b_l$ is regression coefficient $x_{li}$ and $x_{lj}$ are psychological acoustic parameter values of sounds that are compared in pair i=1, 2, 3, . . . , n j=1, 2, 3, . . . , n l=1, 2, 3, . . . , L, that predicts a probability of dominance of sound based on a paired comparison of sounds transforms the expression (e) for calculating the discomfort probabilities into an expression that predicts a discomfort probability of single noise by using an average value of psycho-acoustics parameter values of whole samples that are used to derive a regression model expression.

36. The image formation apparatus according to claim 33, wherein the discomfort probability P, in at least a direction of an operating section, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

37. The image formation apparatus according to claim 33, wherein an average value of the discomfort probability P, in four directions of front, back, left, and right sides, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

38. The image formation apparatus according to claim 33, wherein the discomfort probability P, on at least one side, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

39. The image formation apparatus according to claim 33, wherein the discomfort probability P, on all the four sides, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

40. The image formation apparatus according to claim 33, comprising a higher-frequency-component reducing unit that reduces a higher-frequency-component to fulfill the condition (f).

41. The image formation apparatus according to claim 33, wherein the higher-frequency-component reducing unit includes a guiding member in a medium conveying unit and a sliding noise reducing unit that reduces sliding noise of the recording medium.

42. The image formation apparatus according to claim 33, comprising an impulse-noise reducing unit that reduces impulse noise to fulfill the condition (f).

43. The image formation apparatus according to claim 42, wherein the impulse noise reducing unit includes a medium conveyance control unit that controls electromagnetic clutches, each provided on each of routes for conveying a recording medium each having a plurality of medium feed trays, such that only electromagnetic clutches positioned on a used medium feed tray or above operate.

44. The image formation apparatus according to claim 33, comprising a pure-tone-component reducing unit that reduces a pure-tone-component to fulfill the condition (f).

45. The image formation apparatus according to claim 44, wherein the pure-tone-component reducing unit includes a charging noise reducing unit that reduces charging noise generated during a charging due to an AC bias.

46. The image formation apparatus according to claim 45, wherein the charging noise reducing unit has an eigen frequency of an image holder that is different from a frequency obtained by multiplying a natural number to a frequency of the AC bias.

47. The image formation apparatus according to claim 45, wherein the charging noise reducing unit has a sound absorbing member inside an image holder.

48. The image formation apparatus according to claim 45, wherein the charging noise reducing unit has an oscillation control member inside an image holder.

49. The image formation apparatus according to claim 33, comprising a guiding member in a route of a recording medium, wherein guiding member the includes a flexible sheet having a bent end edge portion or having a thickness of one half or smaller to control the conveying route of the recording medium.

50. An image formation apparatus having an arrangement so that a discomfort probability P, calculated from an expression (g), fulfills a condition (f), wherein the discomfort probability P is calculated using a sound pressure level value (A) in decibels, a loudness value of a psycho-acoustics parameter, a sharpness value, a tonality value, an impulsiveness value, and a printing speed ppm, obtained from operation noise at a position with a predetermined distance from an end surface of the image formation apparatus, $$P = \frac{1}{1 + \exp(-z \pm 2\sigma)} \tag{g}$$

$$P \leqq 0.1728e^{0.0065\,ppm} \tag{f}$$

where $$z = 0.12808364 \times \text{sound pressure level } i + 0.47043907 \times \text{loudness } i + 1.07885872 \times \text{sharpness } i + 9.27879937 \times \text{tonality } i + 2.89529674 \times \text{impulsiveness } i - 0.0155008 \times ppm\ i - 15.09832827$$

i=1, 2, 3, . . . , n

σ is standard error=0.871894 ppm is a printing speed per minute for A4 horizontal size recording medium.

51. The image formation apparatus according to claim 50, wherein a multiple logistic regression model $$\hat{P}_{ij} = 1 \Big/ \left\{1 + \exp\left[-\left(\sum_{l=1}^{L} b_l(x_{li} - x_{lj})\right)\right]\right\},$$

where $b_l$ is regression coefficient $x_{li}$ and $x_{lj}$ are psychological acoustic parameter values of sounds that are compared in pair i=1, 2, 3, . . . , n j=1, 2, 3, . . . , n l=1, 2, 3, . . . , that predicts a probability of dominance of sound based on a paired comparison of sounds transforms the expression (e) for calculating the discomfort probabilities into an expression that predicts a discomfort probability of single noise by using an average value of psycho-acoustics parameter values of whole samples that are used to derive a regression model expression.

52. The image formation apparatus according to claim 50, wherein the discomfort probability P, in at least a direction of an operating section, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

53. The image formation apparatus according to claim 50, wherein an average value of the discomfort probability P, in four directions of front, back, left, and right sides, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

54. The image formation apparatus according to claim 50, wherein the discomfort probability P, on at least one side, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

55. The image formation apparatus according to claim 50, wherein the discomfort probability P, on all the four sides, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

56. The image formation apparatus according to claim 50, comprising a higher-frequency-component reducing unit that reduces a higher-frequency-component to fulfill the condition (f).

57. The image formation apparatus according to claim 56, wherein the higher-frequency-component reducing unit includes a guiding member in a medium conveying unit and a sliding noise reducing unit that reduces sliding noise of the recording medium.

58. The image formation apparatus according to claim 50, comprising an impulse-noise reducing unit that reduces impulse noise to fulfill the condition (f).

59. The image formation apparatus according to claim 58, wherein the impulse noise reducing unit includes a medium conveyance control unit that controls electromagnetic clutches, each provided on each of routes for conveying a recording medium each having a plurality of medium feed trays, such that only electromagnetic clutches positioned on a used medium feed tray or above operate.

60. The image formation apparatus according to claim 50, comprising a pure-tone-component reducing unit that reduces a pure-tone-component to fulfill the condition (f).

61. The image formation apparatus according to claim 60, wherein the pure-tone-component reducing unit includes a charging noise reducing unit that reduces charging noise generated during a charging due to an AC bias.

62. The image formation apparatus according to claim 61, wherein the charging noise reducing unit has an eigen frequency of an image holder that is different from a frequency obtained by multiplying a natural number to a frequency of the AC bias.

63. The image formation apparatus according to claim 61, wherein the charging noise reducing unit has a sound absorbing member inside an image holder.

64. The image formation apparatus according to claim 61, wherein the charging noise reducing unit has an oscillation control member inside an image holder.

65. The image formation apparatus according to claim 50, comprising a guiding member in a route of a recording medium, wherein guiding member the includes a flexible sheet having a bent end edge portion or having a thickness of one half or smaller to control the conveying route of the recording medium.

66. An image formation apparatus having an arrangement so that a discomfort probability P, calculated from an expression (h), fulfills a condition (e), wherein the discomfort probability P is calculated using a sound pressure level value (A) in decibels, a loudness value of a psycho-acoustics parameter, a sharpness value, a tonality value, an impulsiveness value, and a printing speed ppm, obtained from operation noise at a position with a predetermined distance from an end surface of the image formation apparatus, $$P = \frac{1}{1 + \exp(-z)} \quad \text{(h)}$$

$$P \leqq 0.1728e^{0.0065\,ppm} \quad \text{(f)}$$

where $$\hat{P}_{ij} = 1 \Big/ \left\{1 + \exp\left[-\left(\sum_{l=1}^{L} b_l(x_{li} - x_{lj})\right)\right]\right\},$$

i=1, 2, 3, . . . , n ppm is a printing speed per minute for A4 horizontal size recording medium.

67. The image formation apparatus according to claim 66, wherein a multiple logistic regression model $$z = 0.12808364 \times \text{sound pressure level } i + 0.47043907 \times \text{loudness } i + 1.07885872 \times \text{sharpness } i + 9.27879937 \times \text{tonality } i + 2.89529674 \times \text{impulsiveness } i - 0.0155008 \times ppm\ i - 15.09832827$$

where $b_l$ is regression coefficient $x_{li}$ and $x_{lj}$ are psychological acoustic parameter values of sounds that are compared in pair i=1, 2, 3, . . . , n j=1, 2, 3, . . . , n l=1, 2, 3, . . . , that predicts a probability of dominance of sound based on a paired comparison of sounds transforms the expression (e) for calculating the discomfort probabilities into an expression that predicts a discomfort probability of single noise by using an average value of psycho-acoustics parameter values of whole samples that are used to derive a regression model expression.

68. The image formation apparatus according to claim 66, wherein the discomfort probability P, in at least a direction of an operating section, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

69. The image formation apparatus according to claim 66, wherein an average value of the discomfort probability P, in four directions of front, back, left, and right sides, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

70. The image formation apparatus according to claim 66, wherein the discomfort probability P, on at least one side, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

71. The image formation apparatus according to claim 66, wherein the discomfort probability P, on all the four sides, of the sound generated by the image formation apparatus is at a permissible level or below, at a distance of 1.00±0.03 meters from an end surface of the image formation apparatus, and at a height of 1.20±0.03 meters above the floor or 1.50±0.03 meters above the floor.

72. The image formation apparatus according to claim 66, comprising a higher-frequency-component reducing unit that reduces a higher-frequency-component to fulfill the condition (f).

73. The image formation apparatus according to claim 72, wherein the higher-frequency-component reducing unit includes a guiding member in a medium conveying unit and a sliding noise reducing unit that reduces sliding noise of the recording medium.

74. The image formation apparatus according to claim 66, comprising an impulse-noise reducing unit that reduces impulse noise to fulfill the condition (f).

75. The image formation apparatus according to claim 74, wherein the impulse noise reducing unit includes a medium conveyance control unit that controls electromagnetic clutches, each provided on each of routes for conveying a recording medium each having a plurality of medium feed trays, such that only electromagnetic clutches positioned on a used medium feed tray or above operate.

76. The image formation apparatus according to claim 66, comprising a pure-tone-component reducing unit that reduces a pure-tone-component to fulfill the condition (f).

77. The image formation apparatus according to claim 76, wherein the pure-tone-component reducing unit includes a charging noise reducing unit that reduces charging noise generated during a charging due to an AC bias.

78. The image formation apparatus according to claim 77, wherein the charging noise reducing unit has an eigen frequency of an image holder that is different from a frequency obtained by multiplying a natural number to a frequency of the AC bias.

79. The image formation apparatus according to claim 77, wherein the charging noise reducing unit has a sound absorbing member inside an image holder.

80. The image formation apparatus according to claim 77, wherein the charging noise reducing unit has an oscillation control member inside an image holder.

81. The image formation apparatus according to claim 66, comprising a guiding member in a route of a recording medium, wherein guiding member the includes a flexible sheet having a bent end edge portion or having a thickness of one half or smaller to control the conveying route of the recording medium.

82. A method of evaluating a sound generated by an image formation apparatus when forming an image onto a recording medium, the method comprising:

recording an operation noise generated by each of a plurality of image formation apparatuses each having a different image formation speed;

preparing a plurality of sample sounds from the operation noises;

measuring a psycho-acoustics parameter for each of the sample sounds;

evaluating the sample sounds using a paired comparison method;

carrying out a logistic regression analysis by using a discomfort probability of two kinds of sound using the evaluation of the sample sounds as objective variables and a difference of psycho-acoustics parameters as explanatory variables;

deriving a sound quality evaluation expression used to predict a probability of discomfort of sound based on a result of the logistic regression analysis; and evaluating sound quality by using the sound quality evaluation expression.

83. The method according to claim 82, wherein the recording includes recording the operation noise binaurally.

84. The method according to claim 82, wherein the recording includes recording the operation noise of the image formation apparatus at a distance of 1.00±0.03 meters from an end surface of the image formation apparatus, and at a height of 1.20±0.03 meters above the floor or 1.50±0.03 meters above the floor.

85. The method according to claim 82, wherein the recording includes recording the operation noise from at least a direction in which an operating unit is provided in the image formation apparatus.

86. The method according to claim 82, wherein the recording includes recording the operation noise from four directions of front, back, left, and right sides of the image formation apparatus.

87. The method according to claim 82, wherein the preparing the sample sounds includes attenuating or emphasizing portions of main sound sources, on a frequency axis or a time axis, from the operation noises.

88. The method according to claim 82, wherein the preparing the sample sound includes attenuating or emphasizing portions of at least one of main sound sources of metal impulse noise, medium impulse noise, meduim sliding noise, motor driving noise, and charging noise, on a frequency axis or a time axis, from the operation noises.

89. The method according to claim 82, wherein the psycho-acoustics parameters include one or more of a loudness value, a sharpness value, a tonality value, an impulsiveness value, a roughness value, a relative approach value, and a sound quality level value.

90. The method according to claim 82, wherein the evaluating the sample sound includes evaluating the sample sounds for each image formation speed using a paired comparison method.

91. The method according to claim 82, wherein the evaluating the sound quality includes deriving an expression (i) concerning a discomfort probability of sound from a result of the logistic regression analysis, $$\hat{P}_{ij} = 1 \Big/ \left\{ 1 + \exp \begin{bmatrix} -0.650842(\chi_{loudness\ i} - \chi_{loudness\ j}) - \\ 1.022138(\chi_{sharpness\ i} - \chi_{sharpness\ j}) - \\ 12.08128(\chi_{tonality\ i} - \chi_{tonality\ j}) - \\ 3.595879(\chi_{impulse\ i} - \chi_{impulse\ j}) \end{bmatrix} \right\} \quad \text{(i)}$$

substituting an average value of the psycho-acoustics parameter values used to derive the expression (i) into the expression (i), thereby to derive the sound quality evaluation expression.

92. The method according to claim 91, wherein the evaluating the sound quality includes deriving the expression (i); and substituting an average value of psycho-acoustics parameter values used to derive the expression (i) into the expression (i) while taking the probability (P) to be 0.5.

93. The method according to claim 82, wherein the deriving the sound quality evaluation expression includes deriving an expression (j) concerning a discomfort probability of sound from a result of the logistic regression analysis, $$P = \frac{1}{1 + \exp(-z)} \quad \text{(j)}$$

where $$\begin{aligned} z = {} & 0.12808364 \times (\text{sound pressure level } i - \text{sound pressure } j) + \\ & 0.47043907 \times (\text{loudness } i - \text{loudness } j) + \\ & 1.785872 \times (\text{sharpness } i - \text{sharpness } j) + \\ & 9.27879937 \times (\text{tonality } i - \text{tonality } j) + \\ & 2.89529674 \times (\text{impulsiveness } i - \text{impulsiveness } j) - \\ & 0.0114246 \times (ppm\ i - ppm\ j) - \\ & 0.0040762 \times (ppm \text{ average value } i - ppm \text{ average value } j) \end{aligned}$$

where ppm is a printing speed per minute for A4 horizontal size recording medium; and deriving the sound quality evaluation expression by substituting an average value of the psycho-acoustics parameter values used to derive the expression (j) into the expression (j).

94. The method according to claim 93, wherein the deriving the sound quality evaluation expression includes deriving the expression (j); and deriving the sound quality evaluation expression by substituting a total average value of psycho-acoustics parameter values, a printing speed per minute for A4 horizontal size recording medium, and an average value of the printing speed that are used to derive the expression (j) into the expression (j), while taking the probability (P) to be 0.5.

95. A method of manufacturing an image formation apparatus, comprising:

a design step of designing each section of the apparatus so that a discomfort probability (P) calculated according to the expression (k) fulfills the condition (l) by using a loudness value, a sharpness value, a tonality value, and an impulsiveness value of psycho-acoustics parameters obtained from sounds that the image formation apparatus emits at the time of forming an image onto a recording medium, the sounds being collected at a position with a distance from an end surface of the image formation apparatus, $$\hat{P}_{im} = 1/\{1 + \exp[-z]\} \quad \text{(k)}$$

$$\hat{P}_{im} \leqq 0.2725 \ln(\text{ppm}) - 0.6331 \quad \text{(l)}$$

where $z = A \times \text{sound pressure level } i + B \times \text{loudness } i + C \times \text{sharpness } i + D \times \text{tonality } i + \text{impulsiveness } i + F$ i=1, 2, 3, . . . , n A, B, C, D, and E are regression coefficients of parameters, and F is intercept, and A, B, C, D, E, and F satisfy the inequalities $0.142 \leqq A \leqq 0.183$ $0.300 \leqq B \leqq 0.389$ $1.097 \leqq C \leqq 1.265$ $9.818 \leqq D \leqq 11.516$ $2.588 \leqq E \leqq 3.240$ $-18.844 \leqq F \leqq -14.968$; and a manufacturing step of manufacturing the image formation apparatus according to contents designed at the design step.

96. A method of manufacturing an image formation apparatus, comprising:

a design step of designing each section of the apparatus so that a discomfort probability (P) calculated according to the expression (m) fulfills the condition (l) by using a loudness value, a sharpness value, a tonality value, and an impulsiveness value of psycho-acoustics parameters obtained from sounds that the image formation apparatus emits at the time of forming an image onto a recording medium, the sounds being collected at a position with a distance from an end surface of the image formation apparatus, $$\hat{P}_{i\varpi} = 1 \Big/ \left\{ 1 + \exp\left[ \begin{array}{l} 16.90601 - 0.1625723\chi_{sound\ pressure\ level} - \\ 0.34475769\chi_{loudness\ i} - 1.18093783\chi_{sharpness\ i} - \\ 10.6669829\chi_{tonality\ i} - 2.91380546\chi_{impulse\ i} \pm \\ 2\hat{\sigma} \end{array} \right] \right\} \quad \text{(m)}$$

$$\hat{P}_{im} \leqq 0.2725 \ln(\text{ppm}) - 0.6331 \quad \text{(l)}$$

where i=1, 2, 3, . . . , n; and a manufacturing step of manufacturing the image formation apparatus according to contents designed at the design step.

97. A method of manufacturing an image formation apparatus, comprising:

a design step of designing each section of the apparatus so that a discomfort probability (P) calculated according to the expression (n) fulfills the condition (l) by using a loudness value, a sharpness value, a tonality value, and an impulsiveness value of psycho-acoustics parameters obtained from sounds that the image formation apparatus emits at the time of forming an image onto a recording medium, the sounds being collected at a position with a distance from an end surface of the image formation apparatus;

$$\hat{P}_{i\varpi} = 1 \Big/ \left\{ 1 + \exp\left[ \begin{array}{l} 16.90601 - 0.1625723\chi_{sound\ pressure\ level} - \\ 0.34475769\chi_{loudness\ i} - 1.18093783\chi_{sharpness\ i} - \\ 10.6669829\chi_{tonality\ i} - 2.91380546\chi_{impulse\ i} \end{array} \right] \right\} \quad \text{(n)}$$

$$\hat{P}_{im} \leqq 0.2725 \ln(\text{ppm}) - 0.6331 \quad \text{(l)}$$

where i=1, 2, 3, . . . , n; and a manufacturing step of manufacturing the image formation apparatus according to contents designed at the design step.

98. A method of manufacturing an image formation apparatus, comprising:

a design step of designing each section of the apparatus so that a discomfort probability (P) calculated according to the expression (o) fulfills the condition (p) by using a loudness value, a sharpness value, a tonality value, an impulsiveness value, and a printing speed ppm for A4 horizontal size medium per minute, of psycho-acoustics parameters obtained from sounds that the image formation apparatus emits at the time of forming an image onto a recording medium, the sounds being collected at a position with a distance from an end surface of the image formation apparatus, $$P = \frac{1}{1 + \exp(-z)} \quad \text{(o)}$$

$$P \leqq 0.1728e^{0.00065\ ppm} \quad \text{(p)}$$

where $z = A \times \text{sound pressure level } o + B \times \text{loudness } i + C \times \text{sharpness } i + D \times \text{tonality } i + E \times \text{impulsiveness } i + F \times \text{ppm } i + G$ i=1, 2, 3, . . . , n A, B, C, D, E, and F are regression coefficients of parameters, and G is intercept, and A, B, C, D, E, F, and G satisfy the inequalities $0.10547717 \leqq A \leqq 0.15069022$ $0.40687921 \leqq B \leqq 0.53399976$ $0.99138725 \leqq C \leqq 1.166331$ $8.38547981 \leqq D \leqq 10.1721249$ $2.57373312 \leqq E \leqq 3.21686388$ $-0.020344 \leqq F \leqq -0.0106576$ $-17.49359273 \leqq G \leqq 12.70308101$; and a manufacturing step of manufacturing the image formation apparatus according to contents designed at the design step.

99. A method of manufacturing an image formation apparatus, comprising:

a design step of designing each section of the apparatus so that a discomfort probability (P) calculated according to the expression (q) fulfills the condition (p) by using a loudness value, a sharpness value, a tonality value, an impulsiveness value, and a printing speed ppm for A4 horizontal size medium per minute, of psycho-acoustics parameters obtained from sounds that the image formation apparatus emits at the time of forming an image onto a recording medium, the sounds being collected at a position with a distance from an end surface of the image formation apparatus, $$P = \frac{1}{1 + \exp(-z \pm 2\sigma)} \quad \text{(q)}$$

$$P \leqq 0.1728e^{0.0065\ ppm} \quad \text{(p)}$$

where $$z = 0.12808364 \times \text{sound pressure level } i + 0.47043907 \times \text{loudness } i + 1.07885782 \times \text{sharpness } i + 9.27879937 \times \text{tonality } i +$$

-continued $$2.89529674 \times \text{impulsiveness } i - 0.01558008 \times \text{ppm } i - 15.09832827$$

i=1, 2, 3, . . . , n

σ is standard error=0.871894; and a manufacturing step of manufacturing the image formation apparatus according to contents designed at the design step.

100. A method of manufacturing an image formation apparatus, comprising:

a design step of designing each section of the apparatus so that a discomfort probability (P) calculated according to the expression (r) fulfills the condition (p) by using a loudness value, a sharpness value, a tonality value, an impulsiveness value, and a printing speed ppm for A4 horizontal size medium per minute, of psycho-acoustics parameters obtained from sounds that the image formation apparatus emits at the time of forming an image onto a recording medium, the sounds being collected at a position with a distance from an end surface of the image formation apparatus, $$P = \frac{1}{1 + \exp(-z)} \tag{r}$$

$$P \leqq 0.1728e^{0.0065\,ppm} \tag{p}$$

where $$z = 0.12808364 \times \text{sound pressure level } i + 0.47043907 \times \text{loudness } i + 1.07885872 \times \text{sharpness } i + 9.27879937 \times \text{tonality } i + 2.89529674 \times \text{impulsiveness } i - 0.0155008 \times \text{ppm } i - 15.09832827;$$

and a manufacturing step of manufacturing the image formation apparatus according to contents designed at the design step.

101. A method of remodeling an image formation apparatus comprising:

a sound collecting step of collecting sounds that the image formation apparatus emits at the time of forming an image onto a recording medium, at a sound collection position with a distance from an end surface of the image formation apparatus to be remodeled; and a remodeling step of remodeling a configuration of the apparatus so that a probability (P) calculated according to the expression (s) fulfills the condition (t) by using a loudness value, a sharpness value, a tonality value, and an impulsiveness value of psycho-acoustics parameters obtained from a result of the sound collected at the sound collecting step, where $$\hat{P}_{im} = 1/\{1 + \exp[-z]\} \tag{s}$$

$$\hat{P}_{im} \leqq 0.2725 \ln(\text{ppm}) - 0.6331 \tag{t}$$

where $$z = A \times \text{sound pressure level } i + B \times \text{loudness } i + C \text{ sharpness } i + D \times \text{tonality } i + E \times \text{impulsiveness } i + F$$

i=1, 2, 3, . . . , n

A, B, C, D, and E are regression coefficients of parameters, and F is intercept, and A, B, C, D, E, and F satisfy the inequalities $0.142 \leqq A \leqq 0.183$ $0.300 \leqq B \leqq 0.389$ $1.097 \leqq C \leqq 1.265$ $9.818 \leqq D \leqq 11.516$ $2.588 \leqq E \leqq 3.240$ $-18.844 \leqq F \leqq -14.968$.

102. A method of remodeling an image formation apparatus comprising:

a sound collecting step of collecting sounds that the image formation apparatus emits at the time of forming an image onto a recording medium, at a sound collection position with a distance from an end surface of the image formation apparatus to be remodeled; and a remodeling step of remodeling a configuration of the apparatus so that a probability (P) calculated according to the expression (u) fulfills the condition (t) by using a loudness value, a sharpness value, a tonality value, and an impulsiveness value of psycho-acoustics parameters obtained from a result of the sound collected at the sound collecting step, where $$\hat{P}_{i\varpi} = 1 \Big/ \left\{ 1 + \exp \begin{bmatrix} 16.90601 - 0.1625723\chi_{soundpressure\ level} - \\ 0.34475769\chi_{loudness\ i} - 1.18093783\chi_{sharpness\ i} - \\ 10.6669829\chi_{tonality\ i} - 2.91380546\chi_{impulse\ i} \pm \\ 2\hat{\sigma} \end{bmatrix} \right\} \tag{u}$$

$$\hat{P}_{im} \leqq 0.2725 \ln(\text{ppm}) - 0.6331 \tag{t}$$

where i=1, 2, 3, . . . , n

σ is standard error.

103. A method of remodeling an image formation apparatus comprising:

a sound collecting step of collecting sounds that the image formation apparatus emits at the time of forming an image onto a recording medium, at a sound collection position with a distance from an end surface of the image formation apparatus to be remodeled; and a remodeling step of remodeling a configuration of the apparatus so that a probability (P) calculated according to the expression (v) fulfills the condition (t) by using a loudness value, a sharpness value, a tonality value, and an impulsiveness value of psycho-acoustics parameters obtained from a result of the sound collected at the sound collecting step.

$$\hat{P}_{i\varpi} = 1 \Big/ \left\{ 1 + \exp \begin{bmatrix} 16.90601 - 0.1625723\chi_{soundpressure\ level} - \\ 0.34475769\chi_{loudness\ i} - 1.18093783\chi_{sharpness\ i} - \\ 10.6669829\chi_{tonality\ i} - 2.91380546\chi_{impulse\ i} \end{bmatrix} \right\} \tag{v}$$

$$\hat{P}_{im} \leqq 0.2725 \ln(\text{ppm}) - 0.6331 \tag{t}$$

where i=1, 2, 3, . . . , n.

104. A method of remodeling an image formation apparatus comprising:

a sound collecting step of collecting sounds that the image formation apparatus emits at the time of forming an image onto a recording medium, at a sound collection position with a distance from an end surface of the image formation apparatus to be remodeled; and a remodeling step of remodeling a configuration of the apparatus so that a probability (P) calculated according to the expression (w) fulfills the condition (x) by using a loudness value, a sharpness value, a tonality value, an impulsiveness value, and a printing speed ppm for A4 horizontal size medium per minute, of psychoacoustics parameters obtained from a result of the sound collected at the sound collecting step, $$P = \frac{1}{1 + \exp(-z)} \quad \text{(w)}$$

$$P \leqq 0.1728e^{0.006S\ ppm} \quad \text{(x)}$$

where $$z = A \times \text{sound pressure level } i + B \times \text{loudness } i + C \text{ sharpness } i + D \times \text{tonality } i + E \times \text{impulsiveness } i + F \times \text{ppm } i + G$$

i=1, 2, 3, . . . , n

A, B, C, D, E, and F are regression coefficients of parameters, and G is intercept, and A, B, C, D, E, F, and G satisfy the inequalities $0.10547717 \leqq A \leqq 0.15069022$ $0.40687921 \leqq B \leqq 0.53399976$ $0.99138725 \leqq C \leqq 1.166331$ $8.38547981 \leqq D \leqq 10.1721249$ $2.57373312 \leqq E \leqq 3.21686388$ $-0.020344 \leqq F \leqq -0.0106576$ $-17.49359273 \leqq G \leqq 12.70308101$ ppm is a printing speed per minute for A4 horizontal size recording medium.

105. A method of remodeling an image formation apparatus comprising:

a sound collecting step of collecting sounds that the image formation apparatus emits at the time of forming an image onto a recording medium, at a sound collection position with a distance from an end surface of the image formation apparatus to be remodeled; and a remodeling step of remodeling a configuration of the apparatus so that a probability (P) calculated according to the expression (y) fulfills the condition (x) by using a loudness value, a sharpness value, a tonality value, an impulsiveness value, and a printing speed ppm for A4 horizontal size medium per minute, of psychoacoustics parameters obtained from a result of the sound collected at the sound collecting step, $$P = \frac{1}{1 + \exp(-z \pm 2\sigma)} \quad \text{(y)}$$

$$P \leqq 0.1728e^{0.006S\ ppm} \quad \text{(x)}$$

where $$z = 0.12808364 \times \text{sound pressure level } i + 0.47043907 \times \text{loudness } i + 1.07885872 \times \text{sharpness } i + 9.27879937 \times \text{tonality } i + 2.89529674 \times \text{impulsiveness } i - 0.0155008 \times \text{ppm } i - 15.09832827$$

i=1, 2, 3, . . . , n

σ is standard error=0.871894 ppm is a printing speed per minute for A4 horizontal size recording medium.

106. A method of remodeling an image formation apparatus comprising:

a sound collecting step of collecting sounds that the image formation apparatus emits at the time of forming an image onto a recording medium, at a sound collection position with a distance from an end surface of the image formation apparatus to be remodeled; and a remodeling step of remodeling a configuration of the apparatus so that a probability (P) calculated according to the expression (z) fulfills the condition (x) by using a loudness value, a sharpness value, a tonality value, an impulsiveness value, and a printing speed ppm for A4 horizontal size medium per minute, of psychoacoustics parameters obtained from a result of the sound collected at the sound collecting step, where $$P = \frac{1}{1 + \exp(-z)} \quad \text{(z)}$$

$$P \leqq 0.1728e^{0.06S\ ppm} \quad \text{(x)}$$

where $$z = 0.12808364 \times \text{sound pressure level } i + 0.47043907 \times \text{loudness } i + 1.07885872 \times \text{sharpness } i + 9.27879937 \times \text{tonality } i + 2.89529674 \times \text{impulsiveness } i - 0.0155008 \times \text{ppm } i - 15.09832827$$

i=1, 2, 3, . . . , n.

* * * * *